US006327795B1

(12) United States Patent
Russell

(10) Patent No.: US 6,327,795 B1
(45) **Date of Patent: *Dec. 11, 2001**

(54) SOLE CONSTRUCTION FOR ENERGY STORAGE AND REBOUND

(75) Inventor: Brian A. Russell, Littleton, CO (US)

(73) Assignee: Britek Footwear Development, LLC, Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/313,778

(22) Filed: May 17, 1999

Related U.S. Application Data

(63) Continuation-in-part of application No. 09/135,974, filed on Aug. 18, 1998, and a continuation-in-part of application No. 08/903,130, filed on Jul. 30, 1997, now Pat. No. 5,937,544.

(51) Int. Cl.[7] ..... A43B 13/18
(52) U.S. Cl. ..... 36/28; 36/27; 36/29
(58) Field of Search ..... 36/27, 28, 29, 36/3 B, 28 R

(56) References Cited

U.S. PATENT DOCUMENTS

| | | |
|---|---|---|
| Re. 33,066 | 9/1989 | Stubblefield . |
| D. 321,975 | 12/1991 | Amulf et al. . |
| D. 326,956 | 6/1992 | Damianoe et al. . |
| D. 331,832 | 12/1992 | Issler . |
| D. 343,272 | 1/1994 | James . |
| D. 347,105 | 5/1994 | Johnson . |
| 904,891 | 11/1908 | Otlerstedt . |
| 1,382,180 | 6/1921 | Emery . |
| 1,778,089 | 10/1930 | Pomerantz . |
| 1,993,208 | 3/1935 | Cohn . |
| 2,058,975 | 10/1936 | Gray . |
| 2,549,343 | 4/1951 | Stoiner . |
| 2,811,791 | 11/1957 | Cox . |
| 3,086,532 | 4/1963 | Mistarz . |
| 3,100,354 | 8/1963 | Lomard et al. . |
| 3,290,801 | 12/1966 | Bente . |
| 3,402,485 | 9/1968 | McMorrow . |
| 3,834,046 | 9/1974 | Fowler . |
| 4,187,620 | 2/1980 | Selner . |
| 4,259,792 | 4/1981 | Halberstadt . |
| 4,266,349 | 5/1981 | Schmohl . |
| 4,335,530 | 6/1982 | Stubblefield . |
| 4,372,058 | 2/1983 | Stubblefield . |
| 4,798,009 | 1/1989 | Colonel et al. . |
| 4,843,735 | 7/1989 | Nakanishi . |
| 4,888,887 | 12/1989 | Solow . |

(List continued on next page.)

FOREIGN PATENT DOCUMENTS

| | | |
|---|---|---|
| WO 92/03069 | 3/1992 | (WO) . |
| 9203069 * | 3/1992 | (WO) . |
| WO 96/39061 | 12/1996 | (WO) . |

*Primary Examiner*—Ted Kavanaugh
(74) *Attorney, Agent, or Firm*—Knobbe, Martens, Olson & Bear, LLP

(57) ABSTRACT

A sole construction for supporting at least a portion of a human foot and for providing energy storage and return is provided. The sole construction includes a generally horizontal layer of stretchable material, at least one chamber positioned adjacent a first side of the layer, and at least one actuator positioned adjacent a second side of the layer vertically aligned with a corresponding chamber. Each actuator has a footprint size smaller than that of the corresponding chamber, and is sized and arranged to provide individual support to the bones of the human foot. The support structure when compressed causes the actuator to push against the layer and move the layer at least partially into the corresponding chamber. In one embodiment, dual action energy storage and rebound is provided by using a plurality of actuators that move both upwardly and downwardly into corresponding chambers. In another embodiment, lateral stability is improved by using tapered actuators having a convex shape to accommodate the natural rolling movement of the foot.

8 Claims, 30 Drawing Sheets

U.S. PATENT DOCUMENTS

| | | | |
|---|---|---|---|
| 4,897,937 | | 2/1990 | Misevich et al. . |
| 4,922,631 | | 5/1990 | Anderie . |
| 4,956,927 | | 9/1990 | Misevich et al. . |
| 4,999,931 | | 3/1991 | Vermeulen . |
| 5,005,299 | | 4/1991 | Whatley . |
| 5,083,910 | | 1/1992 | Abshire et al. . |
| 5,092,060 | | 3/1992 | Frachey et al. . |
| 5,195,257 | | 3/1993 | Holcomb et al. . |
| 5,311,680 | | 5/1994 | Comparetto . |
| 5,319,866 | | 6/1994 | Foley et al. . |
| 5,367,791 | | 11/1994 | Gross et al. . |
| 5,384,973 | | 1/1995 | Lyden . |
| 5,440,826 | | 8/1995 | Whatley . |
| 5,465,507 | | 11/1995 | Schumacher et al. . |
| 5,595,003 | * | 1/1997 | Snow . |
| 5,647,145 | | 7/1997 | Russell . |
| 5,937,544 | * | 8/1999 | Russell . |

* cited by examiner

FIG. 12
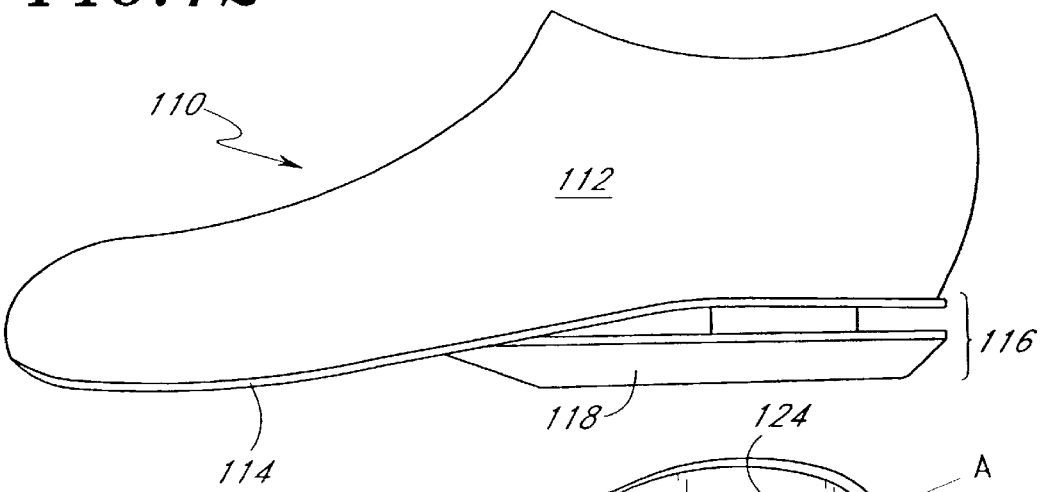
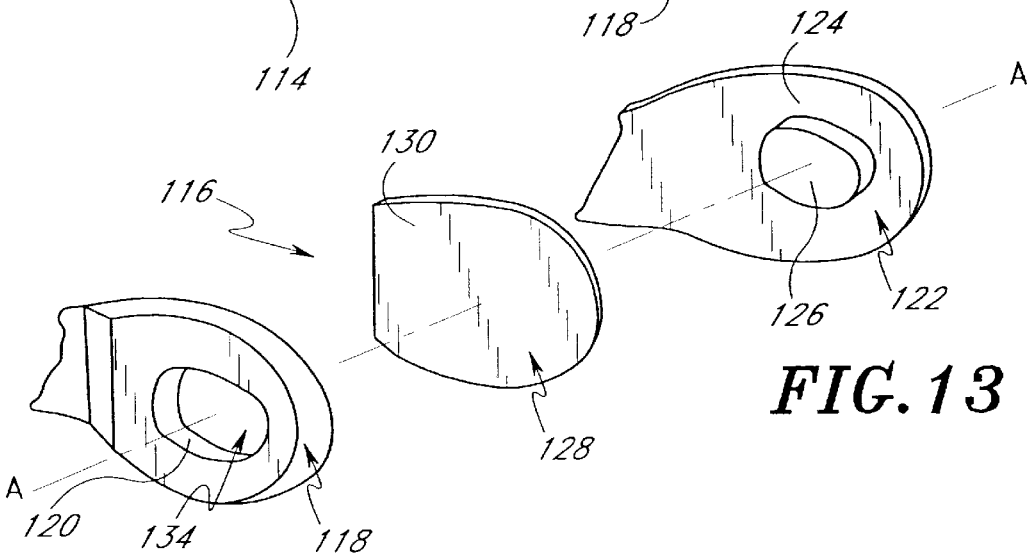
FIG. 13
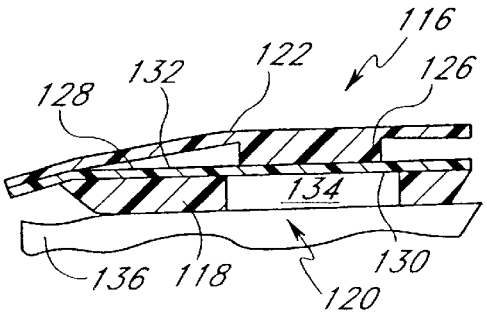
FIG. 14A
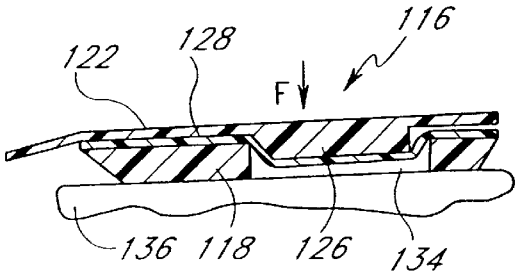
FIG. 14B

FIG. 15
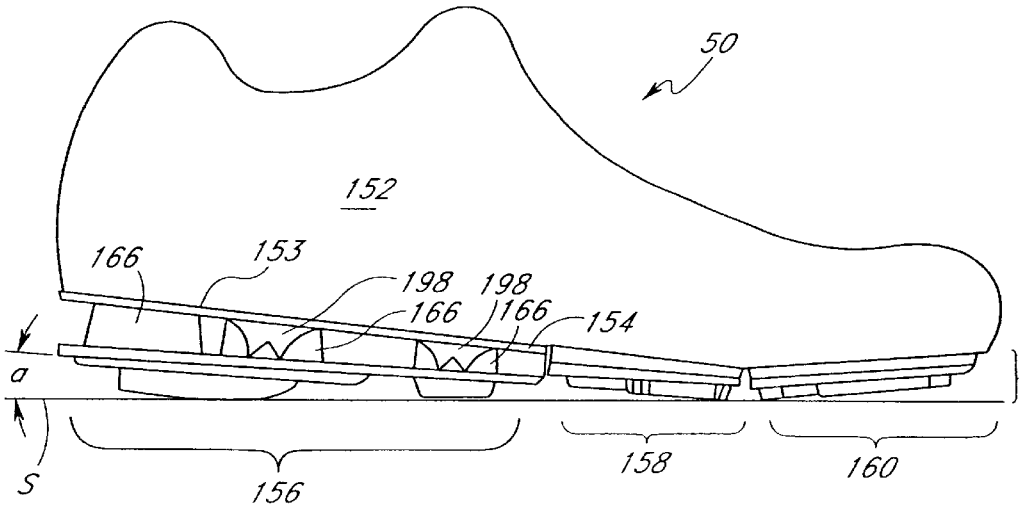
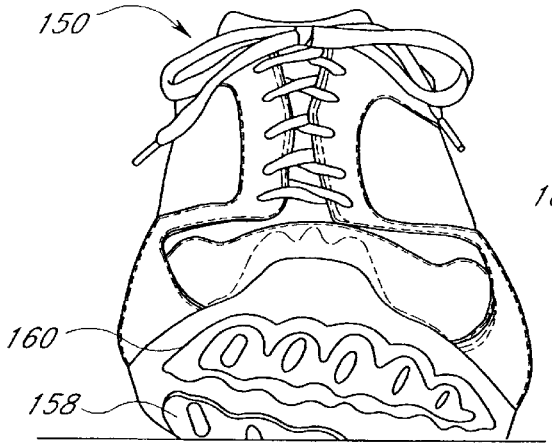
FIG. 16
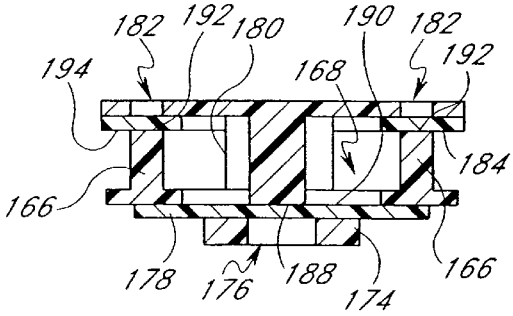
FIG. 19A
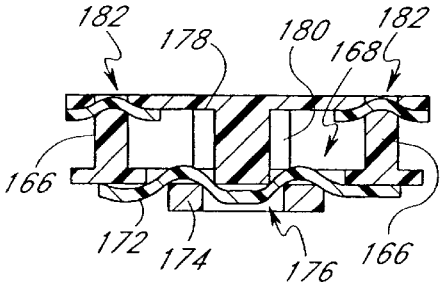
FIG. 19B

SOLE CONSTRUCTION FOR ENERGY STORAGE AND REBOUND

CROSS-REFERENCE TO RELATED APPLICATIONS

This application is a continuation-in-part of application Ser. No. 08/903,130, filed Jul. 30, 1997 now U.S. Pat. No. 5,937,544, and application Ser. No. 09/135,974, filed Aug. 18, 1998, still pending both of which are hereby incorporated by reference in their entirety.

BACKGROUND OF THE INVENTION

1. Field of the Invention

The present invention generally relates to articles of footwear, and more particularly, to a sole construction that may be incorporated into athletic footwear or as an insert into existing footwear and the like in order to store kinetic energy generated by a person. The sole construction has a combination of structural features enabling enhanced storage, retrieval and guidance of wearer muscle energy that complement and augment performance of participants in recreational and sports activities.

2. Description of the Related Art

From the earliest times when humans began wearing coverings on their feet, there has been an ever present desire to make such coverings more useful and more comfortable. Accordingly, a plethora of different types of footwear has been developed in order to meet specialized needs of a particular activity in which the wearer intends to participate. Likewise, there have been many developments to enhance the comfort level of both general and specialized footwear.

The human foot is unique in the animal kingdom. It possesses inherent qualities and abilities far beyond other animals. We can move bi-pedially across the roughest terrain. We can balance on one foot, we can sense the smallest small grain of sand in our shoes. In fact, we have more nerve endings in our feet than our hands.

We literally roll forward, rearward, laterally and medially across the bony structures of the foot. The key word is "roll." The muscles of the foot and ankle system provide a controlled acceleration of forces laterally to medially and vise-versa across the bony structure of the foot. In biomechanical terms these motions are referred to as pronation and supination. The foot is almost never applied flat, in relative position to the ground, yet shoe designers continue to anticipate this event.

The increasing popularity of athletic endeavors has been accompanied by an increasing number of shoe designs intended to meet the needs of the participants in the various sports. The proliferation of shoe designs has especially occurred for participants in athletic endeavors involving rigorous movements, such as walking, running, jumping and the like. In typical walking and running gaits, it is well understood that one foot contacts the support surface (such as the ground) in a "stance mode" while the other foot is moving through the air in a "swing mode." Furthermore, in the stance mode, the respective foot "on the ground" travels through three successive basic phases: heel strike, mid stance and toe off. At faster running paces, the heel strike phase is usually omitted since the person tends to elevate onto his/her toes.

Typical shoe designs fail to adequately address the needs of the participant's foot and ankle system during each of these successive stages. Typical shoe designs cause the participant's foot and ankle system to lose a significant proportion, by some estimates at least thirty percent, of its functional abilities including its abilities to absorb shock, load musculature and tendon systems, and to propel the runner's body forward.

This is because the soles of current walking and running shoe designs fail to address individually the muscles and tendons of a participant's foot. The failure to individually address these foot components inhibits the flexibility of the foot and ankle system, interferes with the timing necessary to optimally load the foot and ankle system, and interrupts the smooth and continuous transfer of energy from the heel to the toes of the foot during the three successive basic phases of the "on the ground" foot travel.

Moreover, in vigorous athletic activities, the athlete generates kinetic energy from the motion of running, jumping, etc. Traditional shoe designs have served merely to dampen the shock from these activities thereby dissipating that energy. Rather than losing the kinetic energy produced by the athlete, it is useful to store and retrieve that energy thereby enhancing athletic performance. Traditional shoe construction, however, has failed to address this need.

Historically, manufacturers of modem running shoes added foam to cushion a wearer's foot. Then, gradually manufacturers developed other alternatives to foam-based footwear for the reason that foam becomes permanently compressed with repeated use and thus ceases to perform the cushioning function. One of the largest running shoe manufacturers, Nike, Inc. of Beaverton, Oregon, has utilized bags of compressed gas as the means to cushion the wearer's foot. A German manufacturer, Puma AG, has proposed a foamless shoe in which polyurethane elastomer is the cushioning material. Another running shoe manufacturer, Reebok International of Stoughton, Mass., recently introduced a running shoe which has two layers of air cushioning. Running shoe designers heretofore have sought to strike a compromise between providing enough cushioning to protect the wearer's heel but not so much that the wearer's foot will wobble and get out of sync with the working of the knee. The Reebok shoe uses air that moves to various parts of the sole at specific times. For example, when the outside of the runner's heel touches ground, it lands on a cushion of air. As the runner's weight bears down, that air is pushed to the inside of the heel, which keeps the foot from rolling inward too much while another air-filled layer is forcing air toward the forefoot. When the runner's weight is on the forefoot, the air travels back to the heel.

In the last several years, there have been some attempts to construct athletic shoes that provide some rebound thereby returning energy to the athlete. Various air bladder systems have been employed to provide a "bounce" during use. In addition, there have been numerous advancements and materials used to construct the sole and the shoe in an effort to make them more "springy."

Furthermore, midsole and sole compression, historically speaking, can be very destabilizing. This is because pitching, tipping and lateral shear of the sole and midsole naturally rebound energies in the opposite direction required for control and energy transfers. Another perplexing problem for shoe engineers has been how to store energy as the foot and ankle system rolls laterally to medially. These rotational forces have been very difficult to absorb and control.

No past shoe designs, including the specific ones cited above, are believed to adequately address the aforementioned needs of the participant's foot and ankle system during walking and running activities in a manner that augments performance. The past approaches, being primarily concerned with cushioning the impact of the wearer's foot with the ground surface, fail to even recognize, let alone begin to address, the need to provide features in the shoe sole that will enhance the storage, retrieval and guidance of a wearer's muscle energy in a way that will complement and augment the wearer's performance during walking, running and jumping activities.

U.S. Pat. No. 5,595,003 to Snow discloses an athletic shoe with a force responsive sole. However, among the problems with the Snow embodiments is that they teach very thick soles comprised of tall cleats, a resilient membrane, deep apertures, and "guide plates." The combination of these components is undesirable because they make up a very heavy shoe. Furthermore, Snow shows numerous small parts that would be cost prohibitive to manufacture. These numerous small cleats cannot affect enough rubber molecules through the resilient membrane to provide a competitive efficiency gain without increasing the thickness of the membrane to the point of impracticability. The heavier and taller midsole and sole of Snow also position the foot further from the ground, providing less stability as well as less neuromuscular input. Moreover, it takes a longer period of time for Snow's cleats to "cycle," i.e., penetrate and rebound. This produces a limiting effect for performance and efficiency gain potential.

Snow's cleats also require vertical guidance, i.e., anti-tipping, such as by Snow's required guide plate. Snow also fails to provide appropriate points of leverage for specific bone structures of the foot, control over the intrinsic rotational involvement of the foot and ankle system, biomechanical guidance, and the ability to produce tunable vertical vectors and transfer energy forward and rearward from heel, midfoot, forefoot and toes and vice-versa.

In my earlier invention disclosed in U.S. Pat. No. 5,647,145 issued Jul. 15, 1997, I teach an athletic footwear sole construction that enhances the performance of the shoe in several ways. First, the construction described in the '145 patent individually addresses the heel, toe, tarsal and metatarsal regions of the foot to allow more flexibility so that the various portions of the sole cooperate with respective portions of the foot. In addition, a resilient layer is provided in the sole which cooperates with cavities formed at various locations to help store energy.

While the advancements in shoe construction described above, including the '145 patent, have provided a great benefit to the athlete, there remains a continued need for increased performance of athletic footwear. There remains a need for an athletic footwear sole construction that can store an increased amount of kinetic energy and return that energy to the athlete to improve athlete performance.

SUMMARY OF THE INVENTION

It is an object of the present invention to provide a new and useful sole construction that may be incorporated into footwear or used as an insert into existing footwear.

It is another object of the present invention to provide a structure for use with footwear that stores kinetic energy when a compressive weight is placed thereon and which releases that energy when the weight is taken off.

It is a further object of the present invention to provide footwear and, specifically, a sole construction therefor, that enhances the performance of a person wearing the footwear.

The present invention provides an athletic footwear sole construction designed to satisfy the aforementioned needs. In one aspect of the present invention, the athletic footwear sole provides a combination of structural features under the heel, midfoot and forefoot regions of the wearer's foot that enable enhanced storage, retrieval and guidance of muscle energy in a manner that complements and augments wearer performance in sports and recreational activities. The sole construction of the present invention enables athletic footwear for walking, running and jumping to improve and enhance performance by complementing, augmenting and guiding the natural flexing actions of the muscles of the foot. The combination of structural features incorporated in the sole construction of the present invention provides unique control over and guidance of the energy of the wearer's foot as it travels through the three successive basic phases of heel strike, mid stance and toe off.

Accordingly, one aspect of the present invention is directed to an athletic footwear having an upper and sole with the sole having heel, midfoot, metatarsal, and toe regions wherein the sole comprises a foundation layer of stiff material attached to the upper and defining a plurality of stretch chambers, a stretch layer attached to the foundation layer and having portions of elastic stretchable material underlying the stretch chambers of the foundation layer, and a thrustor layer attached to the stretch layer and having portions of stiff material underlying and aligned with the stretch chambers of the foundation layer and with the portions of the stretch layer disposed between the thrustor layer and foundation layer. Given the above-defined arrangement, interactions occur between the foundation layer, stretch layer and thrustor layer in response to compressive forces applied thereto upon contact of the heel and midfoot regions and metatarsal and toe regions of the sole with a support surface so as to convert and temporarily store energy applied to heel and midfoot regions and metatarsal and toe regions of the sole by a wearer's foot into mechanical stretching of the portions of the stretch layer into the stretch chambers of the foundation layer. The stored energy is thereafter retrieved in the form of rebound of the stretched portions of the stretch layer and portions of the thrustor layer. Whereas components of the heel and midfoot regions of the sole provide temporary storage and retrieval of energy at central and peripheral sites underlying the heel and midfoot of the wearer's foot, components of the metatarsal and toe regions of the sole provide the temporary storage and retrieval of energy at independent sites underlying the individual metatarsals and toes of the wearer's foot.

In another aspect of the present invention, a sole is adapted for use with an article of footwear to be worn on the foot of a person while the person traverses along a support surface. This sole is operative to store and release energy resulting from compressive forces generated by the person's weight on the support surface. This sole is thus an improvement which can be incorporated with standard footwear uppers. Alternatively, the invention can be configured as an insert sole which can be inserted into an existing shoe or other article of footwear.

In one embodiment, the sole has a first layer of stretchable resilient material that has opposite first and second surfaces. A first profile is formed of a stiff material and is positioned on the first side of the resilient layer. The first profile includes a first profile chamber formed therein. This first profile chamber has an interior region opening toward the first surface of the resilient layer. The first profile and the resilient layer are positioned relative to one another so that the resilient layer spans across the first interior region. A second profile is also formed of a stiff material and is positioned on the second side of the resilient layer opposite the first profile. This second profile includes a primary actuator element that faces the second surface of the resilient layer to define a static state. The first and second profiles are positioned relative to one another with the primary actuator element being oriented relative to the first profile chamber such that the compressive force between the foot and the support surface will move the first and second profiles toward one another. When this occurs, the primary actuator element advances into the first profile chamber thereby stretching the resilient layer into the interior region defining an active state. In the active state, energy is stored by the resilient layer, and the resilient layer releases this energy to move the first and second profiles apart upon removal of the compressive force.

Preferably, the second profile has a second profile chamber formed therein. This second profile chamber has a second interior region opening toward the second surface of the resilient layer so that the resilient layer also spans across this second region. A plunger element is then provided and is disposed in the first interior region. This plunger element moves into and out of the second interior region when the first and second profiles move between the static and active states. Here, also, a plurality of plunger elements may be disposed in the first interior region with these plunger elements operative to move into and out of the second interior region when the first and second profiles move between the static and active states. The plunger element may be formed integrally with the first layer of resilient material.

A third profile may also be provided, with this third profile having a third profile chamber formed therein. This third profile chamber has a third interior region. Here, a second layer of stretchable resilient material spans across the third region. The first profile then includes a secondary actuator element positioned to move into the third interior region and to stretch the second layer of resilient material into the third profile chamber in response to the compressive force. The first profile may also include a plurality of second actuators, and these actuators may extend around a perimeter thereof to define the first profile chamber. The third profile then has a plurality of third chambers each including a second layer of resilient material that spans thereacross. These third profile chambers are each positioned to receive a respective one of the secondary actuators. The first profile in the second actuator may also be formed as an integral, one-piece construction. The third profile and the plunger element may also be formed as an integral, one-piece construction.

The sole according to the present invention can be a section selected from the group consisting of heel sections, metatarsal sections and toe sections. Preferably, the sole includes one of each of these sections so as to underlie the entire foot but to provide independent energy storing support for each of the three major sections of the foot. Alternatively, the present invention may be used in connection with only one or two sections of the foot. In any event, the invention allows either of the first or second profiles to operate in contact with the support surface.

The present invention also contemplates an article of footwear incorporating the sole, as described above, in combination with a footwear upper. In addition, the present invention contemplates an insert sole adapted for insertion into an article of footwear.

In another aspect of the present invention, a support structure provides energy storage and return to at least a portion of a human foot. This support structure comprises a generally horizontal layer of stretchable material, at least one chamber positioned adjacent a first side of the layer, and at least one actuator positioned adjacent a second side of the layer vertically aligned with a corresponding chamber. Each actuator has a footprint size smaller than that of the corresponding chamber. The support structure when compressed causes the actuator to push against the layer and move the layer at least partially into the corresponding chamber. Each actuator is selectively positioned to provide individual support to a portion of the human foot selected from the group consisting of a toe, a metatarsal bone, a midfoot portion and a heel portion.

In another embodiment, an energy storage and return system for footwear and the like is provided. The system comprises at least two stretchable layer portions, each of the portions having an upper side and a lower side. A plurality of actuator elements is provided, wherein at least one of the actuator elements is positioned above a stretchable layer portion and at least one of the actuator elements is positioned below a stretchable layer portion. A plurality of receiving chambers is also provided, wherein each receiving chamber corresponds to one of the actuator elements and is sized and positioned to receive at least partially the corresponding actuator element therein when the actuator elements are compressed toward the receiving chambers. Each of the receiving chambers is preferably located opposite a corresponding actuator element across a stretchable layer portion.

In another aspect of the present invention, an energy return system for footwear and the like is provided. This system comprises at least one layer of stretchable material having a first side and a second side. A plurality of chambers is positioned on either the first side or the second side of the layer. A plurality of actuators each vertically aligned with a corresponding chamber is positioned opposite the chambers across at least one layer of stretchable material, each actuator having a footprint size smaller than that of the chamber. When the footwear receives a generally vertical compressive force, the actuator pushes against the layer and moves at least partially into a chamber. The actuators are patterned according to the structure of the human foot.

In another aspect of the present invention, a sole construction for underlying at least a portion of a human foot is provided. This sole construction comprises a generally horizontal layer of stretchable material having a first side and a second side. A chamber layer having a chamber therein is positioned on the first side of the layer of stretchable material, the chamber having at least one opening facing the first side of the layer of stretchable material. An actuator is positioned on the second side of the layer of stretchable material, the actuator having a footprint size that is smaller than that of the opening of the chamber such that when the sole construction is compressed, the actuator presses against the second side of the layer of stretchable material and at least partially into the chamber of the chamber layer. The actuator is at least partially tapered, which, as used herein, refers to a dimensional reduction in the size of the actuator, either in a vertical or a horizontal direction. For instance, the tapering of the actuator can refer to a vertical decrease in thickness of the actuator, such as by giving the actuator a dome-like shape or sloping surfaces, or by reducing the height or other dimension of the actuator horizontally, such as by tapering or sloping the upper or lower surface of the actuator towards the front of the foot.

In another aspect of the present invention, a sole construction for supporting at least a portion of a human foot is provided. This sole construction comprises a generally horizontal layer of stretchable material having a first side and a second side. A profile piece having a primary chamber therein is positioned on the first side of the layer of stretchable material, the primary chamber having at least one opening facing the first side of the layer of stretchable material. A primary actuator is positioned on the second side of the layer of stretchable material, the primary actuator having a footprint size that is smaller than that of the opening of the primary chamber such that when the sole construction is compressed, the primary actuator presses against the second side of the layer of stretchable material and at least partially into the primary chamber of the first layer. A secondary chamber is positioned within the primary actuator, the secondary chamber having at least one opening facing the second side of the layer of stretchable material. A secondary actuator is positioned on the first side of the layer of stretchable material, the secondary actuator having a footprint size that is smaller than that of the opening of the secondary chamber such that when the sole construction is compressed, the secondary actuator presses against the first side of the layer of stretchable material and at least partially into the secondary chamber.

In another aspect of the present invention, a heel portion for a sole construction is provided. The heel portion comprises a main thrustor, a first layer of stretchable material positioned above the main thrustor, and a satellite thrustor layer positioned above the first layer of stretchable material. The satellite thrustor has an upper surface and a lower surface, the upper surface of the satellite thrustor layer preferably having a plurality of satellite thrustors extending upwardly therefrom. The satellite thrustor layer also has a central opening therein. The heel portion further comprises a second layer of stretchable material positioned above the satellite thrustor layer and a foundation layer positioned above the second layer of stretchable material. The foundation layer preferably has an upper surface and a lower surface and a plurality of satellite openings positioned to receive the satellite thrusters. The heel portion when compressed causes the main thrustor to stretch through the first layer of stretchable material at least partially into the central opening of the satellite thrustor layer and the satellite thrustors to stretch through the second layer of stretchable material at least partially into the satellite openings.

In another aspect of the present invention, a sole construction is provided comprising a generally horizontal layer of stretchable material, a plurality of chambers positioned adjacent a first side of the layer, and a plurality of interconnected actuator elements positioned adjacent a second side of the layer. Each actuator element is vertically aligned with a corresponding chamber and has a footprint size smaller than that of the corresponding chamber. The support structure when compressed causes the actuator element to push against the layer and move the layer at least partially into the corresponding chamber.

These and other features and advantages of the present invention will become apparent to those skilled in the art upon a reading of the following detailed description when considered in connection with the drawings which show and describe exemplary embodiments of the invention.

BRIEF DESCRIPTION OF THE DRAWINGS

FIG. 12 is a side view in elevation of a second exemplary embodiment of an article of footwear incorporating the heel portion of the sole according to the second exemplary embodiment of the present invention.

FIG. 13 is a exploded perspective view of the heel portion of the article of footwear shown in FIG. 12.

FIG. 14A is a side view in cross-section showing the heel portion of FIGS. 12 and 13 in a static state.

FIG. 14B is a side view in cross-section, similar to FIG. 14A except showing the heel portion in an active state.

FIG. 15 is a side view in elevation of an article of footwear having a sole constructed according to a third exemplary embodiment of the present invention.

FIG. 16 is an end view in elevation of the article of footwear shown in FIG. 15.

FIG. 19A is a rear end view in cross-section showing the heel portion of the sole of the article of footwear of FIG. 15 in a static state.

FIG. 19B is a cross-sectional view, similar to FIG. 19A but showing the heel portion in an active state.

DETAILED DESCRIPTION OF THE PREFERRED EMBODIMENTS

Figure 2:
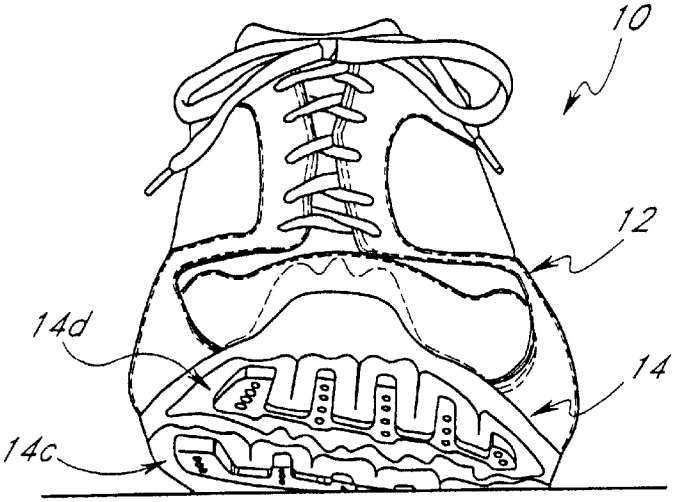
FIG. 2 is a front elevational view of the sole construction of FIG. 1.

The description provided hereinbelow illustrates seven exemplary embodiments of a sole construction according to the present invention. It should be appreciated that each of these embodiments is merely exemplary. Therefore, features from one or more of the embodiments may be added or removed from other embodiments without departing from the scope of the invention. Furthermore, the energy storage and rebound characteristics as described in one embodiment may also be applicable to the other embodiments when similar mechanisms are involved. Moreover, as used herein, the terms "thrustor," "plunger," "lug " and "actuator" are substantially interchangeable and generally refer to actuators used for the storage and rebound of energy.

In general, the embodiments described below provide chambered actuators patterned according to the structure of the foot. In these embodiments, patterned rigidity ensures a smooth transfer of energies (the energy "wave") across the foot. The chambers provide holes for the energy to flow into. Energy always follows the path of least resistance. The staggering of active support actuators and energy exchange chambers balances and supports the intrinsic rolling action of metatarsal bones, toes and heel.

The controlled storing and rebound of energy as described herein do not force the foot into undesired movement; rather it supplies superior position, force and speed information to allow supination and pronation controlling musculature to store and release energy from the energy "wave" process. This produces an efficiency gain, a "tightening up" of the foot's rotational passes through the neutral plane. The resulting sequential stability manages complex energy transfers and storing demands across the foot, enabling the predictable specific vertical vector rebound or thrust of energy required for measurable efficiency gains.

Multiple intrinsic rate limiting factors together control the speed at which the human neuro-muscular system acts and reacts within its natural environment. Rate limiting factors include the contractile proteins actin and myosin, the speed of neuro-muscular input and feedback systems, the natural dash pot effect of involved musculature, the genetic makeup, i.e., ratio of fast to slow twitch muscle fibers, the individual training environment, etc.

With this in mind, there is an optimum speed at which muscles will receive the most energy as well as force, position, perceived resistance and speed information from the environment. Chambered actuators provide a tunable environment for energy and environmental information to be provided to the neuro-muscular skeletal system. Tighter tolerances and shorter drops produce sprint speed efficiency gains, while looser tolerances and increased drops produce slower running speed efficiency gains.

Chambered actuators also resist tipping through the controlled stretching of the membrane externally and more importantly internally, balancing the stretch producing a lateral-to-medial cradling effect. As described below, chambered actuators can utilize either a rigid or rubber internal pattern lug offering optional compression of a rubber lug or the superior vertical guidance of a rigid, e.g., plastic, internal pattern lug.

Raised nesting patterns on the elastic layers provide additional specifically placed thickness while limiting additional weight. Chambered actuators produce a very small footprint in relationship to the amount of surface area, "stretch zone," activated by impact or weight bearing. This generates more power, less weight, less required actuator penetration and faster cycle time.

With these general concepts in mind, the embodiments of the present invention are described below.

First Exemplary Embodiment

Figure 1:
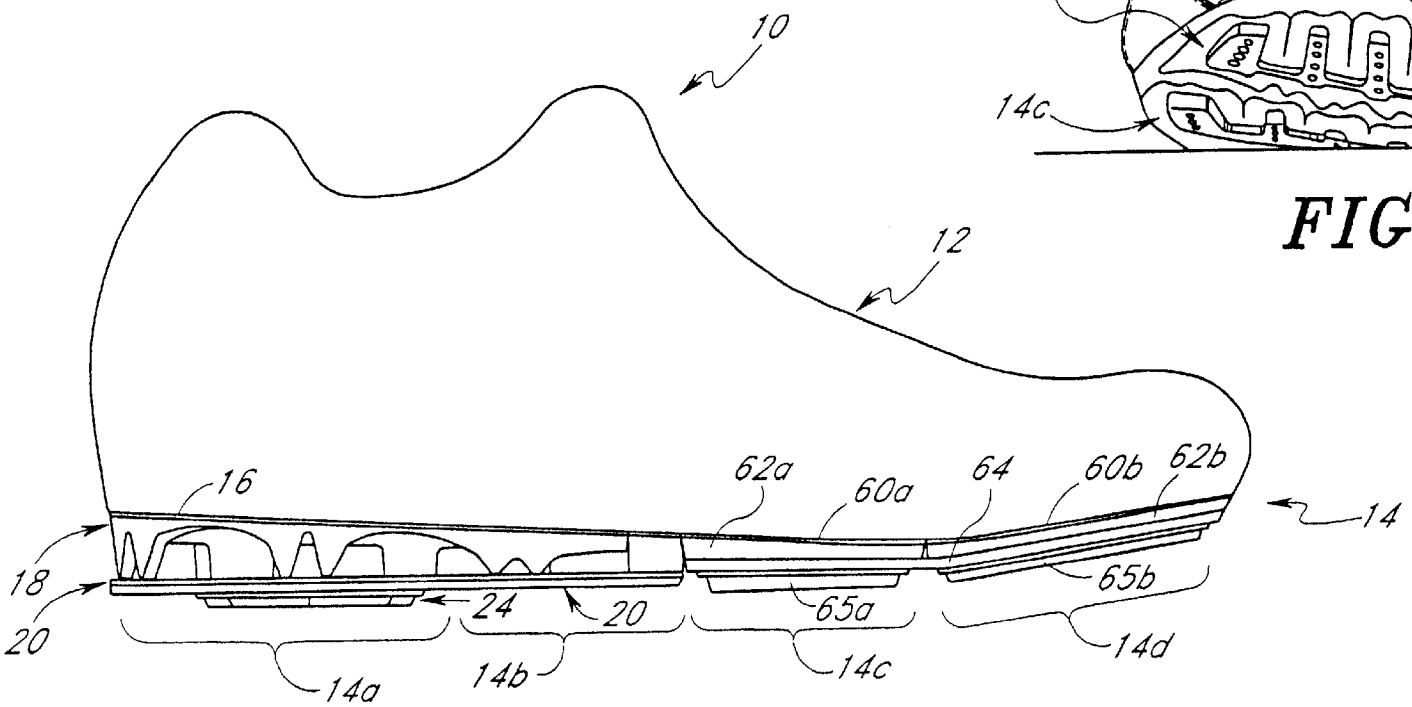
FIG. 1 is a side elevational view of an athletic footwear sole construction in a first exemplary embodiment of the present invention.

Referring to the drawings and particularly to FIGS. 1 and 2, there is illustrated a first exemplary embodiment of an article of athletic footwear for walking, running and/or jumping, being generally designated 10. The footwear 10 includes an upper 12 and a sole 14 having heel and midfoot regions 14A, 14B and metatarsal and toe regions 14C, 14D wherein are provided the structural features of the sole 14 constituting the present invention. The sole 14 incorporating the construction of the present invention improves the walking, running and jumping performance of a wearer of the footwear 10 by providing a combination of structural features which complements and augments, rather than resists, the natural flexing actions of the muscles of the foot to more efficiently utilize the muscular energy of the wearer.

Referring to FIGS. 1 and 3 to 8, the heel and midfoot regions 14A, 14B of the sole 14 basically includes the stacked combination of a footbed layer 16, an upper stretch layer 18, an upper thrustor layer 20, a lower stretch layer 22, and a lower thrustor layer 24. The footbed layer 16 of the sole 14 serves as a foundation for the rest of the stacked components of the heel and midfoot regions 14A, 14B. The footbed layer 16 includes a substantially flat foundation plate 26 of semi-rigid semi-flexible thin stiff material, such as fiberglass, whose thickness is chosen to predetermine the degree of flexion (or bending) it can undergo in response to the load that will be applied thereto.

The foundation plate 26 has a heel portion 26A and a midfoot portion 26B. The foundation plate 26 has a continuous interior lip 26C encompassing a central opening 28 formed in the foundation plate 26 which provides its heel portion 26A with a generally annular shape. The flat foundation plate 26 also has a plurality of continuous interior edges 26D encompassing a corresponding plurality of elongated slots 30 formed in the foundation plate 26 arranged in spaced apart end-to-end fashion so as to provide a U-shaped pattern of the slots 30 starting from adjacent to a forward end 26E of the foundation plate 26 and extending rearwardly therefrom and around the central opening 28. The slots 30 are preferably slightly curved in shape and run along a periphery 26F of the foundation plate 26 but are spaced inwardly from the periphery 26F thereof and outwardly from the central opening 28 thereof so as to leave solid narrow borders respectively adjacent to the periphery 26F and the central opening 28 of the foundation plate 26. The slots 30 alone or in conjunction with recesses 32 of corresponding shape and position in the bottom of the shoe upper 12 define a corresponding plurality of peripheral stretch chambers 34 in the foundation plate 26.

The upper stretch layer 18 is made of a suitable elastic material, such as rubber, and includes a flexible substantially flat stretchable body 36 and a plurality of compressible lugs 38 formed on and projecting downwardly from the bottom surface 36A of the flat stretchable body 36 at the periphery 36B thereof. The peripheral profile of the flat stretchable body 36 of the upper stretch layer 18 generally matches that of the flat foundation plate 26 of the footbed layer 16. In the exemplary embodiment shown in FIGS. 1, 3 and 5 to 8, the compressible lugs 38 are arranged in a plurality of pairs thereof, such as six in number, spaced apart along opposite lateral sides of the flat stretchable body 36. Other arrangements of the compressible lugs 38 are possible so long as it adds stability to the sole 14. For ease of manufacture, the compressible lugs 38 are preferably integrally attached to the flat stretchable body 36.

The upper thrustor layer 20 disposed below and aligned with the upper stretch layer 18 includes a substantially flat support plate 40 preferably made of a relatively incompressible, semi-rigid semi-flexible thin stiff material, such as fiberglass, having a construction similar to that of the flat foundation plate 26 of the footbed layer 16. The flat support plate 40 may have a heel portion 40A and a midfoot portion 40B. The support plate 40 also has a continuous interior rim 40C surrounding a central hole 42 formed through the support plate 40 which provides its heel portion 40A with a generally annular shape. The central hole 42 provides an entrance to a space formed between the flat stretchable body 36 of the upper stretch layer 18 and the flat support plate 40 spaced therebelow which space constitutes a main central stretch chamber 44 of said sole 14. The peripheral profile of the upper thrustor layer 20 generally matches the peripheral profiles of the footbed layer 16 and upper stretch layer 18 so as to provide the sole 14 with a common profile when these components are in an operative stacked relationship with one on top of the other.

The upper thrustor layer 20 also includes a plurality of stretch-generating thrustor lugs 46 made of a relatively incompressible flexible material, such as plastics, and being mounted on the top surface 40D of the flat support plate 40 and projecting upwardly therefrom so as to space the flat support plate 40 below the flat stretchable body 36 of the upper stretch layer 18. The thrustor lugs 46 are arranged in a spaced apart end-to-end fashion which corresponds to that of the slots 30 in the foundation plate 26 so as to provide a U-shaped pattern of the thrustor lugs 46 starting from adjacent to a forward end 40E of the flat support plate 40 and extending rearward therefrom and around the central opening 42. The thrustor lugs 46 run along a periphery 40F of the support plate 40 but are spaced inwardly therefrom and outwardly from the central opening 42 of the support plate 40 so as to leave solid narrow borders respectively adjacent to the periphery 40F and the central opening 42 of the support plate 40.

The peripherally-located thrustor lugs 46 thus correspond in shape and position to the peripherally-located slots 30 in the flat foundation plate 26 of the footbed layer 16 defining the peripherally-located stretch chambers 34. For ease of manufacture the thrustor lugs 46 are attached to a common thin sheet which, in turn, is adhered to the top surface 40D of the flat support plate 40.

The flat support plate 40 of the upper thrustor layer 20 supports the thrustor lugs 46 in alignment with the slots 30 and thus with the peripheral stretch chambers 34 of the foundation plate 26 and upper 12 of the shoe 10. However, the flat stretchable body 36 of upper stretch layer 18 is disposed between the stretch generating thrustor lugs 46 and flat foundation plate 26. Thus, with the footbed layer 16, upper stretch layer 18 and upper thrustor layer 20 disposed in the operative stacked relationship with one on top of the other in the heel and midfoot regions 14A, 14B of the sole 14, spaced portions 36C of the flat stretchable body 36 of the upper stretch layer 18 overlie top ends 46A of the stretch-generating thrustor lugs 46 and underlie the peripheral stretch chambers 34. Upon compression of the footbed layer 16 and upper thrustor layer 20 toward one another from a relaxed condition shown in FIGS. 5 and 6 toward a loaded condition shown in FIGS. 7 and 8, as occurs upon impact of the heel and midfoot regions 14A, 14B of the sole 14 of the shoe 10 with a support surface, the spaced portions 36A of the flat stretchable body 36 are forcibly stretched by the upwardly movement of the top ends 46A of the thrustor lugs 46 upwardly past the interior edges 26D of the foundation plate 26 surrounding the slots 30 and into the stretch chambers 34. This can occur due to the fact that the thrustor lugs 46 are enough smaller in their footprint size than that of the slots 30 so as to enable their top ends 46A together with the portions 36A of the flat stretchable body 36 stretched over the top ends 46A of the thrustor lugs 46 to move and penetrate upwardly through the slots 30 and into the peripheral stretch chambers 34, as shown in FIGS. 7 and 8.

The compressible lugs 38 of the upper stretch layer 18 are located in alignment with the solid border extending along the periphery 26F of the foundation plate 26 outside of the thrustor lugs 46. The compressible lugs 38 project downwardly toward the support base 40. The compressive force applied to the foundation plate 26 of the footbed layer 16 and to the support plate 42 of the upper thrustor layer 20, which occurs during normal use of the footwear 10, causes compression of the compressible lugs 38 from their normal tapered shape assumed in the relaxed condition of the sole 14 shown in FIGS. 5 and 6, into the bulged shape taken on in the loaded condition of the sole 14 shown in FIGS. 7 and 8. In addition to adding stability, the function of the compressible lugs 38 is to provide storage of the energy that was required to compress the lugs 38 and thereby to quicken and balance the resistance and rebound qualities of the sole 14

Figure 3:
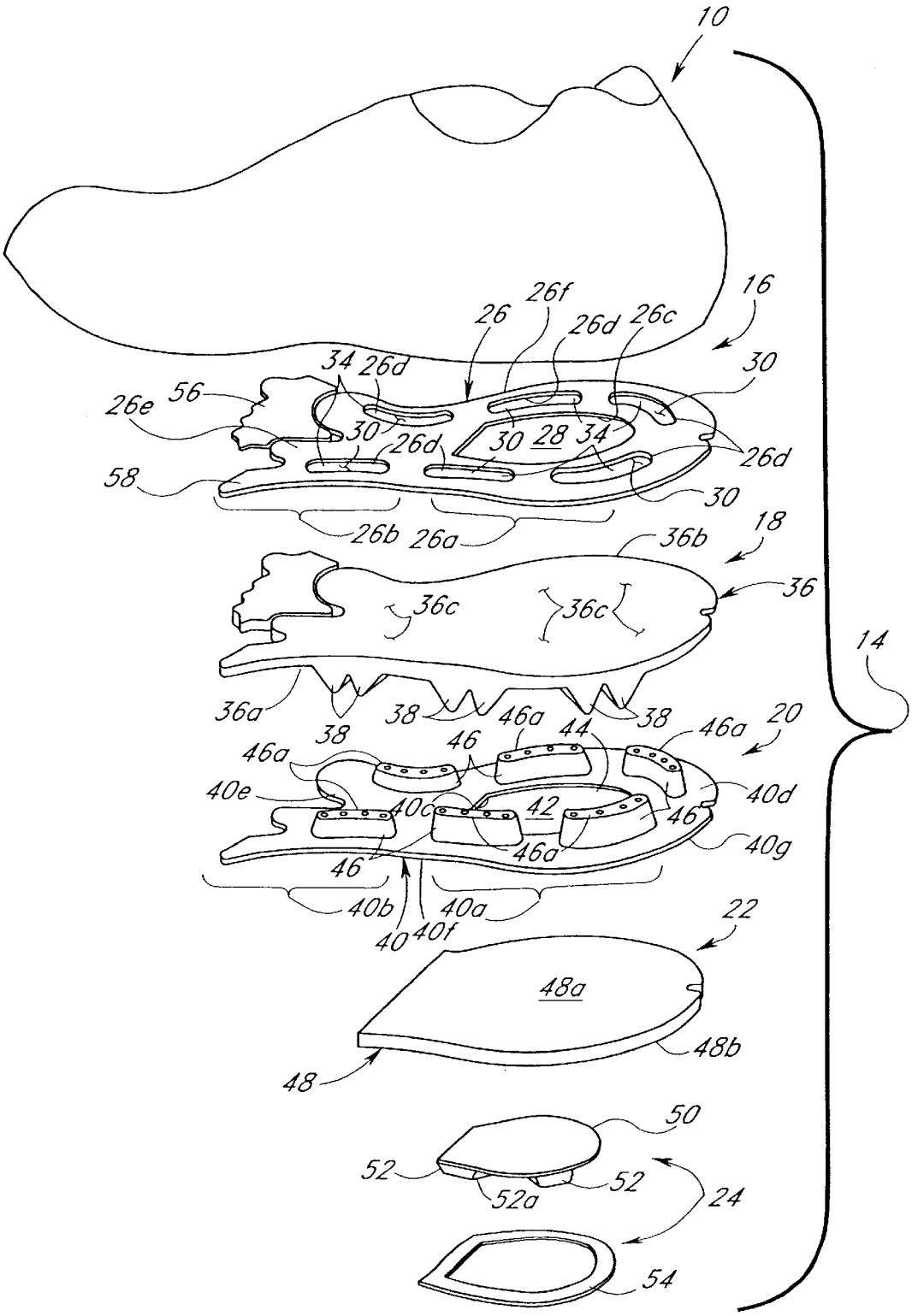
FIG. 3 is an exploded top perspective view of heel and midfoot regions of the sole construction.
Figure 4:
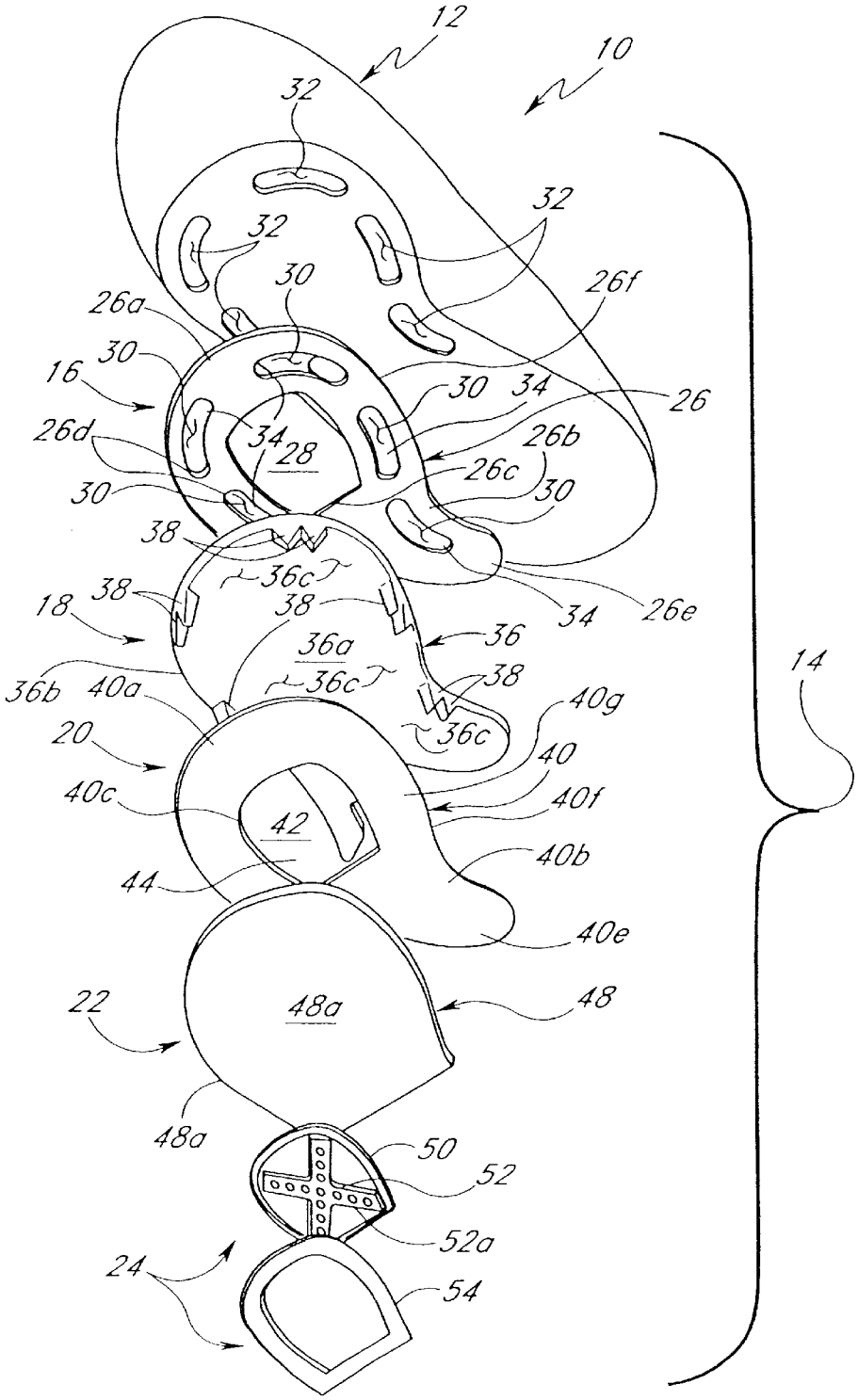
FIG. 4 is an exploded bottom perspective view of heel and midfoot regions of the sole construction.

As can best be seen in FIGS. 1 and 3, the stretch-generating thrustor lugs 46 are generally greater in height at the heel portion 40A of the support plate 40 than at the midfoot portion 40B thereof. This produces a wedge shape through the heel and midfoot regions 14A, 14B of the sole 14 from rear to front, that effectively generates and guides a forward and upward thrust for the user's foot as it moves through heel strike to midstance phases of the foot's "on the ground" travel.

Figure 8:
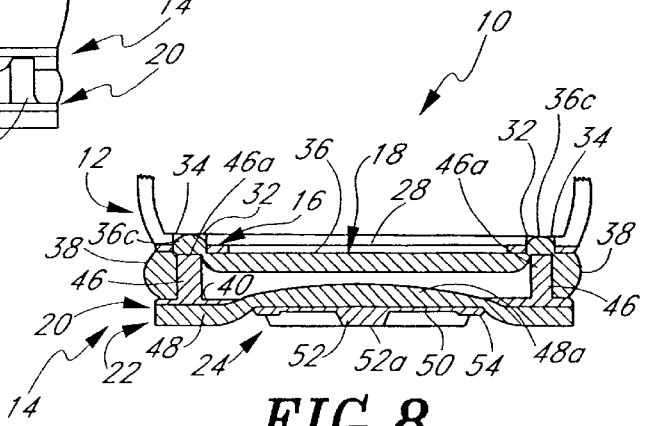
FIG. 8 is a vertical transverse sectional view of the sole construction of FIG. 7.

Referring to FIGS. 2, 3 and 8, the lower-stretch layer 22 is in the form of a flexible thin substantially flat stretchable sheet 48 of resilient elastic material, such as rubber, attached in any suitable manner, such as by gluing, to a bottom surface 40G of the flat support plate 40 of the upper thruster layer 20. The lower thrustor layer 24 disposed below the flat stretchable sheet 48 of the lower stretch layer 22 includes a thrustor plate 50, a thrustor cap 52 and a retainer ring 54. The thrustor plate 50 preferably is made of a suitable semi-rigid semi-flexible thin stiff material, such as fiberglass. The thrustor plate 50 is bonded to the bottom surface of a central portion 48A of the stretchable sheet 48 in alignment with the central hole 42 in the support plate 40 of the upper thrustor layer 20. In operative stacked relationship of the stretchable sheet 48 of the lower stretch layer 22 between the stretch-generating thrustor plate 50 of the lower thrustor layer 24 and the support plate 40 of the upper thrustor layer 20, the periphery 48B of the central portion 48A of the stretchable sheet 48 overlies the peripheral edge 50A of the stretch-generating thrustor plate 50 and underlie the rim 40C of the support plate 40.

Figure 5:
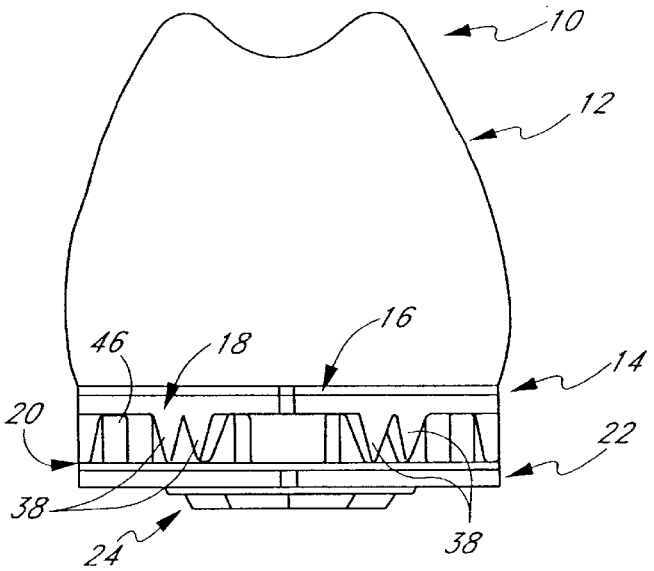
FIG. 5 is a rear end view of the heel region of the sole construction shown in a relaxed condition.
Figure 6:
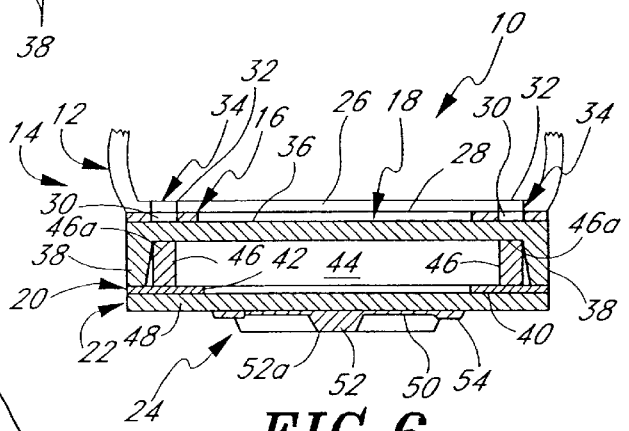
FIG. 6 is a vertical transverse sectional view of the sole construction of FIG. 5.
Figure 7:
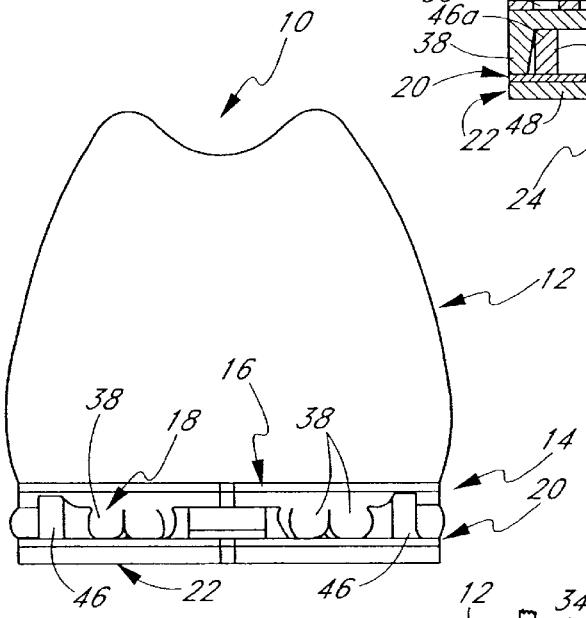
FIG. 7 is a rear end view of the heel region of the sole construction shown in a loaded condition.

Upon compression of the lower thrustor layer 24 toward the upper thrustor layer 20 from a relaxed condition shown in FIGS. 5 and 6 toward a loaded condition shown in FIGS. 7 and 8, as occurs upon impact of the heel and midfoot regions 14A, 14B of the sole 14 of the shoe 10 with a support surface during normal activity, the periphery 48B of the stretchable sheet 48 is forcibly stretched by the peripheral edge 50A of the thrustor plate 50 upwardly past the rim 40C surrounding the central hole 42 and into the main central stretch chamber 44. This can occur due to the fact that the thrustor plate 50 is enough smaller in its footprint size than that of the central hole 42 in the support plate 40 so as to enable the thrustor plate 50 together with the periphery 48B of the central portion 48A of the stretchable sheet 48 stretched over the thrustor plate 50 to move and penetrate upwardly through the central hole 42 and into the main centrally-located stretch chamber 44, as shown in FIGS. 7 and 8.

The rigidity of the thrustor plate 50 of the lower thrustor layer 24 encourages a stable uniform movement and penetration of the thrustor plate 50 and resultant stretching of the periphery 48B of the central portion 48A of the stretchable sheet 48 into the main central stretch chamber 44 in response to the application of compressive forces. The thrustor cap 52 is bonded on the bottom surface 50A of the thrustor plate 50 and preferably is made of a flexible plastic or hard rubber and its thickness partially determines the depth of penetration and length of drive or rebound of the thrustor plate 50. The ground engaging surface 52A of the thrustor cap 52 is generally domed shape and presents a smaller footprint than that of the thrustor plate 50. The retainer ring 54 is preferably made of the same material as the thrustor plate 50 and surrounds the thrustor plate 50 and thrustor cap 52. The retainer ring 54 is bonded on the bottom surface of the stretchable sheet 48 in alignment with the central hole 42 in the support plate 40 and surrounds the thrustor plate 50 so as to increase the stretch resistance of the central portion 48A of the stretchable sheet 48 and stabilize the lower thrustor layer 24 in the horizontal plane reducing the potential of jamming or binding of the thrustor plate 50 as it stretches the periphery 48B of the central portion 48A of the stretchable sheet 48 through the central hole 42 in the flat support plate 40 of the upper thrustor layer 20.

The above-described centrally-located interactions in the heel and midfoot regions 14A, 14B of the sole 14 between the support plate 40 of the upper thrustor layer 20, the flat stretchable sheet of the lower stretch layer 22 and flat thrustor plate of the lower thrustor layer 24 of the heel and midfoot regions 14A, 14B occur concurrently and interrelatedly with the peripherally-located interactions between footbed layer 16, the flat stretchable body 36 of the upper stretch layer 18 and the thrustor lugs 46 of the upper thrustor layer 20. These interrelated central and peripheral interactions convert the energy applied to the heel and midfoot regions 14A, 14B of the sole 14 by the wearer's foot into mechanical stretch. The applied energy is thus temporarily stored in the form of concurrent mechanical stretching of the central portion 48A of the lower stretchable sheet 48 of the lower stretch layer 22 and of the spaced portions 36C of the upper stretchable body 36 of the upper stretch layer 18 at the respective sites of the centrally-located and peripherally-located stretch chambers 44, 34. The stored applied energy is thereafter retrieved in the form of concurrent rebound of the stretched portions 36C of the upper stretchable body 36 and the thrustor lugs 46 therewith and of the stretched portion 48A of the lower stretchable sheet 48 and the thrustor plate 40 therewith. The resistance and speed of these stretching and rebound interactions is determined and controlled by the size relationship between the retainer ring 54 and the rim 40C about the central hole 42 of the support plate 49 and between the top ends 46A of the thrustor lugs 46 and the continuous interior edges 26D encompassing the slots 30 of the foundation plate 26. The thickness and elastic qualities preselected for the lower stretchable sheet 48 of the lower stretch layer 22 and the upper stretchable body 36 of the upper stretch layer 18 influence and mediate the resistance and speed of these interactions. The stretching and rebound of the lower stretchable sheet 48 also causes a torquing of the support plate 40. The torquing can be controlled by the thickness of the support plate 40 as well as by the size and thickness of the retainer ring 54.

Referring to FIG. 3, the midfoot region 14B of the sole 14 of the present invention also includes a curved midfoot piece 56 and a compression midfoot piece 58 complementary to the curved midfoot piece 56. The midfoot portion 26B of the foundation plate 26 terminates at the forward end 26E which has a generally V-shaped configuration. The curved midfoot piece 56 preferably is made of graphite and is provided as a component separate from the foundation plate 26. The curved midfoot piece 56 has a configuration which is complementary to and fits with the forward end 26E of the foundation plate 26. The forward end 26E of the foundation plate 26 cradles the number five metatarsal bone of the forefoot as the curved midfoot piece 56 couples the heel and forefoot portions 14A, 14B of the sole 14 so as to load the bones of the forefoot in an independent manner. The peripheral profiles of the upper stretch layer 18 and compression midfoot piece 58 are generally the same as those of the foundation plate 26 and curved midfoot piece 56.

Referring now to FIGS. 1, 2 and 9 to 11, the metatarsal and toe regions 14C, 14D of the sole 14 basically include the stacked combinations of metatarsal and toe articulated plates 60A, 60B, metatarsal and toe foundation plates 62A, 62B, a common metatarsal and toe stretch layer 64, and metatarsal and toe thrustor layers 65A, 65B. The metatarsal and toe thrustor layers 65A, 65B include metatarsal and toe plates 66A, 66B, metatarsal and toe thrustor caps 68A, 68B and metatarsal and toe retainer rings 70A, 70B. Except for a common stretch layer 64 serving both metatarsal and toe regions 14C, 14D of the sole 14, there is one stacked combination of components in the metatarsal region 14C of the sole 14 that underlies the five metatarsals of the wearer's foot and another separate stacked combination of components in the toe region 14D of the sole 14 that underlies the five toes of the wearer's foot. Except for the upper articulated plates 60A, 60B, the above-mentioned stacked combinations of components of the metatarsal and toe regions 14C, 14D of the sole 14 interact (stretching and rebound) generally similarly to the above-described interaction (stretching and rebound) of the stacked combination of components of the heel and midfoot regions 14A, 14B of the sole 14. However, whereas the stacked combination of components of the heel and midfoot regions 14A, 14B provide interrelated main and peripheral sites for temporary storage and retrieval of the applied energy, the stacked combination of components of the metatarsal and toe regions 14C, 14D provide a plurality of relatively independent sites for temporary storage and retrieval of the applied energy at the individual metatarsals and toes of the wearer is foot. The additional components, namely, the articulated plates 60A, 60B, of the metatarsal and toe regions 14C, 14D each has a plurality of laterally spaced slits 72A, 72B formed therein extending from the forward edges 74A, 74B rearwardly to about midway between the forward edges 74A, 74B and rearward edges 76A, 76B of the articulated plates 60A, 60B. These pluralities of spaced slits 72A, 72B define independent deflectable or articulatable appendages 78A, 78B on the metatarsal and toe articulated plates 60A, 60B that correspond to the individual metatarsals and toes of the wearer's foot and overlie and augment the independent characteristic of the respective sites of temporary storage and retrieval of the applied energy at the individual metatarsals and. toes of the wearer's foot.

More particularly, the metatarsal and toe articulated plates 60A, 60B are substantially flat and made of a suitable semi-rigid semi-flexible thin stiff material, such as graphite, while the metatarsal and toe foundation plates 62A, 62B disposed below the metatarsal and toe articulated plates 60A, 60B are substantially flat and made of a incompressible flexible material, such as plastic. Each of the metatarsal and toe foundation plates 62A, 62B has a continuous interior edge 80A, 80B defining a plurality of interconnected interior slots 82A, 82B which are matched to the metatarsals and toes of the wearer's foot. The continuous interior edges 80A, 80B are spaced inwardly from located inwardly from the peripheries 84A, 84B of the metatarsal and toe foundation plates 62A, 62B so as to leave continuous solid narrow borders 86A, 86B respectively adjacent to the peripheries 84A, 84B. The metatarsal and toe portions of the borders 86A, 86B encompassing or outlining the locations of the separate metatarsals and toes of the wearer's foot and of the appendages 78A, 78B on the articulated plates 60A, 60B are also separated by narrow slits 88A, 88B. The pluralities of interconnected interior slots 82A, 82B define corresponding pluralities of metatarsal and toe stretch chambers 90A, 90B in the respective metatarsal and toe foundation plates 62A, 62B.

The common metatarsal and toe stretch layer 64 is made of a suitable elastic stretchable material, such as rubber, and is disposed below the metatarsal and toe foundation plates 62A, 62B. The peripheral profile of the common stretch layer 64 generally matches the peripheral profiles of the articulated plates 60A, 60B and of the foundation plates 62A, 62B so as to provide the sole 14 with a common profile when these components are in an operative stacked relationship with one on top of the other. The common stretch layer 64 is attached at its upper surface 64A to the respective continuous borders 86A, 96B of the foundation plates 62A, 62B between their respective continuous interior edges 80A, 80B and peripheries 84A, 84B.

The metatarsal and toe thrustor plates 66A, 66B are disposed below and aligned with the common stretch layer 64 and the pluralities of interconnected interior slots 82A, 82B in foundation plates 62A, 62B forming the metatarsal and toe stretch chambers 90A, 90B. The metatarsal and toe thrustor plates 66A, 66B are made of semi-rigid semi-flexible thin stiff material, such as fiberglass. The metatarsal and toe thrustor plates 66A, 66B are bonded to the lower surface 64B of the common stretch layer 64 in alignment with the pluralities of interconnected interior slots 82A, 82B of forming the metatarsal and toe stretch chambers 90A, 90B of the foundation plates 62A, 62B. In the operative stacked relationship of the common stretch layer 64 between the stretch-generating metatarsal and toe thrustor plates 66A, 66B and the respective metatarsal and toe foundation plates 62A, 62B, portions 92A, 92B of the common stretch layer 64 overlie the peripheral edges 94A, 94B of the metatarsal and toe thrustor plates 66A, 66B and underlie the continuous interior edges 80A, 80B of the metatarsal and toe foundation plates 62A, 62B.

Figure 10:
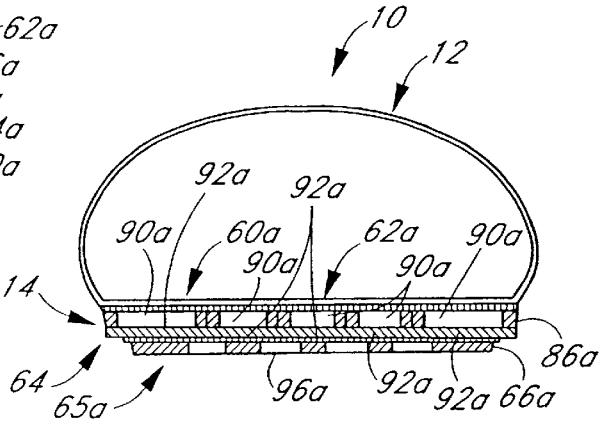
FIG. 10 is a vertical transverse sectional view of the metatarsal region of the sole construction shown in a relaxed condition.
Figure 11:
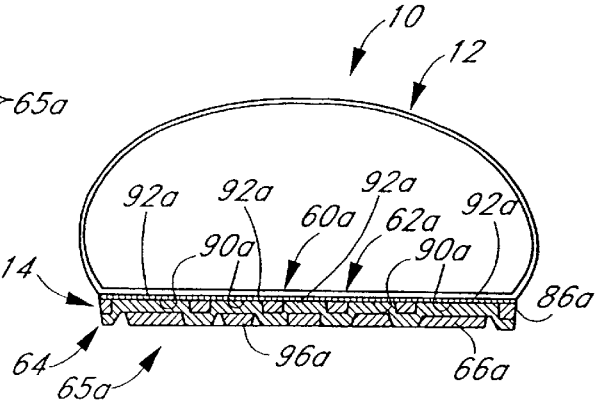
FIG. 11 is a vertical transverse sectional view of the metatarsal region of the sole construction shown in a loaded condition.

Upon compression of the lower metatarsal and toe thrustor plates 66A, 66B toward the upper metatarsal and toe foundation plates 62A, 62B from a relaxed condition shown in FIG. 10 toward a loaded condition shown in FIG. 11, as occurs upon impact of the metatarsal and toe regions 14C, 14D of the sole 14 of the shoe 10 with a support surface during normal activity, the portions 92A, 92B of the common stretch layer 64 are forcibly stretched by the peripheries 94A, 94B of the metatarsal and toe thrustor plates 66A, 66B upwardly past the continuous interior edges 80A, 80B of the metatarsal and toe foundation plates 62A, 62B into the metatarsal and toe stretch chambers 90A, 90B. This can occur due to the fact that the metatarsal and toe thrustor plates 66A, 66B are enough smaller in their respective footprint sizes than the sizes of the slots 82A, 82B in the metatarsal and toe foundation plates 62A, 62B so as to enable the metatarsal and toe thrustor plates 66A, 66B together with the portions 92A, 92B of the common stretch layer 64 stretched over the respective thrustor plates 66A, 66B to move and penetrate upwardly through the slots 82A, 82B and into the metatarsal and toe stretch chambers 90A, 90B, as shown in FIG. 11

The rigidity of the metatarsal and toe thrustor plates 66A, 66B encourages a stable uniform movement and penetration of the thrustor plates 66A, 66B and resultant stretching of the portions 92A, 92B of the common stretch layer 64 into the metatarsal and toe stretch chambers 90A, 90B in response to the application of compressive forces. The metatarsal and toe thrustor caps 68A, 68B are bonded respectively on the bottom surfaces 96A, 96B of the metatarsal and toe thrustor plates 66A, 66B and preferably is made of a flexible plastic or hard rubber and their respective thicknesses partially determine the depth of penetration and length of drive or rebound of the metatarsal and toe thrustor plates 66A, 66B. The metatarsal and toe retainer rings 70A, 70B are preferably made of the same material as the metatarsal and toe thrustor plates 66A, 66B and surround the respective thrustor plates 66A, 66B and thrustor caps 68A, 68B. The metatarsal and toe retainer rings 70A, 70B are bonded on the lower surface 64B of the common stretch layer 64 in alignment with the interior slots 82A, 82B and surround the thrustor plates 66A, 66B so as to increase the stretch resistance of the portion 92A, 92B of the common stretch layer 64 and stabilize the metatarsal and toe thrustor plates 66A, 66B in the horizontal plane reducing the potential of jamming or binding of the thrustor plates 66A, 66B as they stretch the peripheries of the portions 92a, 92B of the common stretch layer 64 into the metatarsal and toe stretch chambers 90A, 90b in the metatarsal and toe foundation plates 62A, 62B.

The above-described plurality of stretching interactions between the metatarsal and toe foundation plates 62A, 62B, common stretch layer 64 and metatarsal and toe thrustor plates 66A, 66B of the metatarsal and toe regions 14C, 14D in their stacked relationship converts the energy applied to the metatarsals and toes by the wearer's foot into mechanical stretch. The applied energy is stored in the form of mechanical stretching of the metatarsal and toe portions 92A, 92B of the common stretch layer 64 at the respective sites of the metatarsal and toe stretch chambers 90A, 90B. The applied energy is retrieved in the form of rebound of the stretched portions 92A, 92B of the common stretch layer 64 and the thrustor plates 66A, 66b therewith. The resistance and speed of these stretching interactions is determined and controlled by the size relationship between the retainer rings 70A, 70B and the continuous interior edges 80A, 80B in the metatarsal and toe foundation plates 62A, 62B. The thickness and elastic qualities preselected for the common stretch layer 64 influence and mediate the resistance and speed of these interactions. The peripheral profiles of the metatarsal and toe thrustor plates 66A, 66B are generally the same. The previously described midfoot pieces 56, 58 also provide a bridge between the components of the heel and midfoot regions 14A, 14B of the sole 14 and the components of the metatarsal and toe regions 14C, 14D of the sole 14.

Figure 9:
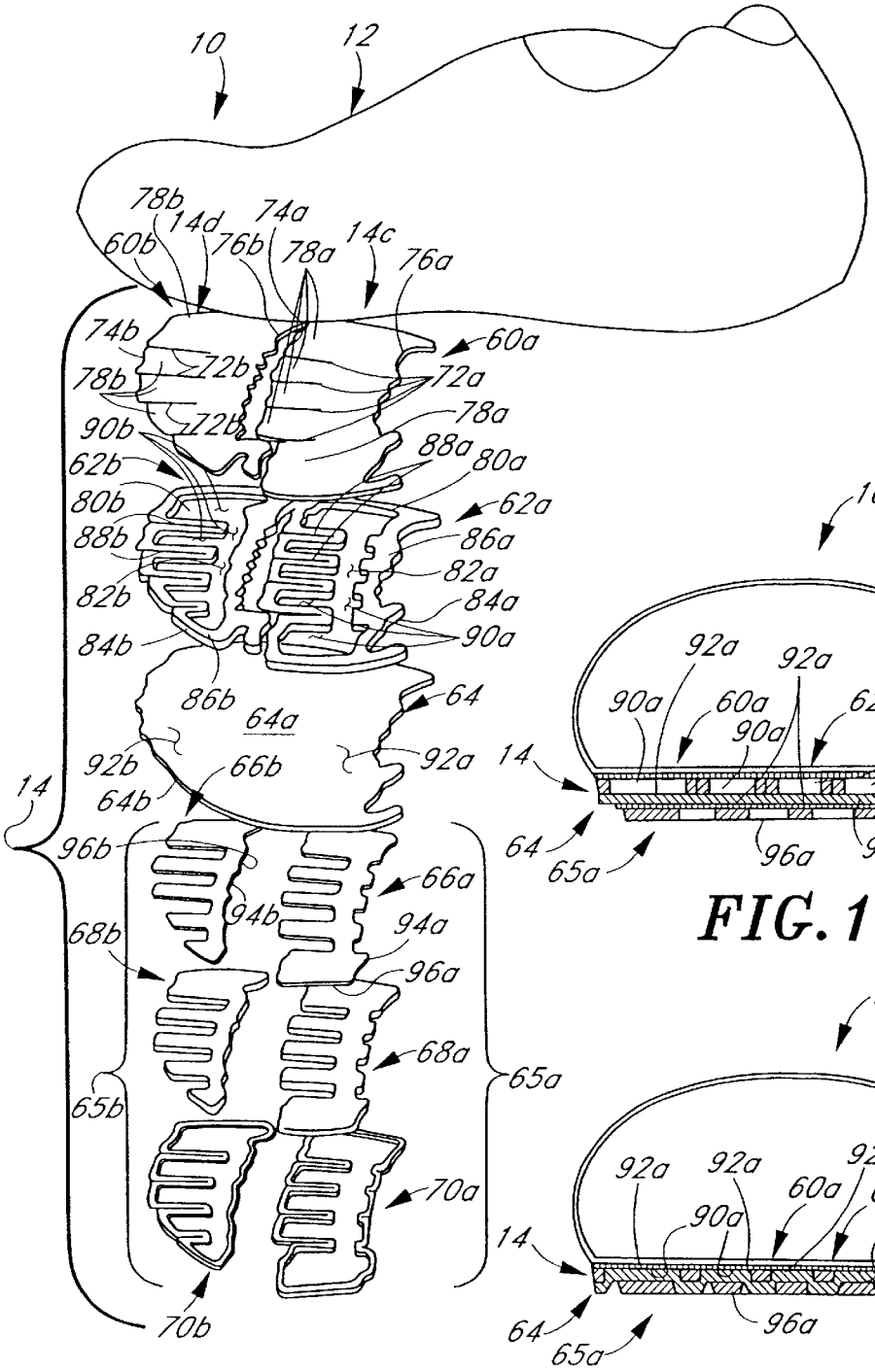
FIG. 9 is an exploded top perspective view of the metatarsal and toe regions of the sole construction of the present invention.

The metatarsal and toe regions 14C and 14D of the first preferred embodiment significantly improve the Snow tipping problem by employing metatarsal and toe thrustor layers with a single torsion armature. As shown in FIG. 9, the thrustor plates 66A and 66B and the thrustor caps 68A and 68B each preferably include an armature 69 extending between the lateral sides of the foot. This single torsion armature thereby interconnects the actuator elements of the plates 66A, 66B and caps 68A, 68B, to give the plates or caps the ability to conduct energy laterally to medially across the forefoot and toes across individual actuator elements corresponding to each of the bones of the toe or metatarsal region. This provides superior guidance and synergism between the actuator elements, as well as the opportunity to provide specific leverage points for the bony structure of the foot.

Further control over lateral to medial movement can be accomplished by increasing the height of the lateral and medial borders of the plates 66A, 66B and caps 68A, 68B. Raising the outer edges guides the foot's natural lateral to medial movement.

Preliminary experimental treadmill comparative testing of a skilled runner wearing prototype footwear 10 having soles 14 constructed in accordance with the present invention with the same runner wearing premium quality conventional footwear, has demonstrated a significantly improved performance of the runner while wearing the prototype footwear in terms of the runner's oxygen intake requirements. The prototype footwear 10 compared to the conventional footwear allowed the runner to use from ten to twenty percent less oxygen running at the same treadmill speed. The dramatically reduced oxygen intake requirement can only be attributed to an equally dramatic improvement of the energy efficiency that the runner experienced while wearing the footwear 10 having the heel construction of the present invention. It is reasonable to expect that this dramatic improvement in energy efficiency will translate into dramatic improvement in runner performance as should be reflected in elapsed times recorded in running competitions.

Second Exemplary Embodiment

In a second exemplary embodiment, the present invention is directed to articles of footwear incorporating a sole either as an integral part thereof or as an insert wherein the sole is constructed so as to absorb, store and release energy during active use. Thus, it should be appreciated that the invention includes such a sole, whether alone, as an insert for an existing article of footwear or incorporated as an improvement into an article of footwear. In any event, the sole is adapted to be worn on the foot of a person while traversing along a support surface and is operative to store and release energy resulting from compressive forces between the person and the support surface.

With reference first to FIGS. 12–14, the second exemplary embodiment of the present invention is shown to illustrate its most simple construction. As may be seen in FIG. 1, an article of footwear in the form of an athletic shoe 110 has an upper 112 and a sole 114. Sole 114 includes a heel portion 16 that is constructed according to the second exemplary embodiment of the present invention.

The structure of heel portion 116 is best shown with reference to FIGS. 13, 14A and 14B. In these FIGS., it may be seen that heel portion 16 includes a first profile in the form of a heel piece 118 that is formed of a relatively stiff material such as rubber, polymer, plastic or similar material. Heel piece 118 includes a first profile chamber 120 centrally located therein with first profile chamber 120 being oval in configuration and centered about axis "A". A second profile 122 is structured as a flat panel 124 that is provided with a primary actuator 126 that is similarly shaped but slightly smaller in dimension then first profile chamber 120. Second profile piece 122 is also formed of a stiff material, such as rubber, polymer, plastic or similar material. Actuator 126 can be formed integrally with flat panel 124 or, alternatively, affixed centrally thereon in any convenient manner.

The first layer 128 of a stretchable resilient material is interposed between heel piece 118 and second profile piece 122 so that resilient layer 128 spans across first profile chamber 120. To this end, it may be appreciated that heel piece 118 is positioned on a first side 130 of first resilient layer 128 while the second profile piece 122 is positioned on a second side 132 of first resilient layer 128 with actuator 126 facing the second side thereof Moreover, it may be seen that first profile chamber 120 has a first interior region 134 that is sized to receive actuator 126.

With reference to FIGS. 14A and 14B, it may be seen that heel piece 118 and second profile piece 122 are positioned so that a compressive force between the first and the support surface 136 in the direction of vector "F" moves heel piece 118 and second profile piece 122 toward one another. During this movement, the primary actuator element 126 advances into the first profile chamber 120. As this happens, resilient layer 128 is stretched into the first interior region 134 to define the active state shown in FIG. 14B. In the active state, energy is stored by the stretching of resilient layer 128. However, when the compressive force is removed, resilient layer 128 operates to release the energy thereby to move heel piece 118 and second profile piece 122 apart from one another to return them to the static stage shown in FIG. 14A. Accordingly, in operation, when a user places weight on the heel portion 116, either from walking, running or jumping, the impact force is cushioned and absorbed by the stretching of resilient layer 128. When the user transfers weight away from heel portion 116, this energy is released thereby helping propel the user in his/her activity.

Third Exemplary Embodiment

The simple structure shown in FIGS. 12-14 can be expanded to make a highly active sole, such as that shown in the third exemplary embodiment of the FIGS. 15–22. With reference to FIG. 15, it may be seen that an article of footwear in the form of an athletic shoe 150 has an upper 152 and a sole 154 with sole 154 being constructed according to the third exemplary embodiment of the present invention. Sole 154 includes a heel portion 156, a metatarsal portion 158 and a toe portion 160, all described below in greater detail. Thus, when reference is made to a "sole" it may be just one of these portions, a group of portions or a piece that underlies the entire foot or a portion thereof.

Figure 17:
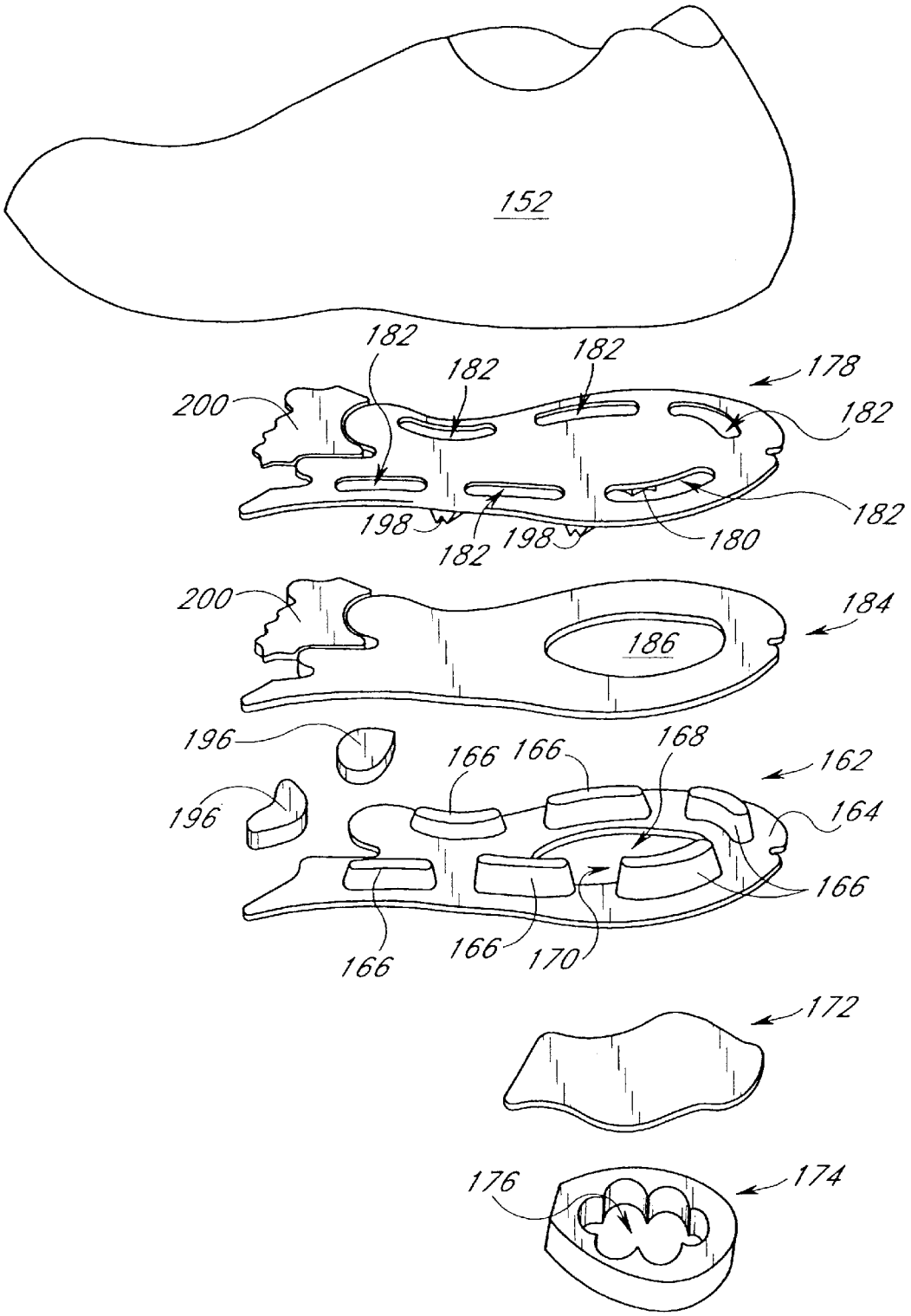
FIG. 17 is an exploded perspective view of the heel portion of the article of footwear shown in FIG. 15.
Figure 18:
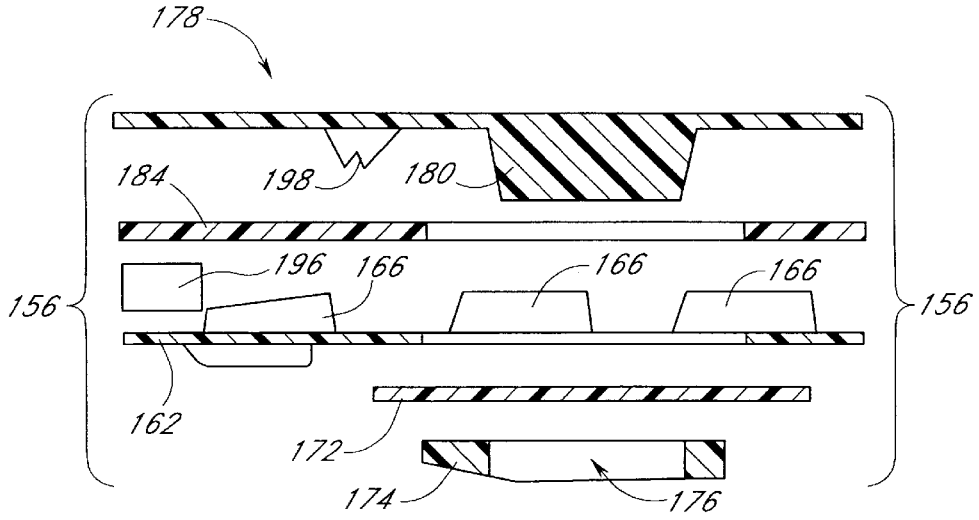
FIG. 18 is a side view in a partial cross-sectional and exploded view to show the construction of the heel portion of FIG. 17.

Turning first, then, to heel portion 156, the structure of the same may best be shown with reference to FIGS. 17–19. In these figures, it may be seen that heel portion 156 includes a first profile 162 formed by an annular heel plate 164 that has a plurality of spaced apart auxiliary actuator elements 166 positioned around the perimeter. Actuator elements 166 are formed of a stiff, fairly rigid material and define a first profile chamber 168 which has an opening 170 formed in annular heel plate 164. A layer of resilient stretchable material 172 is configured so that it will span across opening 170 with heel plate 164 and resilient layer 172 being secured together such as by an adhesive or other suitable means. Thus, first profile piece 162 is positioned on one side of resilient layer 172, and a second profile piece 174 is positioned on a second side of resilient layer 172 and is affixed thereto in any convenient manner. Second profile piece 174 is in the form of a heel piece but defines a primary actuator element for interaction with chamber 170. Thus, when used in this application, the phrase "second profile including a primary actuator element" can mean either that a second profile is provided with an independent actuator element or that the profile itself forms such actuator element.

In any event, it may further be appreciated that second profile piece 174 has a second profile chamber 176 formed centrally therein with second profile chamber 176 being an elongated six-lobed opening. Heel portion 156 then includes a third profile piece 178 that is provided with a plunger element 180 that is geometrically similar in shape to second profile chamber 176 but that is slightly smaller in dimension. Third profile piece 178 also includes a plurality of openings 182 that are sized and oriented to receive secondary actuator elements 166 noted above. To this end, also, heel portion 156 includes a second resilient layer 184 which has an elongated oval opening 186 centrally located therein. Openings 182 define third profile chambers each having a third interior region.

With reference now to FIGS. 18 and 19A, it may be understood that, when nested, the various pieces which make up heel portion 156 form a highly active system for storing energy. Here, it may be seen that plunger 180 of a selected height so that, when nested, surface 188 of plunger 180 contacts the second side 190 of resilient layer 172. Simultaneously, upper surfaces 192 of secondary actuators 166 just contact surface 194 of second resilient layer 184. Each of secondary actuator elements 166 align with a respective opening 182 with openings 182 having a similar shape as the configuration of actuator 166 but slightly larger in dimension. Second profile piece 174 is then aligned so that second profile chamber 176 is positioned to receive plunger 180 when second profile piece 174 moves into the interior region of first profile chamber 168.

This movement, from the static state shown in FIG. 19A is depicted in the active state of FIG. 19B. Here it may be seen that resilient layer 172 is forced to undergo a dual stretching wherein first profile piece 162, second profile piece 174 and plunger 180 counteract in a dual piston-like action. Resilient layer 172 is accordingly stretched both into first profile chamber 168 (by second profile piece 174) and into the interior region of second profile chamber 176 (by plunger 180).

At the same time, second resilient layer 184 undergoes a single deflection into each of the third profile chambers formed by openings 182. It should now be appreciated that by making the third profile chambers small in vertical dimension, the undersurface 153 of upper 152 provides a limit stop so that peripheral support is attained by second actuator elements 166 while the primary energy storing occurs with the coaction of plunger 180 and second profile piece 174 on resilient layer 172. To further assist in lateral stability, auxiliary positioning blocks 196 may be employed along with optional soft lugs 198 which extend downwardly between third profile piece 178 and second resilient layer 184. Moreover, optional metatarsal support plates 200 may be employed if desired.

With reference again to FIG. 15, it may be seen that sole 154 is constructed so as to be oriented at a slight acute angle "a" relative to support surface "s" when in the static state, with heel portion 156 being elevated relative to toe portion 160. Preferably angle "a" is in a range of about 2 degrees to 6 degrees. By providing this small angle, the release of the energy from the active state is not simply in the vertical direction during mid-stance to toe-off. Rather, since sole 154 pivots about the toe portion 160, the restorative force therefore is angled slightly forwardly during this movement. This results in a component of the restorative force being transferred to propel the user in a forward direction.

Figures 20A, 20B, 20C:
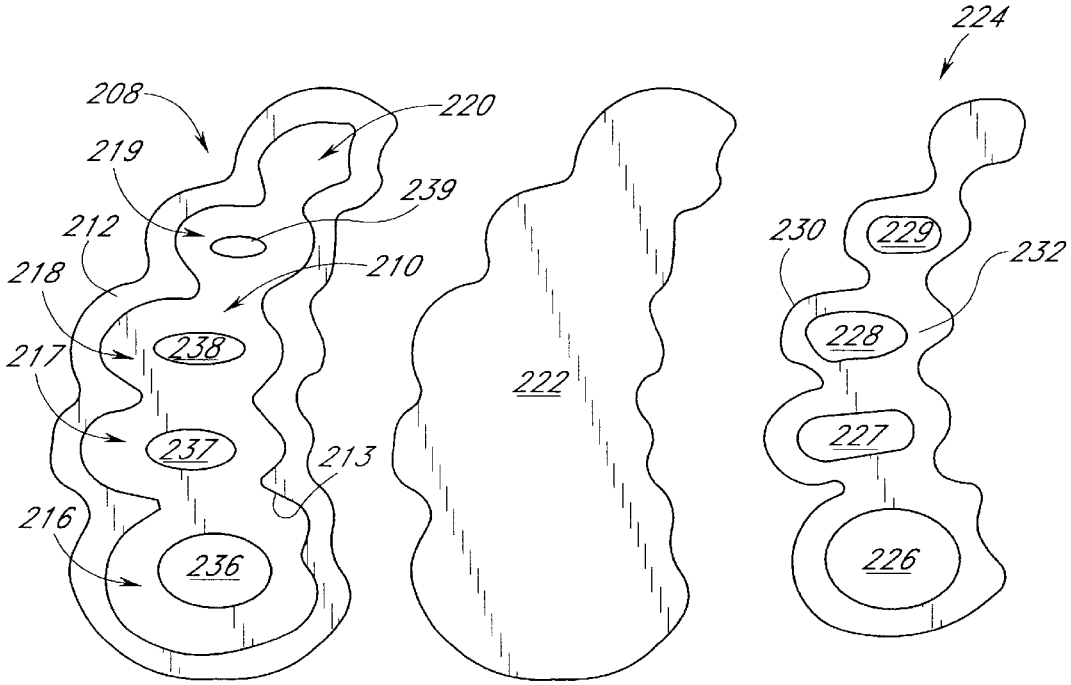
FIG. 20A is a top plan view of the first profile used for the toe portion of the sole of FIG. 15.
FIG. 20B is a top plan view of the resilient layer used to form the toe portion of the sole of FIG. 15
FIG. 20C is a top plan view of the second profile used to form the toe portion of the sole of FIG. 15.

With reference now to FIGS. 20 and 21, the construction of toe portion 160 may be seen in greater detail. Here, it may be seen that toe portion 160 is formed by a first profile piece 208 that includes a first profile by an upstanding perimeter wall 212 that extends around the peripheral edge of first profile piece 208. As may be seen with reference to FIG. 20A, perimeter wall 212 is configured so that chamber 210 has five regions 216–220, that correspond to each of the human toes. A first resilient layer 222 is shown in FIG. 20B and has a peripheral edge that is geometrically congruent to first profile piece 208. When assembled, first resilient layer 222 spans across first profile chamber 210. The structure of toe portion 160 is completed with the addition of second profile piece 224 which is shown in FIG. 20A. Second profile piece 224 is shaped geometrically similar to the interior side wall 213 of perimeter wall 212 so that it can nest in close-fitted, mated relation into first profile chamber 210. Second profile piece 224 is provided with openings 226–229 that define second profile chambers which correspond to toe regions 216–219. With reference again to FIG. 20A, it may be seen that each of these toe regions is provided with an upstanding plunger 236–239 which are sized for mated insertion into openings 226–229, respectively.

Figure 21A:
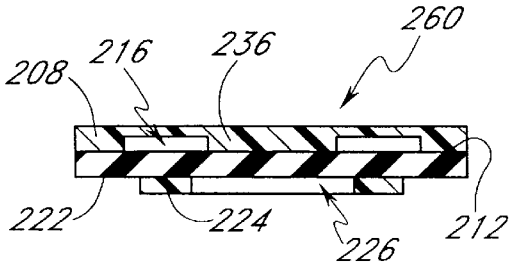
FIG. 21A is, a cross-sectional view of the toe portion of the sole of FIG. 20 shown in a static state.
Figure 21B:
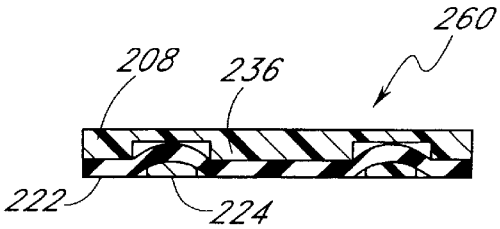
FIG. 21B is a cross-sectional view similar to FIG. 21A but showing the toe portion in an active state.
Figure 23:
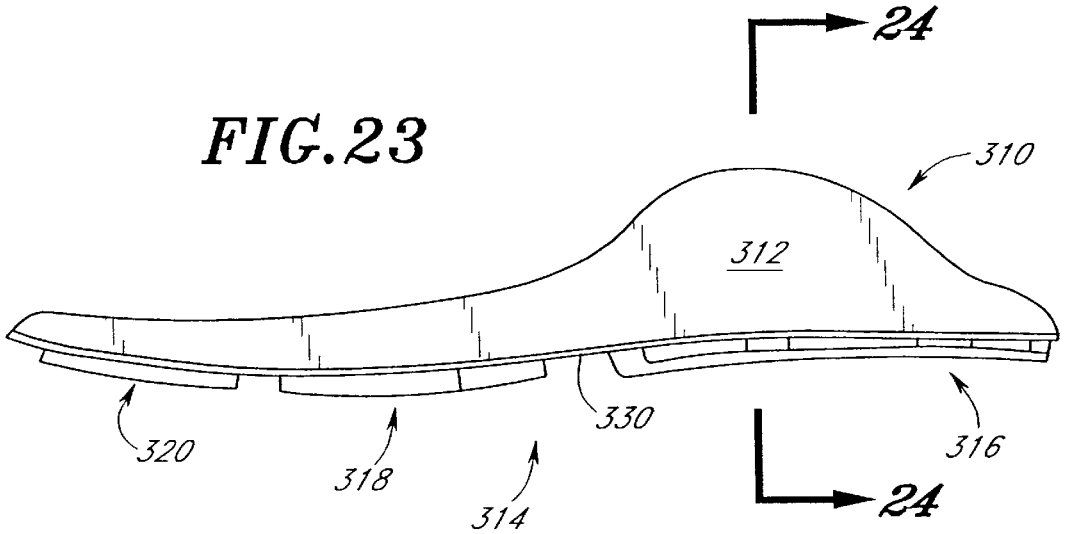
FIG. 23 is a side view in elevation showing a sole insert according to a fourth exemplary embodiment of the present invention.

Accordingly, as is shown in FIGS. 21A and 21B, toe portion 160 provides a dual acting energy storing system. When first profile piece 208 and second profile piece 224 are moved from the static state shown in FIG. 21A to the active state shown in FIG. 21B, resilient layer 222 undergoes a double deflection. Second profile piece 224, which defines the primary actuator, moves into first profile chamber 210 thus stretching resilient layer 222 into the interior region thereof. Simultaneously, each of the plungers 236–239 move into the corresponding opening 226–229 in second profile piece 224 thus stretching resilient layer 222 into the interior region of openings 226–229.

Figure 20D:
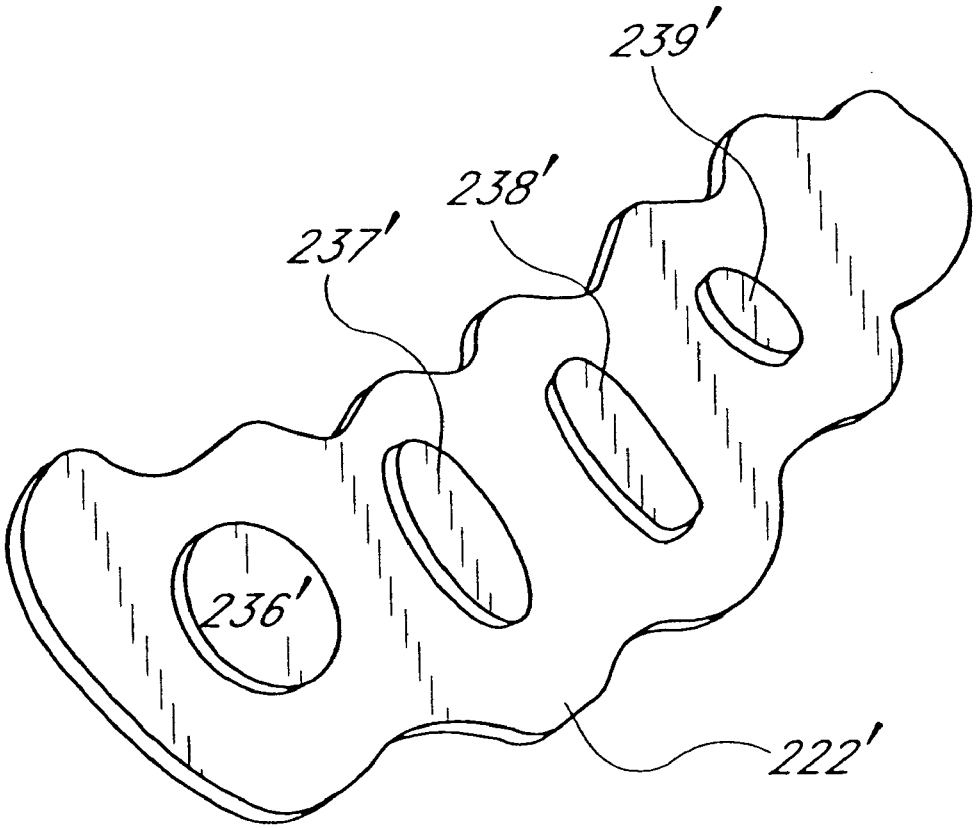
FIG. 20D is a perspective view of an alternative construction of the resilient layer for the toe portion of the sole of FIG. 15.

For ease of manufacture, it is possible to provide plungers 236–239 as part of resilient layer 222. Accordingly, this alternative structure is shown in FIG. 20D wherein resilient layer 222 is shown to have plunger elements 236'–239' formed integrally therewith. In FIG. 20D, the opposite side of resilient layer of 222' is revealed from that shown in FIG. 20B.

Figure 22A:
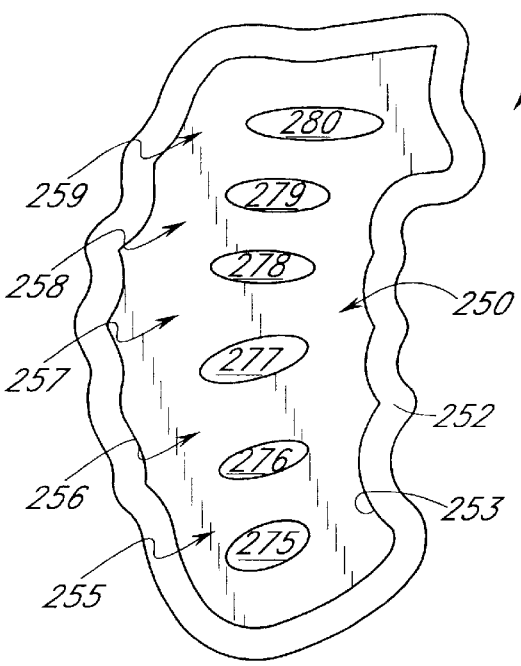
FIG. 22A is a top plan view of the first profile used to form the metatarsal portion of the sole of FIG. 15.
Figure 22C:
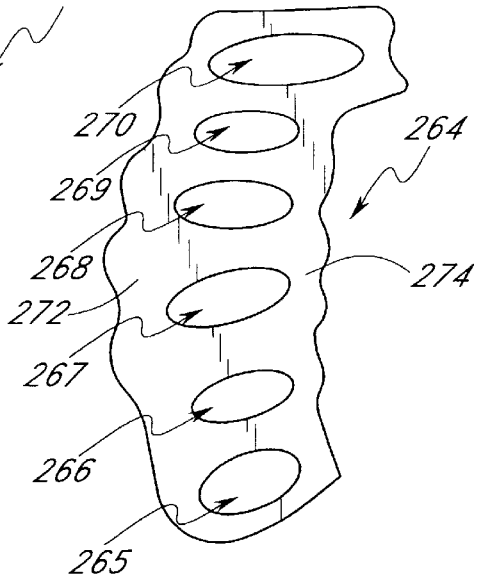
FIG. 22C is a top plan view of the second profile used to form the metatarsal portion of the sole of FIG. 15.
Figure 22B:
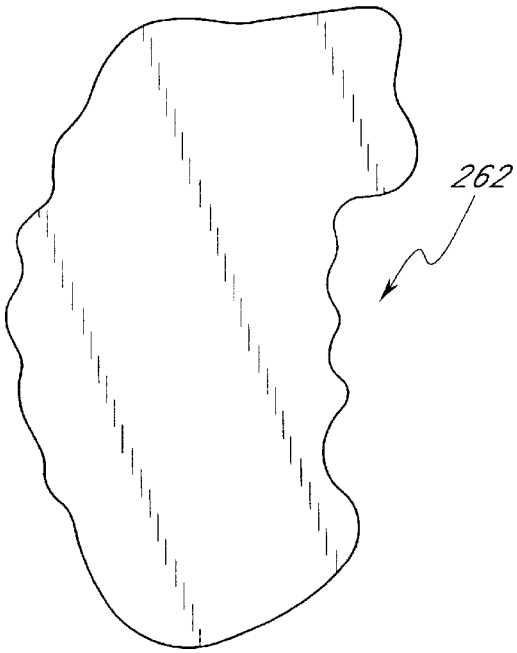
FIG. 22B is a top plan view of the resilient layer used to form the metatarsal portion of the sole of FIG. 15.

The structure of metatarsal portion 158 is similar to that of toe portion 160. In FIGS. 22A–22C, it may be seen that metatarsal portion 158 is formed by a first profile piece 218 that includes a first profile chamber 250 formed therein. First profile chamber 250 is thus bounded by an upstanding perimeter wall 252 that extends around the peripheral edge of first profile piece 208. As may be seen with reference to FIG. 20A, perimeter wall 252 is configured so that chamber 250 has five regions 255–259, that correspond to each of the metatarsal bones. A first resilient layer 262 is shown in FIG. 22B and has a peripheral edge that is geometrically congruent to first profile piece 248. When assembled, first resilient layer 262 spans across first profile chamber 250. The structure of metatarsal portion 158 is completed with the addition of second profile piece 264 which is shown in FIG. 22C.

Second profile piece 264 is shaped geometrically similar to the interior side wall 253 of perimeter wall 252 so that it can nest in close-fitted, mated relation into first profile chamber 250. Second profile piece 264 is provided with openings 265–270 that define second profile chambers. With reference again to FIG. 22A, it may be seen that first profile chamber 250 is provided with upstanding plungers 275–280 which are sized for mated insertion into openings 265–270, respectively. Plungers 275–280 are oriented to extend between the metatarsal bones of the human foot.

Here again when first profile piece 248 and second profile piece 264 move from the static state to the active state, resilient layer 262 undergoes a double deflection. Second profile piece 264 which defines the primary actuator, moves into first profile chamber 250 thus stretching resilient layer 262 into the interior region thereof. Simultaneously, each of the plungers 275–280 move into the corresponding chambers 265–270 in second profile piece 264 thus stretching resilient layer 262 into the interior region of openings 265–270. The action, therefore, is identical to that described with reference to FIGS. 21A and 21B.

The energy focal points for the toe profile piece 224 and the forefoot profile piece 264 center around the chambers 226–229 and 265–270, respectively. These chambers are further stabilized by fore and aft torsion armatures which interconnect the actuator portions of actuators 224 and 264 and conduct energy laterally and medially across the forefoot and toe regions. As shown in FIG. 20C, a fore torsion armature 230 bounds the fore portion of the profile piece 224, and an aft torsion armature 232 bounds the aft portion of the profile piece 224. Similarly, as shown in FIG. 22C, a fore torsion armature 272 bounds the fore portion of the profile piece 264, and an aft torsion armature 274 bounds the aft portion of the profile piece 264.

Fourth Exemplary Embodiment

Figure 24:
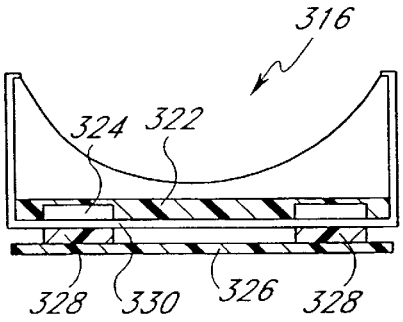
FIG. 24 is a cross-sectional view taken about lines 24—24 of FIG. 23.
Figure 26B:
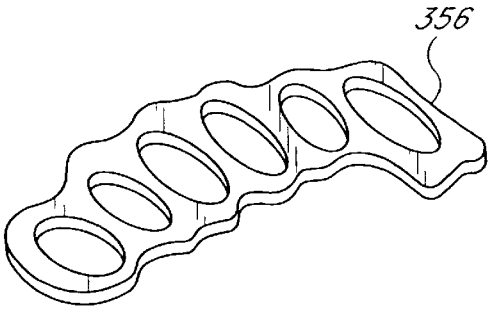
FIG. 26B is a perspective view of the second profile used to form the metatarsal portion of the sole insert of FIG. 23.
Figure 26A:
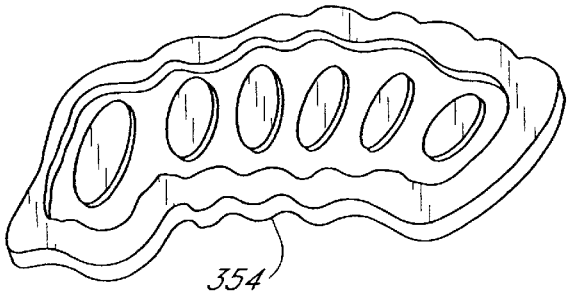
FIG. 26A is a perspective view of the first profile used to form the metatarsal portion of the sole insert of FIG. 23.
Figure 25A:
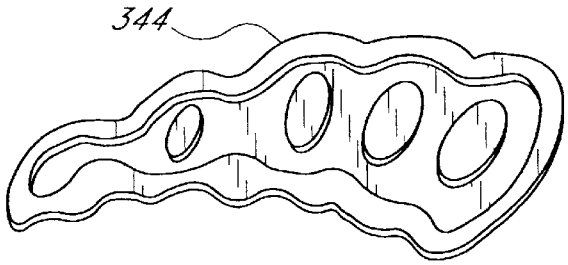
FIG. 25A is a perspective view of the first profile used to form the toe portion of the sole insert of FIG. 23.
Figure 25B:
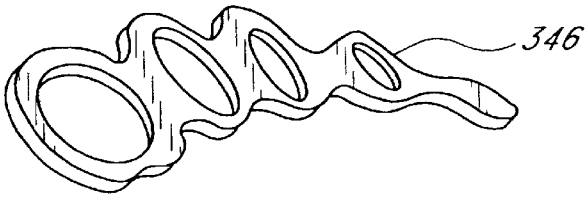
FIG. 25B is a respective view of the second profile used to form the toe portion of the sole insert of FIG. 23.
Figure 27A:
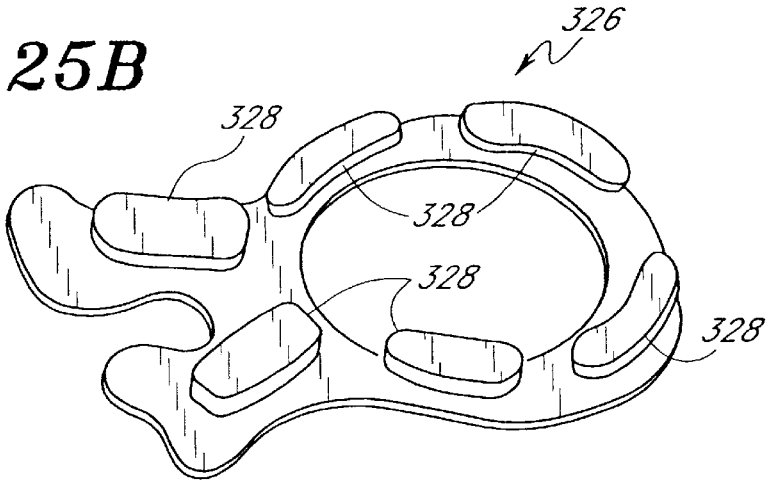
FIG. 27A is a perspective view of the first profile used to form the heel portion of the sole insert of FIG. 23.
Figure 27B:
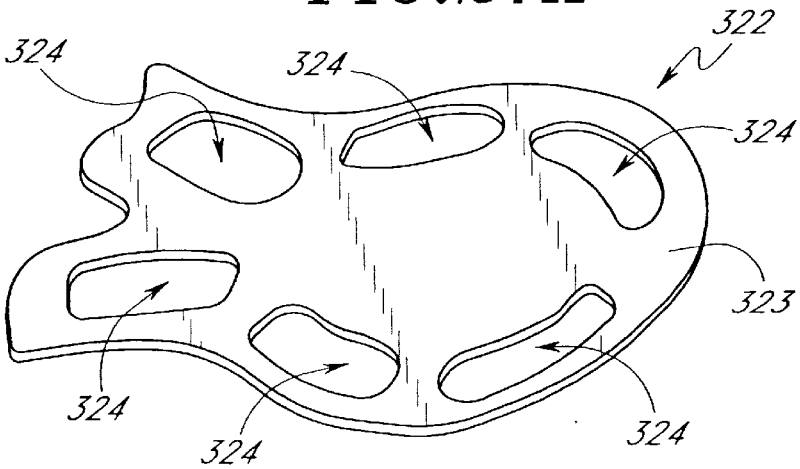
FIG. 27B is a perspective view of the second profile used to form the heel portion of the sole insert of FIG. 23.

A fourth exemplary embodiment of the present invention is shown in FIGS. 23–27. In these FIGS. a sole insert 310 is shown to include an upper 312 and a sole 314. Sole 314 includes a heel section 316, a metatarsal 318 and a toe portion 320. The structure of heel portion 216 is best shown in FIGS. 24 and 27A and 27B. Heel portion 316 includes a first profile piece 322 structured generally as flat plate 323 that has a plurality of first profile chambers 324 formed therein. Chambers 324 are formed as cavities in plate 323. Alternatively, chambers 324 could be formed by openings completely through plate 323. A second profile piece 326 includes a plurality of actuator elements 328 which are sized for engagement into the interior region of a respective chamber 324. First profile piece 324 and second profile piece 326 sandwich a resilient layer 330 therebetween so that, when compression forces are exerted, actuator elements 328 are advanced into first profile chamber 324.

Toe portion 320 is formed by a first profile piece 344 and a second profile piece 346 that defines an actuator. The structure of profile pieces 344 and 346 are identical to that described with respect to profile pieces 208 and 224, respectively, so that this description is not repeated. Similarly, metatarsal portion 318 is formed by a first profile piece 354 and a second profile piece 356 with the structure of profile pieces 354 and 356 being the same as that of profile pieces 348 and 364. One difference that may be noted in the structure of the sole insert 310, however, is that the resilient layer 330 is a common resilient layer that extends along the complete sole of insert 310 so that resilient layer 330 provides the resilient layers for storing energy in each of heel portion 316, metatarsal portion 318 and toe portion 320.

Fifth Exemplary Embodiment

Figure 28:
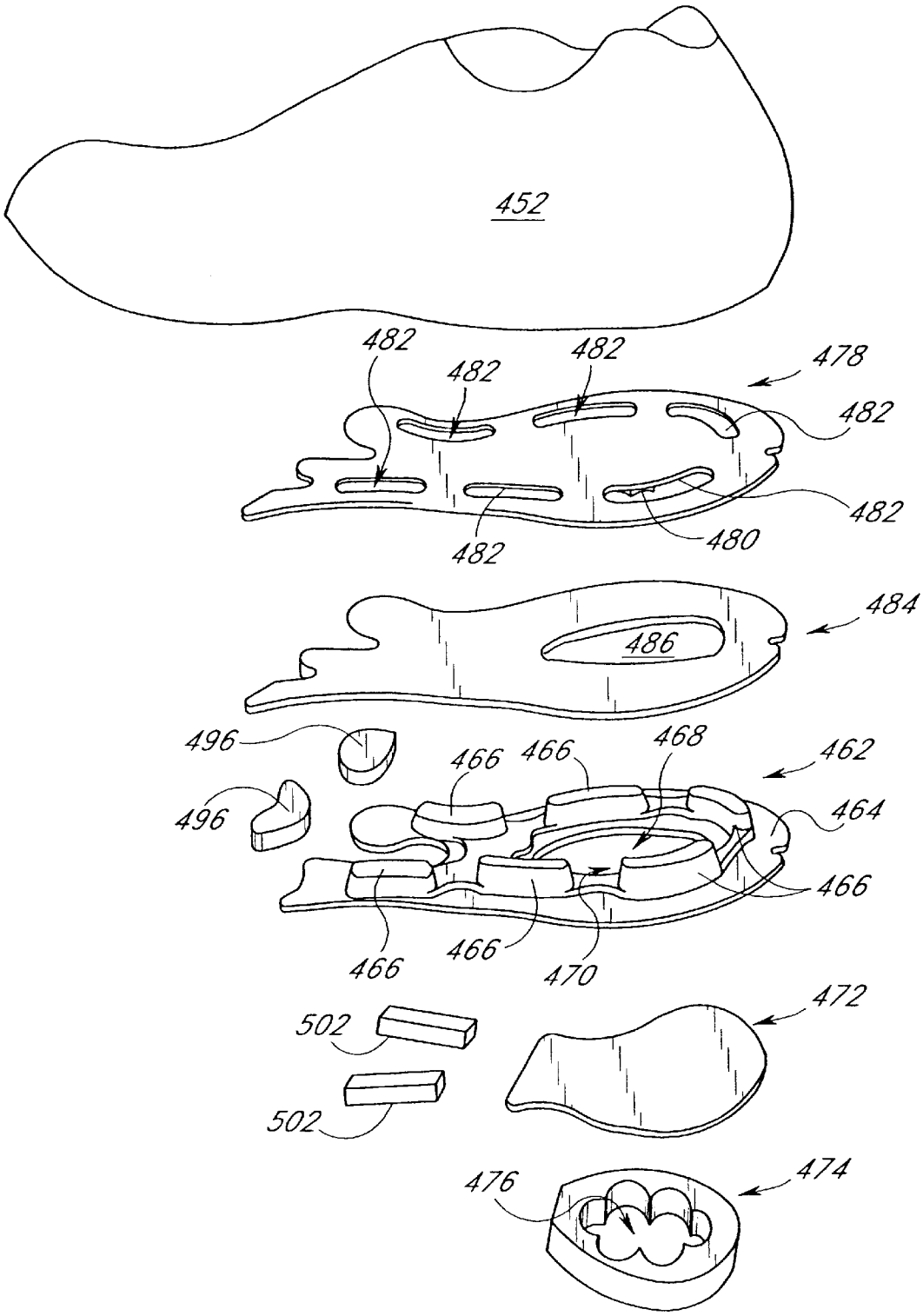
FIG. 28 is an exploded perspective view of the heel portion of an article of footwear according to a fifth exemplary embodiment.
Figure 29:
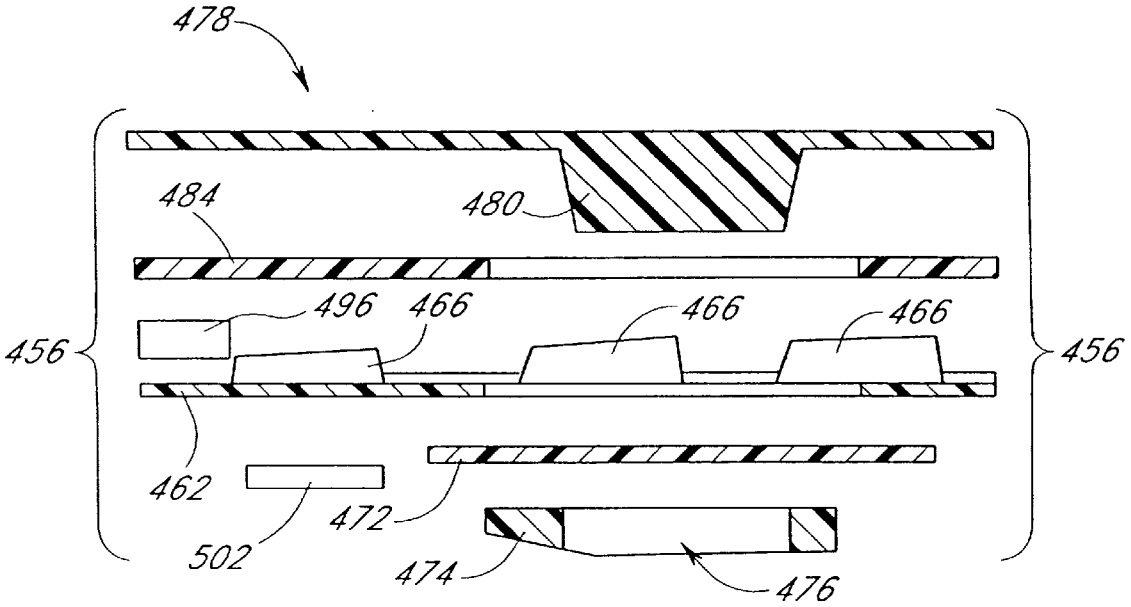
FIG. 29 is a side view in a partial cross-sectional and exploded view to show the construction of the heel portion of FIG. 28.
Figure 30:
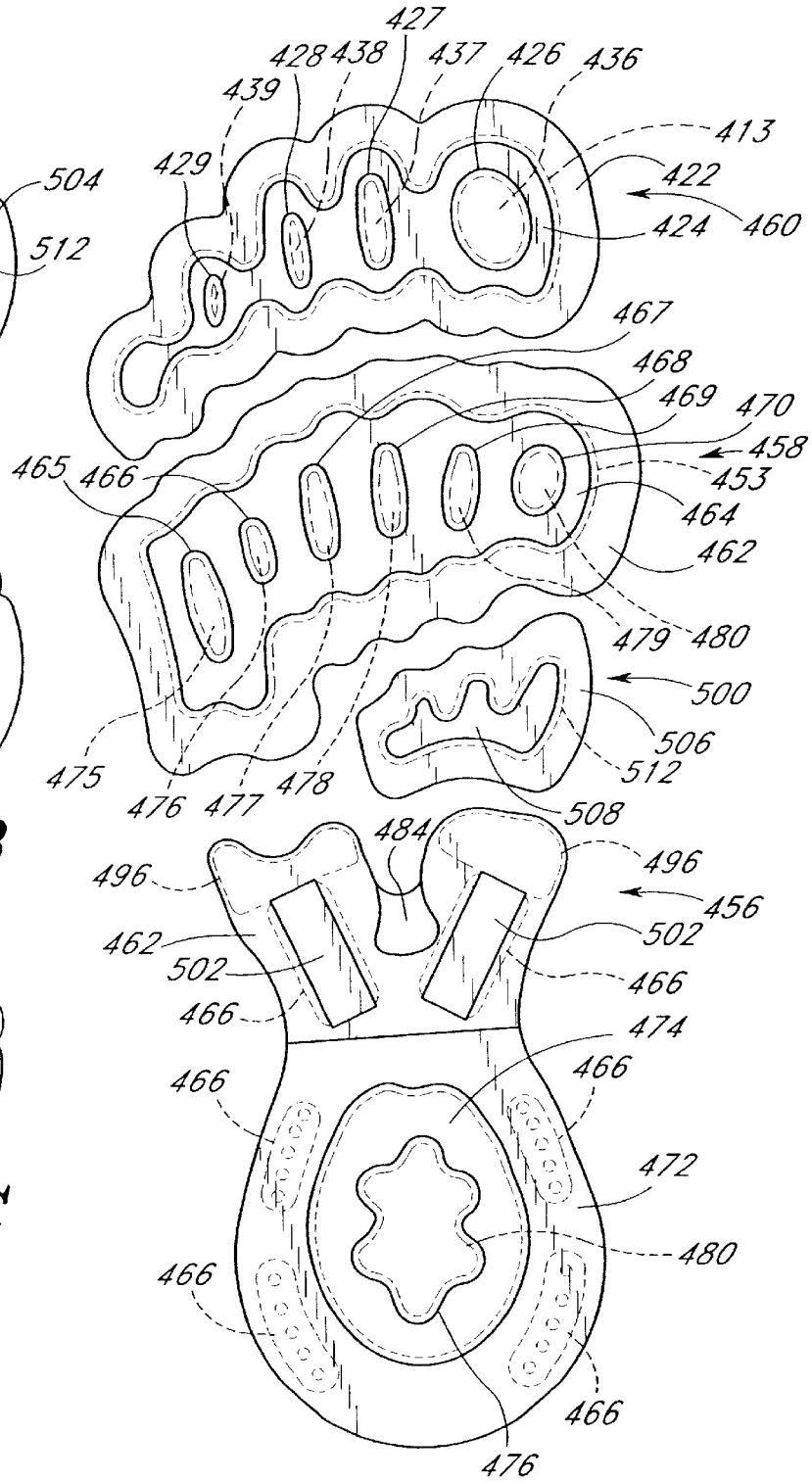
FIG. 30 is a bottom elevational view of the sole of FIG. 28.

FIGS. 28–30 illustrate a fifth exemplary embodiment of the sole of the present invention. This embodiment is similar to the third exemplary embodiment described above, with one difference being that the heel portion 456 does not have the optional soft lugs 198 shown in FIG. 17 above. Toe portion 460 and metatarsal portion 458, shown in a bottom view in FIG. 30, are substantially the same as shown in 20A–20C and 22A–22C, respectively, using like numerals in the 400 series rather than the 200 series.

FIGS. 28 and 29 show the heel portion 456 in an exploded perspective view and an exploded partial cross-sectional view, respectively. The heel portion 456 includes a first profile 462 formed by an annular heel plate 464 that has a plurality of spaced apart auxiliary actuator elements 466 positioned around the perimeter in a U-shape. Actuator elements 466 are formed of a stiff, fairly rigid material and define a first profile chamber 468 which has an opening 470 formed in annular heel plate 464. Actuator elements 466 are preferably tapered, as shown in FIG. 29, toward the front of the sole, to provide additional support toward the rear of the foot. A layer of resilient stretchable material 472 is configured so that it will span across opening 470 with heel plate 464 and resilient layer 472 being secured together such as by an adhesive or other suitable means. Thus, first profile piece 462 is positioned on one side of resilient layer 472, and a second profile piece 474 is positioned on a second side of resilient layer 472 and is affixed thereto in any convenient manner. Second profile piece 474 is in the form of a heel piece but defines a primary actuator element for interaction with chamber 470.

It may further be appreciated that second profile piece 474 has a second profile chamber 476 formed centrally therein with second profile chamber 476 being an elongated six-lobed opening. Heel portion 456 then includes a third profile piece 478 that is provided with a plunger element 480 that is geometrically similar in shape to second profile chamber 476 but that is slightly smaller in dimension. Third profile piece 478 also includes a plurality of openings 482 that are sized and oriented to receive secondary actuator elements 466 noted above. To this end, also, heel portion 456 includes a second resilient layer 484 which has an elongated oval opening 486 centrally located therein. Openings 482 define third profile chambers each having a third interior region.

To assist in lateral stability, auxiliary positioning blocks 496 are provided between the second resilient layer 484 and first profile piece 464. Additional support blocks or motion control posts 502 are provided beneath the first profile piece substantially underlying the forward pair of secondary actuator elements 466. The tripod configuration of the support blocks 502 and second profile piece 474 provides improved stability. The unit is capable of storing energies derived from rotational forces, producing optimal vertical vectors. Shoes requiring additional stability can take advantage of the ability to space the motion control posts further apart. For individuals having flat feet or requiring full support of the midfoot region, an optional active foot bridge is contemplated.

It should be understood that, when nested, the various pieces which make up heel portion 456 form a highly active system for storing energy. In particular, the heel portion 456 exhibits substantially similar behavior as the heel portion 156 depicted in FIGS. 19A and 19B.

Figure 31A:
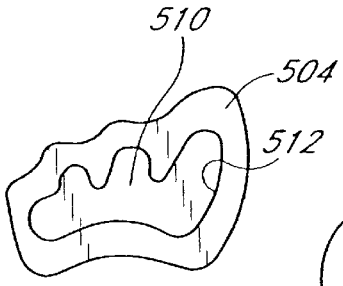
FIG. 31A is a top plan view of the first profile used for the additional metatarsal support portion of the sole of FIG. 30.
Figure 31B:
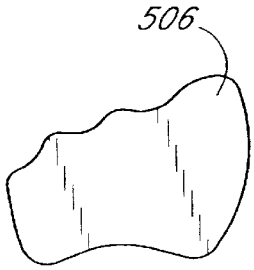
FIG. 31B is a top plan view of the resilient layer used to form the additional metatarsal support portion of the sole of FIG. 30.
Figure 31C:
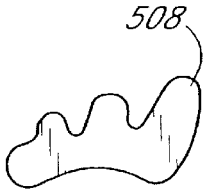
FIG. 31C is a top plan view of the second profile used to form the additional metatarsal portion of the sole of FIG. 30.

The bottom view of the sole portion shown in FIG. 30 depicts the arrangement of the heel portion 456, metatarsal portion 458 and toe portion 460 comprising the exemplary sole of the shoe. FIG. 30 also depicts an additional metatarsal support portion 500, shown more particularly in FIGS. 31A–31C. As shown in FIG. 31A, the metatarsal support portion 500 is formed by a first profile piece 504 that includes a first profile chamber 510 defined by an upstanding perimeter wall 512 that extends around the peripheral edge of first profile piece 504. A resilient layer 506 is shown in FIG. 31B and has a peripheral edge that is geometrically congruent to first profile piece 504. When assembled, resilient layer 506 spans across profile chamber 510. The structure of metatarsal support portion 500 is completed with the addition of second profile piece 508 which is shown in FIG. 31C. Second profile piece 508 is shaped geometrically similar to the interior side wall 512 of first profile piece 504 so that it can nest in close-fitted, mated relation into profile chamber 510. More particularly, second profile piece 508 and chamber 510 are positioned to cradle the first and second metatarsal bones.

Sixth Exemplary Embodiment

Figure 32:
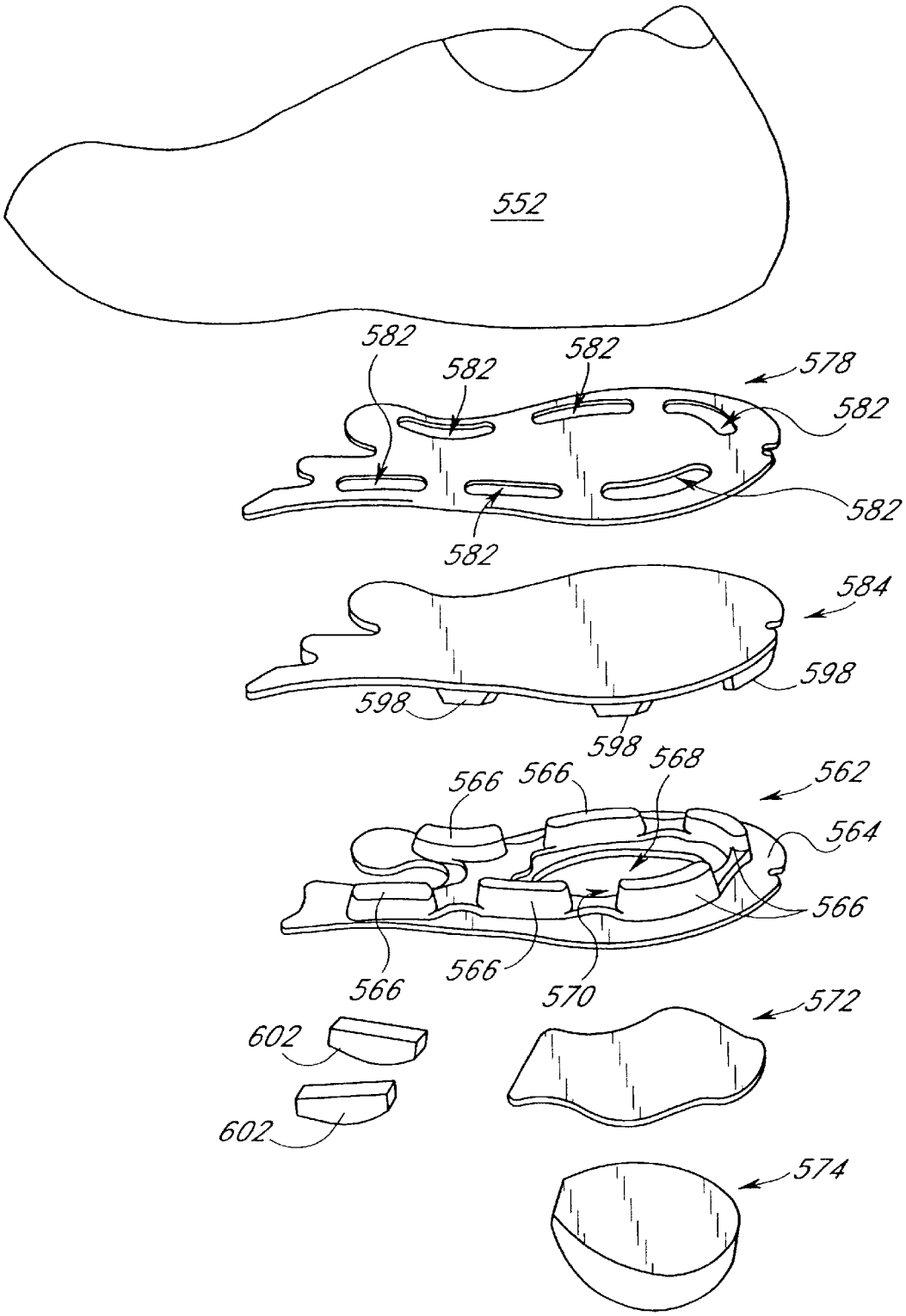
FIG. 32 is anxploded perspective view of the heel portion of an article of footwear according to a sixth exemplary embodiment.
Figure 33:
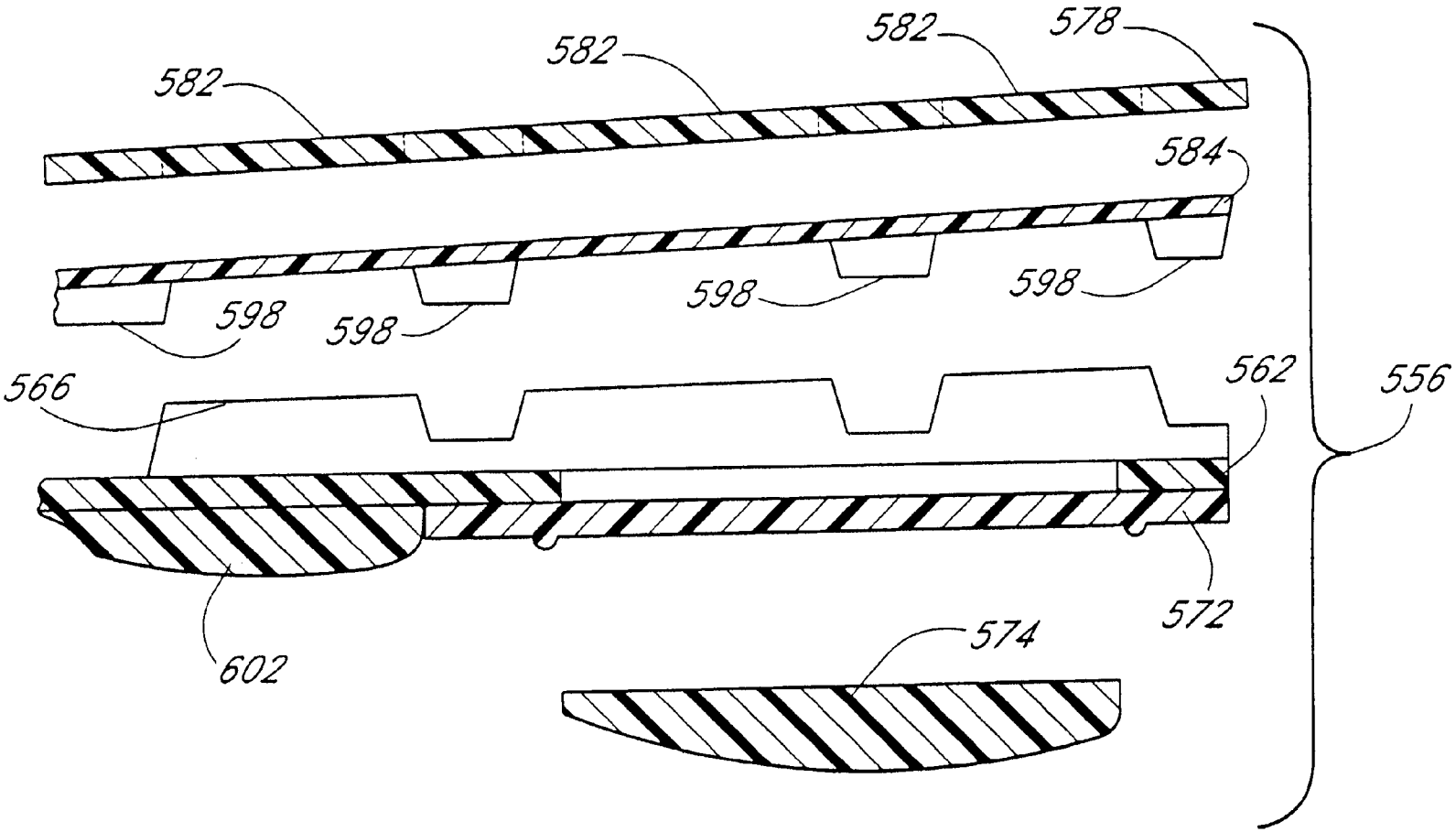
FIG. 33 is a side view in a partial cross-sectional and exploded view to show the construction of heel portion of FIG. 32.

FIGS. 32 and 33 depict an alternative exemplary embodiment of a heel portion 556 for a sole of the present invention. The heel portion 556 comprises a main thrustor 574, a first resilient layer 572, a first profile layer 562 with actuator elements or satellite thrustors 566 thereon, interlocking rubber lugs 598 on a second resilient layer 584, and a second profile layer 578 overlying the resilient layer 584. Additionally auxiliary support blocks 602 are positioned proximal to the resilient layer 572 beneath the profile layer 562.

The embodiment shown in FIG. 32 is similar to the heel portion 156 shown in FIG. 17, with two differences being that the rubber lugs 598 are provided beneath the resilient layer 584 instead of the profile piece 578, and that the embodiment in FIG. 32 does not have a plunger similar to element 180 in FIG. 17.

With reference to FIGS. 32 and 33, it may be seen that heel portion 556 includes a first profile 562 formed by an annular heel plate 564 that has a plurality of spaced apart auxiliary or satellite actuator elements 566 positioned around the perimeter in a U-shape. Actuator elements 566 are formed of a stiff, fairly rigid material and define a first profile chamber 568 which has an opening 570 formed in annular heel plate 564. A layer of resilient stretchable material 572 is configured so that it will span across opening 570 with heel plate 564 and resilient layer 572 being secured together such as by an adhesive or other suitable means. Thus, first profile piece 562 is positioned on one side of resilient layer 572, and a second profile piece 574 is positioned on a second side of resilient layer 572 and is affixed thereto in any convenient manner. Second profile piece 574 is in the form of a heel piece but defines a primary actuator element or main thrustor for interaction with chamber 570. As shown in FIG. 33, second profile piece 574 preferably decreases or tapers in dimension in a downward direction, and more preferably has a substantially lower dome-like shape with sloping surfaces. This shape provides improved lateral support to the heel through three basic phases of foot movement of heel strike, mid stance and toe off.

Heel portion 556 includes a third profile piece or foundation layer 578 that includes a plurality of openings 582 that are sized and oriented to receive actuator elements 566 noted above. To this end, heel portion 556 includes a second resilient layer 584. Openings 582 define second profile chambers each having a second interior region. The upper surfaces of actuators 566 just contact the lower surface of second resilient layer 584. Each of secondary actuator elements 566 align with a respective opening 582 having a similar shape as the configuration of actuator 566 but slightly larger in dimension.

A pair of support blocks or motion control posts 602 are provided underlying the forward pair of actuators 566. Like the second profile piece 574, these posts 602 are preferably convex downward in shape, and are more preferably dome-like in shape and forwardly sloped to provide improved lateral stability to the sole.

The rubber lugs 598 are provided beneath the resilient layer 584 to substantially mate and interlock with the actuators 566. Both the rubber lugs 598 and the actuators 566 are preferably tapered in a forward direction to allow for a more controlled lateral displacement during compression. The side walls of lugs 598 and 566 are preferably sloped approximately 3 to 6 degrees. Each of the lugs mirror each other to provide elastically cradled interaction. The space between the rubber lugs 598 and thrustors 566 is preferably less than about 0.020 inches, to keep particles larger than 0.020 out. Too tight of a seal creates a vacuum, slowing the rebound process. The interlock allows a sufficient air flow, particularly during rebound as a too-tight-of-a-seal creates a vacuum slowing the rebound process. In anticipation, this design leaves a large space between the motion control posts 602 to allow for the exit of air, water, etc.

The actuators 566 preferably have a raised nesting pattern to better interlock with the rubber lugs 598. The nesting effect creates a more adaptable environment, improving the conversion of energies from rotational forces to vertical force storage and retrieval. By specifically increasing the thickness of the plate 564 near the actuators 566, weight is also reduced. Nesting patterns also act as a relocator and stabilizer for actuators fostering the energy wave to vertical vectors. Nesting patterns increase the sensitivity of the main thrustor 574 maximizing the length of propulsion or drive of the rebounding thrustor. They also provide additional force at the end of the thrust cycle, and help keep actuators in place.

Varying the actuator rigidity increases the amount of control over the energy "wave" and the neuro-muscular system's sensitivity to it. If the user's foot naturally supinates, that action tends to put excessive motion control demands on the outer border of the forefoot, metatarsal number five. This excessive undesirable motion is sequentially captured by a chambered actuator, such as actuator 574 in the sixth exemplary embodiment described above, stored and released quickly enough that the negative motion itself becomes the energy for sending the foot laterally to medially enhancing neutral plane functioning. A more rigid chambered actuator resists tipping or diving to the outer lateral or medial borders, thereby stabilizing the interlocking energy storing process. Further details regarding varying the actuator rigidity is described in the seventh exemplary embodiment below.

Seventh Exemplary Embodiment

FIGS. 34–68 illustrate a seventh exemplary embodiment of a sole construction according to the present invention. As used throughout this specification, the term "sole construction" refers to both a whole or a portion of the sole used to support a human foot. Furthermore, because the components described in the seventh exemplary embodiment are similar to many of the components described in the embodiments above, it should be appreciated that the terminology used to describe similar components in the above embodiments may be interchangeable with the terminology used below.

Figure 34:
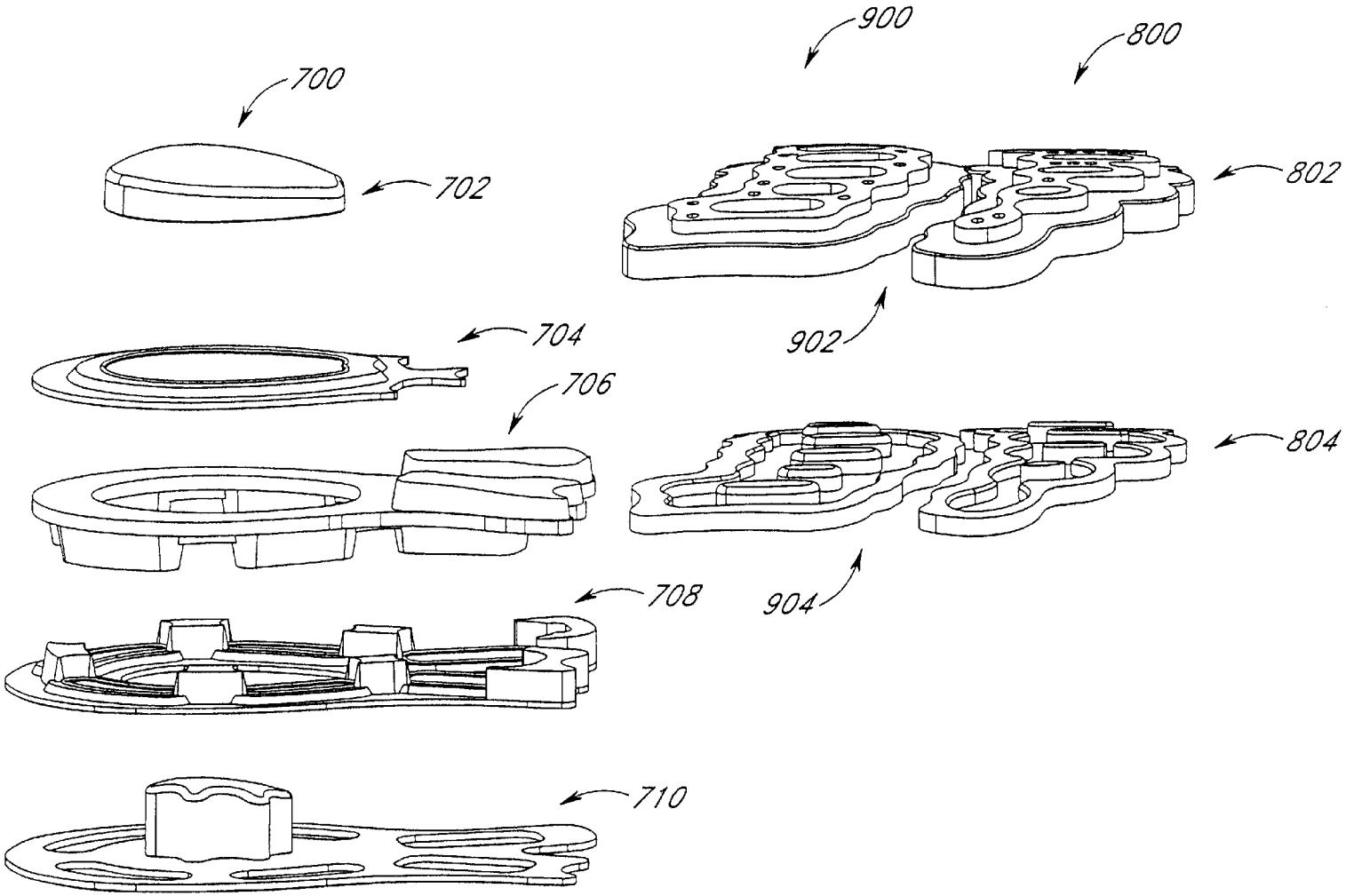
FIG. 34 is an exploded perspective view of a seventh exemplary embodiment of the sole construction of the present invention.

FIG. 34 illustrates the preferred sole construction in an exploded perspective view, with each of the components shown upside-down. More particularly, the sole construction includes three regions, namely a heel portion 700, a toe portion 800, and a metatarsal or forefoot portion 900. Heel portion 700 includes a main thrustor 702, a first layer of resilient stretchable material 704, a satellite thrustor layer 706, a second layer of resilient stretchable material 708 and a foundation or secondary thrustor layer 710. Toe portion 800 includes an actuator layer 802 and a chamber layer 804. Forefoot or metatarsal portion 900 includes an actuator layer 902 and a chamber layer 904. Each of the components comprising each portion of the foot is attached preferably using chemical bonding during a molding process as would be known to one skilled in the art. As described herein, the "top" of the sole construction as shown in FIGS. 34–68 is designated as being toward the secondary thrustor layer 710, and the "bottom" of the sole construction is designated as being toward the main thrustor 702. Correspondingly, the heel portion 700 represents the back or rear of the sole construction and the toe portion 800 represents the front of the sole construction.

Figure 37:
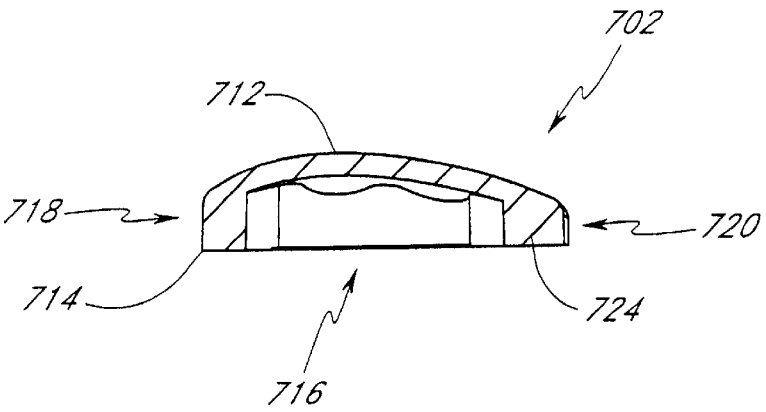
FIG. 37 is cross-sectional view of the main thrustor of FIG. 36, taken along line 37—37.
Figure 35:
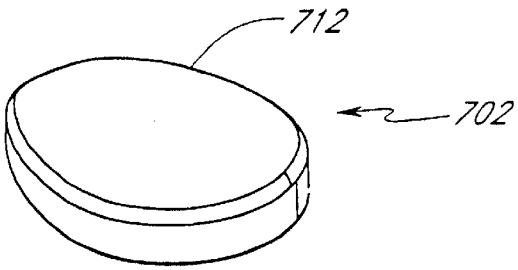
FIG. 35 is a perspective view of the main thrustor of the sole construction of FIG. 34.
Figure 36:
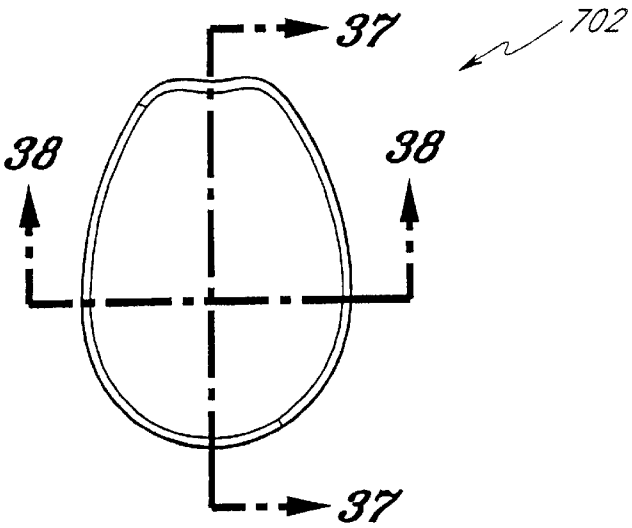
FIG. 36 is a bottom plan view of the main thrustor of the sole construction of FIG. 34.
Figure 38:
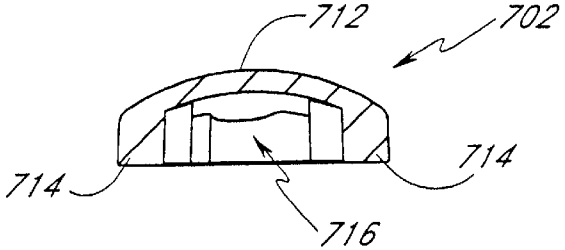
FIG. 38 is a cross-sectional view of the main thrustor of FIG. 36, taken along line 38—38.

As shown in FIGS. 35–38, the main thrustor 702 is preferably tapered downward and has a substantially domed bottom surface 712 (shown toward the top of FIG. 35) which slopes more in the forward direction, thereby providing lateral stability and allowing rotational movement to the heel bone of the human foot that it substantially directly underlies. The main thrustor 702 is substantially oval-shaped, as shown in FIG. 36, being longer in the front-to-rear direction than side-to-side. As shown in FIGS. 37 and 38, the main thrustor 702 includes an upstanding wall 714, extending upwardly away from the bottom surface and defining a chamber 716 within the main thrustor. This chamber 716 preferably has a six-lobed shape, similar to thrustor 474 in the fifth exemplary embodiment described above (see FIG. 30), but is enclosed by bottom surface 712. The wall 714 preferably slopes slightly outward as the wall extends away from the surface 712. The main thrustor 702 is preferably designed to be slightly tapered toward the front of the foot, such that the height of the wall 714 at the rear end 718 of the thrustor is larger than the wall at the front end 720 of the thrustor. This design provides additional support to the rear of the heel while accommodating the rolling motion of the heel. In particular, the curved bottom surface 712 allows energy to spread out laterally when the sole construction is compressed and allows for more efficient movement as the sole construction crosses the ground.

In the illustrated embodiment, the thrustor 702 has a rear wall height of about 0.324 inches, which decreases to a height of about 0.252 inches at the front of the wall 714. In this embodiment, the wall 714 is preferably sloped about 1.5 degrees. The bottom surface 712 connecting the walls and defining the bottom of the chamber 716 preferably has a thickness of about 0.125 inches. The height of the entire main thrustor 702, from the top of the wall 714 to the bottommost point of the surface 712 is about 0.536 inches. As shown in FIG. 36, the length of the thrustor 702, as measured along line 37—37, is about 2.101 inches, and the width of the thrustor 702, as measured along line 38—38, is about 1.561 inches. It should be appreciated that these dimensions are merely exemplary of one embodiment, and numerous variations can be made to the dimensions of the sole construction. The preferred material for the thrustor 702 is a plastic such as Dupont HYTREL®, but other materials being more or less rigid may also be used. When greater rigidity is desired, for instance, fiberglass may be used.

Figure 39:
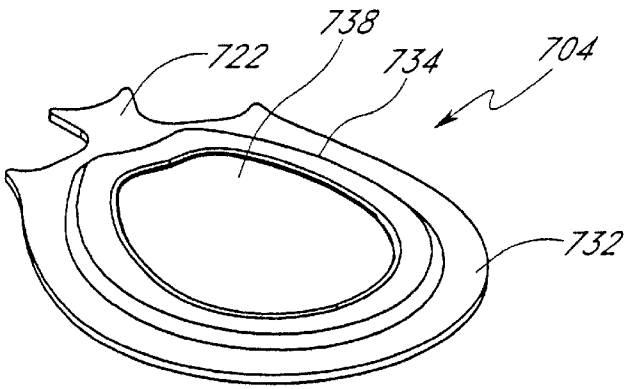
FIG. 39 is a perspective view of the first resilient layer of FIG. 34.
Figure 40:
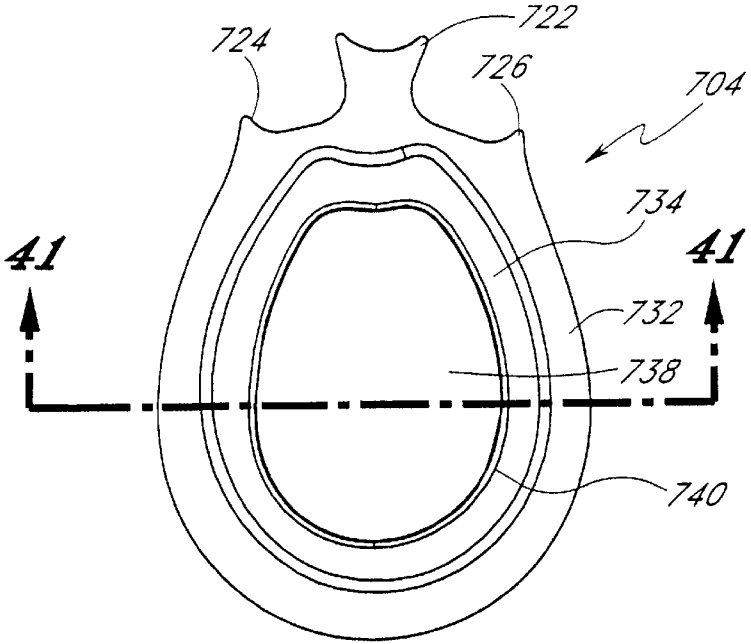
FIG. 40 is a bottom plan view of the first resilient layer of FIG. 34.
Figure 41:
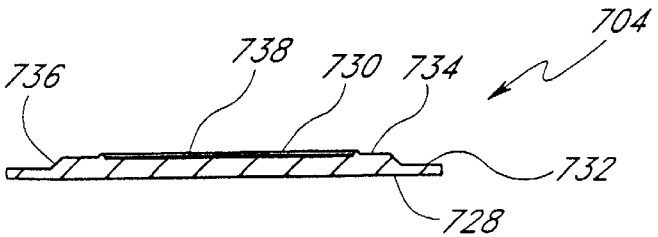
FIG. 41 is a cross-sectional view of the first resilient layer of FIG. 40, taken along line 41—41.

FIGS. 39–41 illustrate a first layer of resilient stretchable material 704 that is disposed above the main thrustor 702 of the sole construction shown in FIG. 34. This layer is preferably made out of rubber, and has a substantially oval shape similar to but larger in footprint size than that of the main thrustor 702. The layer 704 also includes a tongue 722 extending from the front of the layer 704, and has comers 724 and 726 at the front of the layer 704.

As shown in FIGS. 40 and 41, the top surface 728 of the layer 704 is preferably planar. The bottom surface 730 of the layer 704 preferably has a boundary region 732 which extends around the perimeter of the layer 704 in a substantially oval shape. Within this boundary region 732 is an intermediate region 734 also having a substantially oval shape, the intermediate region having a greater thickness than that of the boundary region. The increase in thickness between boundary region 732 and the intermediate region 734 is preferably gradual, thereby providing a sloped surface 736 as shown in FIG. 41. Within the intermediate region 734 is a central stretch region 738 that is slightly recessed relative to the intermediate region 734, and is separated from the intermediate region by a boundary ring 740. This central stretch region 738 is sized to have substantially the same shape as the main thrustor 702 described above, such that when the sole construction is compressed during a walking or running activity, the thrustor 702 presses against the central region 738 causing it to stretch.

In the illustrated embodiment, the resilient layer 704 has a thickness of about 0.06 inches in the boundary region 732, increasing to about 0.135 inches in the intermediate region 734, and decreasing to about 0.125 inches in the central stretch region 738. The length of the layer 704, when measured from the front tip of the tongue 722 to the back of the layer 704, is about 3.793 inches. The width of the layer 704 at its widest portion is about 2.742 inches. The length of the layer 704, when measured from the comers 724 and 726 to the back of the layer 704, is about 3.286 inches. When measured from the back of the layer to the frontmost edge of the intermediate region 734, this length is about 3.098 inches. The width of the boundary region as it extends around the oval shape of the layer varies from about 0.298 inches at the rear of the layer to about 0.28 inches at the lateral sides of the layer. The slope of the surface 736 is preferably about 45°. Again, it should be appreciated that all of these dimensions are merely exemplary of one particular embodiment.

Figure 42:
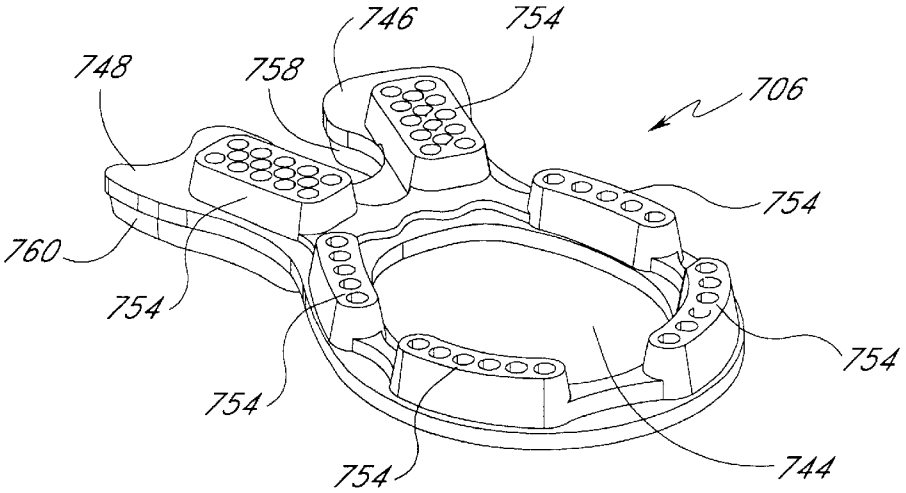
FIG. 42 is a perspective view of the satellite thrustor layer of FIG. 34.
Figure 44:
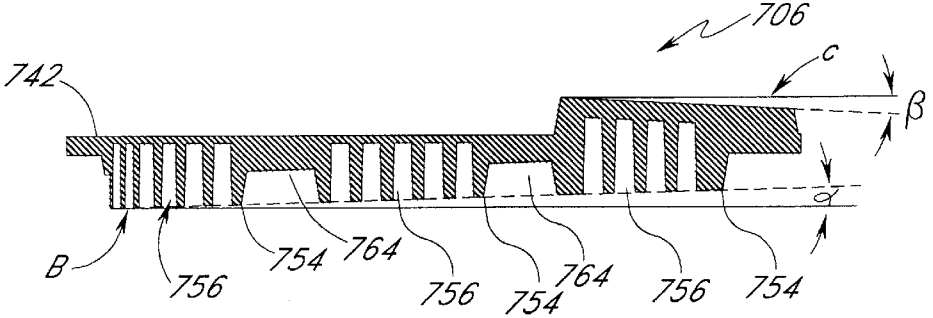
FIG. 44 is a cross-sectional view of the satellite thrustor layer of FIG. 43, taken along line 44—44.
Figure 43:
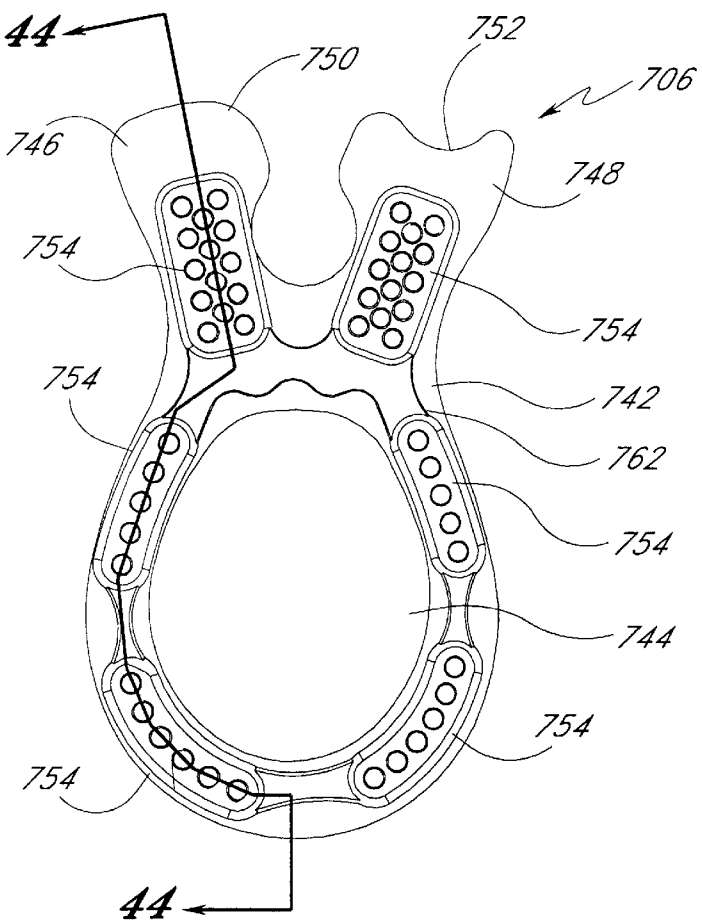
FIG. 43 is a bottom plan view of the satellite thrustor layer of FIG. 34.

FIGS. 42–44 illustrate the satellite thrustor layer 706 of the sole construction of FIG. 34. As shown in FIGS. 42 and 43, the layer 706 comprises an annular heel plate 742 including an opening 744 which serves as a chamber through which main thrustor 702 and resilient layer 704 extend when the assembled sole construction is compressed. Thus, the opening or chamber 744 has a substantially oval shape which is large enough to contain the main thrustor 702.

The preferred shape of the heel plate 742 is substantially annular, further comprising two extensions 746 and 748 toward the front of the foot. As shown in FIG. 34, the shape of the extensions 746 and 748 depends on whether the sole construction is for a right foot or a left foot. The design shown in FIG. 34 is for a left foot, and accordingly, the left extension 748 preferably has a front surface 752 which is concave outward while the right extension 746 preferably has a front surface 750 which is convex outward. It will be appreciated, of course, that these shapes will be reversed for a sole construction for a right foot. Simply put, for either foot, the front surface of the inner extension is preferably convex outward and the front surface of the outer extension is preferably concave outward.

The top side of the layer 706 is preferably provided with a plurality of satellite thrustors 754 arranged substantially in a U-shape around the layer. As shown in FIG. 44, the top surfaces of these thrustors 754 are preferably tapered toward the front of the layer, as indicated by angle a. Furthermore, each satellite thrustor 754 preferably has a plurality of holes 756 extending partially therethrough. The holes 756 serve to reduce the weight of the satellite thrustors. In the preferred embodiment, two of the satellite thrustors are provided over the extensions 746 and 748, while four thrustors are distributed around the opening 744.

At the front of the layer 706 and extending from the underside of the extensions 746 and 748 are support blocks 758 and 760 which are preferably integrally formed with the layer 706. As shown in FIG. 42, these support blocks preferably have substantially the same shape as the extensions 746 and 748, in that the front surface of the inner support block 758 is preferably convex outward, while the front surface of the outer support block 760 is preferably concave outward. As shown in FIG. 44, these support blocks are preferably tapered toward the front of the layer 706, as indicated by angle β, and have front and rear walls that are preferably sloped.

As shown in FIGS. 43 and 44, the satellite thrustors 754 and provided on the upper side of the layer 706 on a raised nesting pattern 762. As shown in FIG. 44, the raised nesting pattern 762 creates chambers 764 between the satellite thrustors having a substantially trapezoidal shape as shown.

In the illustrated embodiment, the length of the layer 706 from the front surface 750 of extension 746 to the rear of the plate 742 is about 4.902 inches. The length of the oval-shaped opening 744 along its major axis is about 2.352 inches. The width of the layer 706, as measured laterally across its widest portion, is about 2.753 inches. The width of the layer, as measured laterally across its narrowest portion, is about 1.776 inches. The satellite thrustors 754 are tapered, as shown in FIG. 44, about 1.58 degrees, as indicated by angle $\alpha$. The support blocks 758 and 760 are preferably tapered about 3 degrees, as indicated by angle $\beta$, and have front and rear walls which are sloped about 7 degrees. The height of the layer 706 as measured from the underside of the plate 742 to the top of the tallest satellite thrustor, as indicated by plane B in FIG. 44, is about 0.477 inches. The plate 742 itself has a thickness of about 0.1 inches at its thinnest point. For the tallest thrustor, the holes 756 as measured from plane B preferably have a depth of about 0.427 inches. The height of the layer 706, as measured from the bottom of the support block 758, as indicated by plane C in FIG. 44 to plane B, is about 0.726 inches. The layer 706, including the satellite thrustors 754, are preferably made of a material similar to the layer 702, and in one preferred embodiment, is Dupont HYTREL®.

Figure 45:
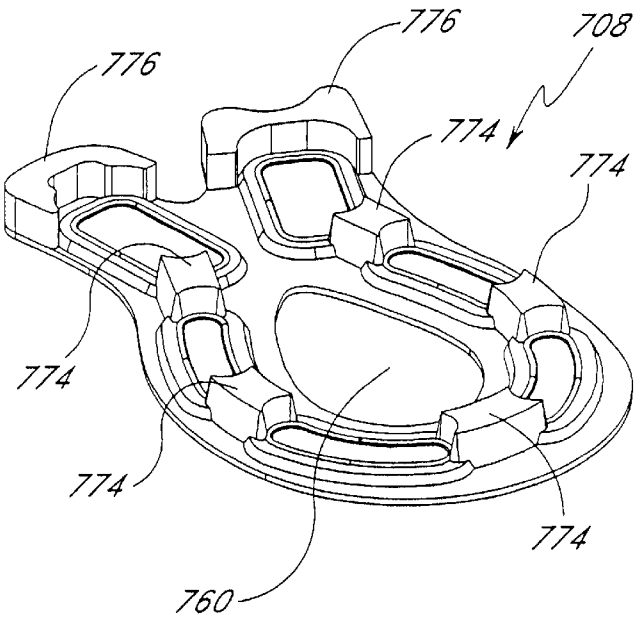
FIG. 45 is a perspective view of the second resilient layer of FIG. 34.
Figure 46:
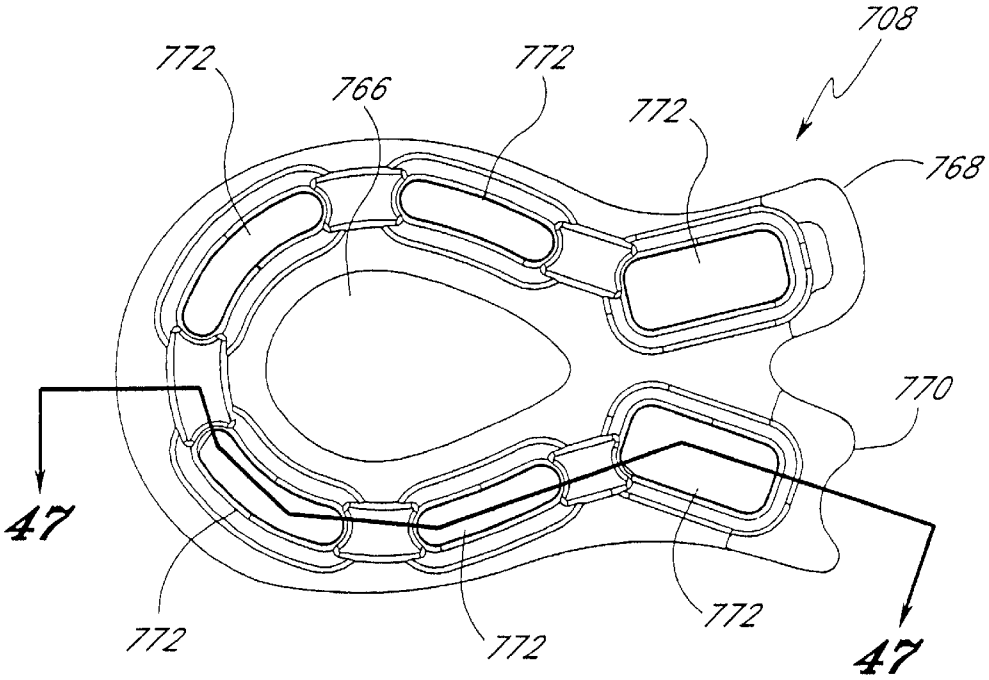
FIG. 46 is a bottom plan view of the second resilient layer of FIG. 34.
Figure 47:
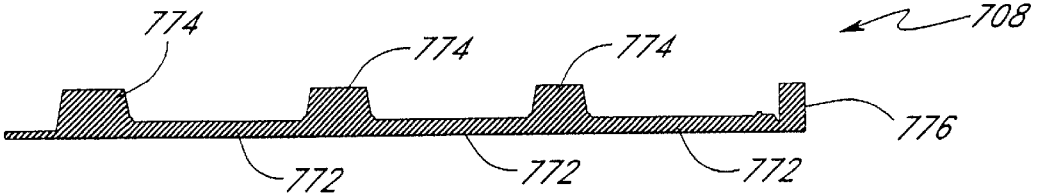
FIG. 47 is a cross-sectional view of the second resilient layer of FIG. 46, taken along line 47—47.
Figure 48:
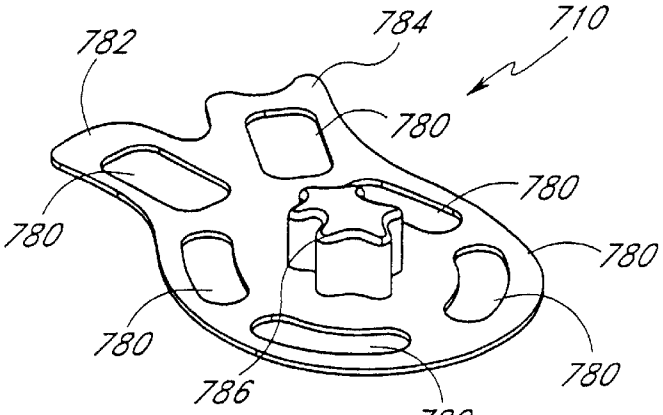
FIG. 48 is a perspective view of the secondary thrustor layer of FIG. 34.

FIG. 45–47 illustrates the second layer 708 of resilient material. This layer is preferably made of rubber, and is shaped substantially to correspond with the shape of the satellite thrustor layer 706. More particularly, like the layer 706, layer 708 has a substantially annular shape with a substantially oval-shaped opening 766 therein and two extensions 768 and 770 protruding forward therefrom. The front surface of the outer extension 770 is preferably concave outward, while the front surface of the inner extension 768 is preferably convex outward.

Disposed around the opening 760 and on the extensions 768 and 770 are stretch regions 772 which correspond to the satellite thrustors 754 of layer 706. These stretch regions 772 are preferably integrally formed with the layer 708 and have an increased thickness as shown in FIG. 47 as compared to the rest of the layer 708 to give them a raised configuration. The stretch regions 772 are preferably substantially rectangular in shape having curved comers to correspond with the shape of the satellite thrustors. Each of these stretch regions 772 has a footprint size which is larger than that of the satellite thrustors 754 in order to allow the satellite thrustors to press through the stretch regions when the sole construction is compressed.

A plurality of compressible rubber lugs 774 and 776 is also provided around the layer 708, preferably disposed between each of the stretch regions 772. In the preferred embodiment, five lugs 774 are provided between the six satellite thrustors, with two additional lugs 776 provided at the front of layer 708 underlying extensions 768 and 770. These rubber lugs 774 and 776 are preferably integrally formed with the layer 708. More preferably, the lugs 774 and 776 are substantially rectangular in shape to conform to the shape of the stretch regions 772. More particularly, the walls of the lugs 774 as between each of the stretch regions are preferably concave inward, as shown in FIG. 47, such that they mate with the shape of the stretch regions 772. As shown in FIG. 47, the lugs preferably extend substantially downward away from the layer 708, and have sloped walls. These lugs are therefore shaped to mate with the chambers 764 of the satellite thrustor layer 706, and provide energy storage and return when the sole construction is compressed causing compression of the lugs 774 in the chambers 764. The lugs 776 at the front of the layer 708 are shaped to correspond with the shape of the extensions 768 and 770.

As shown in FIG. 46, for the illustrated embodiment the layer 708 has a length measured from the back of the layer 708 to the front surface of extension 768 of about 5.17 inches. The width of the layer at its widest portion is about 3.102 inches, and at its narrowest portion is about 2.236 inches. The width of the annular portion of layer 708 measured from the rear of the layer to the rear of the opening 766 is about 1.02 inches. The distance from the rear of the layer 708 to the front of the opening 766 is about 3.138 inches. The width of the opening as measured across its minor axis is about 1.302 inches. The layer 708 along its outer edge has a thickness of about 0.05 inches. At the raised stretch regions 772 the thickness is about 0.120 inches, and at the lugs 774 and 776 the thickness is about 0.319 inches. The lugs 774 are preferably sloped about 7 degrees to mate with the chambers 764.

The foundation or secondary thrustor layer 710 is shown in FIGS. 48–51. The thrustor layer 710 comprises a plate 778 having a plurality of openings or chambers 780 therein. This plate 778 is shaped substantially the same as the resilient layer 708 and satellite thrustor layer 706, in that it is substantially oval-shaped corresponding to the shape of the heel with two extensions 782 and 784 extending from the front. The chambers 780 are arranged to correspond with the satellite thrustors 754 of layer 706, which will move into the chambers 780 through resilient layer 708 when the sole construction is compressed. Accordingly, chambers 780 have substantially the same footprint shape as the satellite thrustors 754, but are sized slightly larger to accommodate the thrustors 754.

Figure 49:
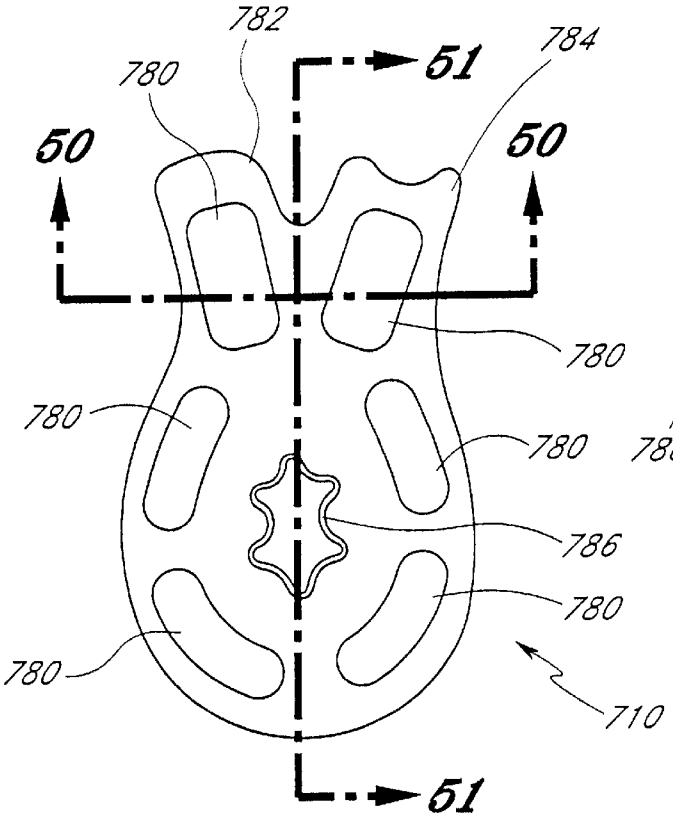
FIG. 49 is a bottom plan view of the secondary thrustor layer of FIG. 34.
Figure 50:
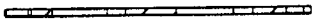
FIG. 50 is a cross-sectional view of the secondary thrustor layer of FIG. 49, taken along line 50—50.
Figure 51:
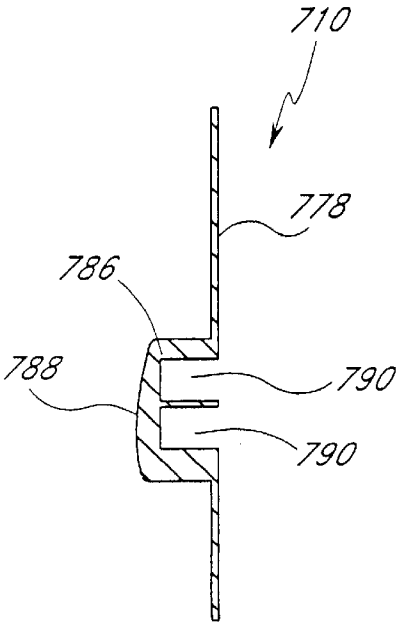
FIG. 51 is a cross-sectional view of the secondary thrustor layer of FIG. 49, taken a long line 51—51.
Figure 52:
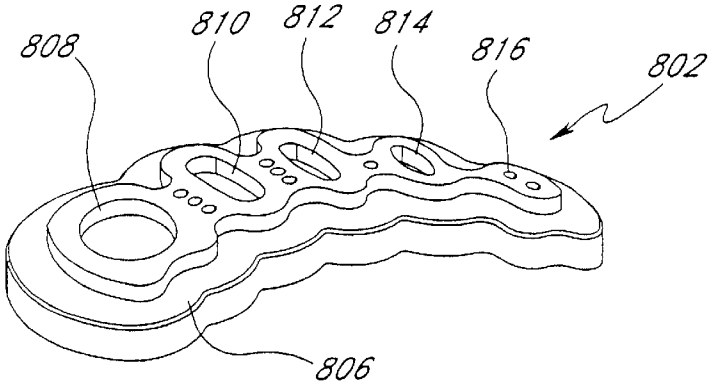
FIG. 52 is is a perspective view of the toe actuator layer of FIG. 34.

A secondary thrustor 786 is provided on the underside of the plate 778 substantially centered within the chambers 780 and extending downward therefrom. This secondary thrustor 786 is positioned such that when the sole construction is assembled, the thrustor 786 extends through the opening 766 in resilient layer 708 and the opening 744 in satellite thrustor layer 706. More particularly, the thrustor 786 preferably has a six-lobe shape which corresponds with the six-lobe opening 716 of main thrustor 702. Thus, when the sole construction is compressed, the secondary thrustor 786 presses against the stretch portion 738 of resilient layer 704 and into the opening 716. As shown in FIGS. 49 and 51, the bottom surface 788 of secondary thrustor 786 preferably has a curved or substantially domed shape, and preferably also has a pair of holes 790 extending partially therethrough to reduce the weight of the secondary thrustor.

The layer 710 of the illustrated embodiment shown in FIGS. 48–51 preferably has a length measured from the rear of the plate 778 to the front of extension 782 of about 5.169 inches. The width of the layer 710 across its widest portion is preferably about 3.105 inches, and across its narrowest portion is about 2.239 inches. The width between the outer lateral sides of extensions 782 and 784 is preferably about 2.689 inches. The front pair of chambers 780 preferably each has a length of about 1.25 inches and a width of about 0.63 inches. The plate 710 preferably has a thickness of about 0.06 inches, and the secondary thrustor preferably has a height as measured from the top side of the plate of about 0.71 inches. The holes 790 in the secondary thrustor each has a diameter of about 0.35 inches and a depth of about 0.5 inches. The layer 710 is preferably made of a material such as Dupont HYTREL®, although other similar materials may also be used. For instance, when more rigidity is required, materials such as fiberglass and graphite may also be used.

Figure 55:
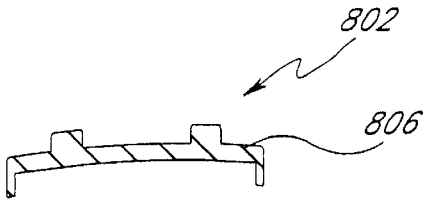
FIG. 55 is a cross-sectional view of the toe actuator layer of FIG. 53, taken along line 55—55.
Figure 53:
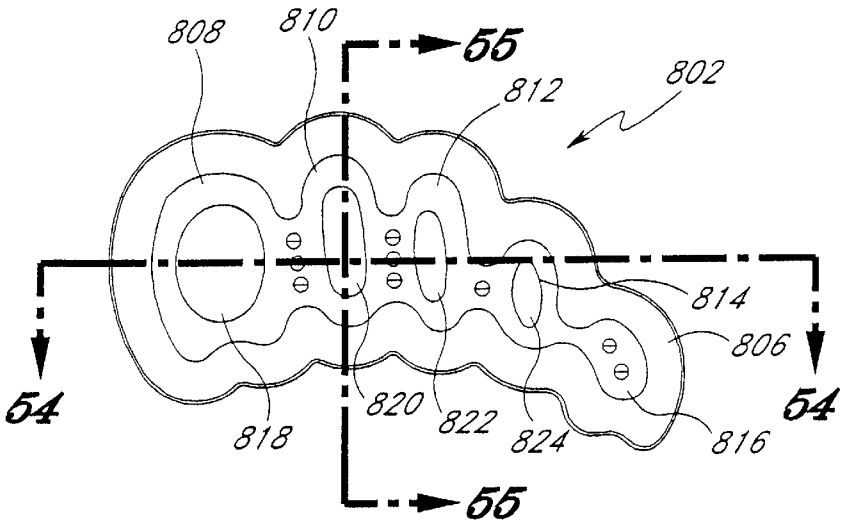
FIG. 53 is a bottom plan view of the toe actuator layer of FIG. 34.
Figure 54:
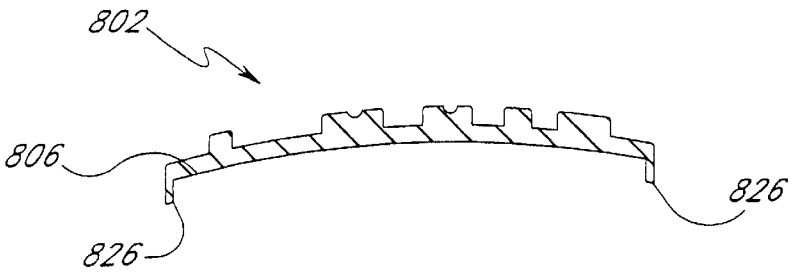
FIG. 54 is a cross-sectional view of the toe actuator layer of FIG. 53, taken along line 54—54.
Figure 56:
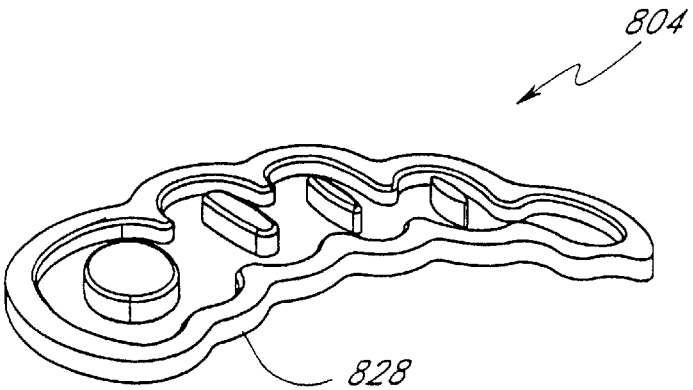
FIG. 56 is a perspective view of the toe chamber layer of FIG. 34.
Figure 57:
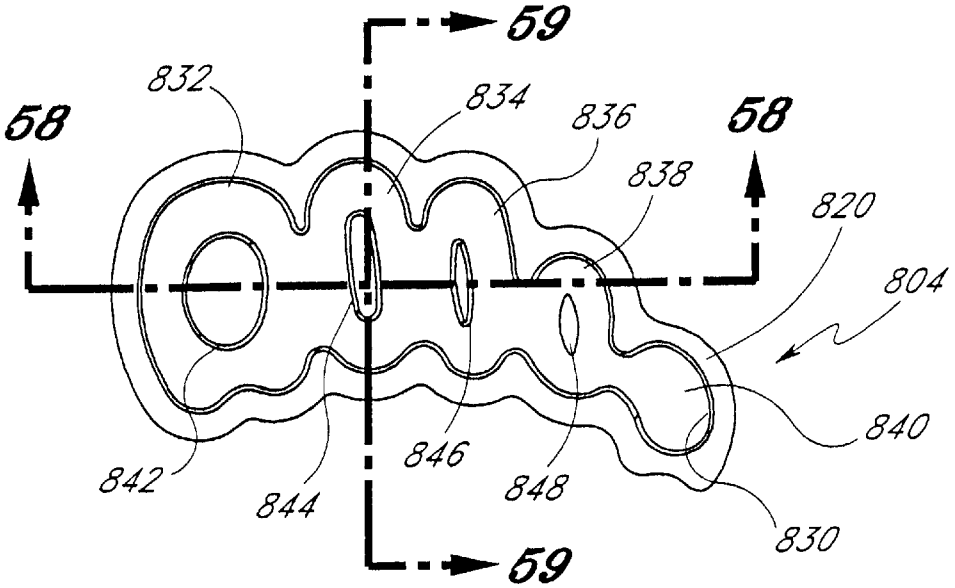
FIG. 57 is a bottom plan view of the toe chamber layer of FIG. 34.

FIGS. 52–55 illustrate the toe actuator layer 802 of the sole construction of the seventh exemplary embodiment. This layer 802 is preferably made of rubber, with all of the elements described and shown in FIGS. 52–55 being preferably integrally formed. The layer 802 preferably comprises a main resilient portion 806. Provided on the lower side of the main portion 806 are the toe actuators 808, 810, 812, 814 and 816, corresponding to each of the human toes. As shown in FIG. 54, the toe actuators are preferably raised segments below the main portion 806. The first through fourth toe actuators 808–814 also contain chambers 818, 820, 822 and 824, respectively, within the actuators, which are substantially oval in shape. As shown in FIGS. 54 and 55, the toe actuator layer is preferably arched. Along the edges of the toe actuator layer 802 are upwardly-oriented walls 826 to contain the toe chamber layer 804, described below.

The illustrated toe actuator layer 802 preferably measures about 4.165 inches from side-to-side. The toe actuator layer 802 preferably has a width measured from its frontmost point to its rearmost point of about 2.449 inches. The main portion 806 of the layer 802 preferably has a thickness of about 0.12 inches, with the actuators 808–816 having a height of about 0.12 inches measured from the underside of the main portion 806. The walls 826 preferably extend about 0.16 inches away from the top side of the main portion 806, and are preferably about 0.55 inches thick.

Figure 58:
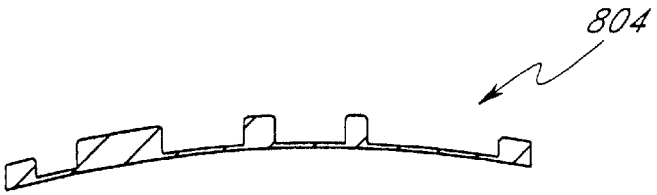
FIG. 58 is a cross-sectional view of the toe chamber layer of FIG. 57, taken along line 58—58.
Figure 59:
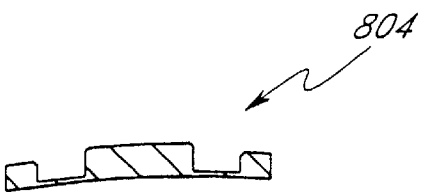
FIG. 59 is a cross-sectional view of the toe chamber layer of FIG. 57, taken along line 59—59.
Figure 60:
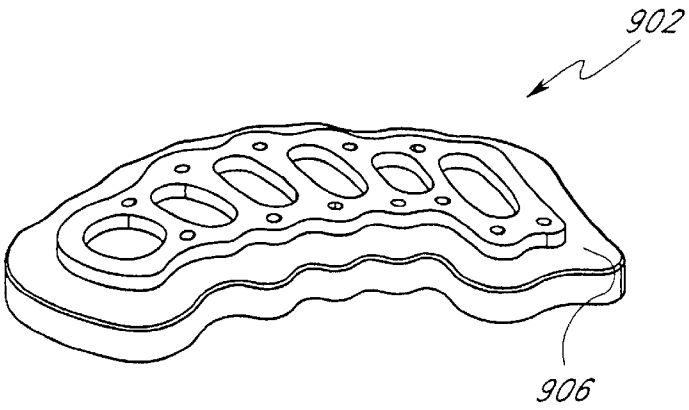
FIG. 60 is a perspective view of the forefoot actuator layer of FIG. 34.

FIGS. 56–59 illustrate the toe chamber layer 804 that corresponds with the toe actuator layer described above. The toe chamber layer 804 is also preferably made of Dupont HYTREL®, and is formed having an upstanding perimeter wall 828 that extends around the peripheral edge of the layer 804 to define a chamber 830 therein. The toe chamber layer 804 is shaped geometrically similar to the toe actuator layer and is also preferably arched as shown in FIGS. 58 and 59. As may be seen with reference to FIG. 57, perimeter wall 828 is configured so that chamber 830 has five regions 832, 834, 836, 838 and 840, that correspond to each of the human toes. Plungers 842, 844, 846 and 848 preferably having a substantially oval shape are provided in each of the first four regions 832, 834, 836 and 838, respectively. The plungers are sized to be smaller than the corresponding chambers of layer 802. Similarly, the actuators of the layer 802 press through the main portion 806 into the chamber 830 when compressed. Thus, the toe actuator layer and toe chamber layer together provide a dual action energy storage system. The energy storage and return characteristics of the toe portion 800 is substantially as described with respect to FIGS. 20A–20C, above.

In the illustrated embodiment, the perimeter wall 828 and the plungers 842–848 preferably have a height of about 0.16 inches. The layer 804 has a thickness of about 0.03 inches at its thinnest point within chamber 830. The side-to-side length of the layer 804 is preferably about 4.044 inches and the front-to-rear width of the layer from its frontmost to rearmost point is about 2.326 inches.

Figure 64:
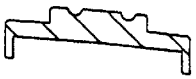
FIG. 64 is a cross-sectional view of the forefoot actuator layer of FIG. 61, taken along line 64—64.
Figure 63:
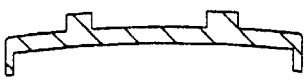
FIG. 63 is a cross-sectional view of the forefoot actuator layer of FIG. 61, taken along line 63—63.
Figure 61:
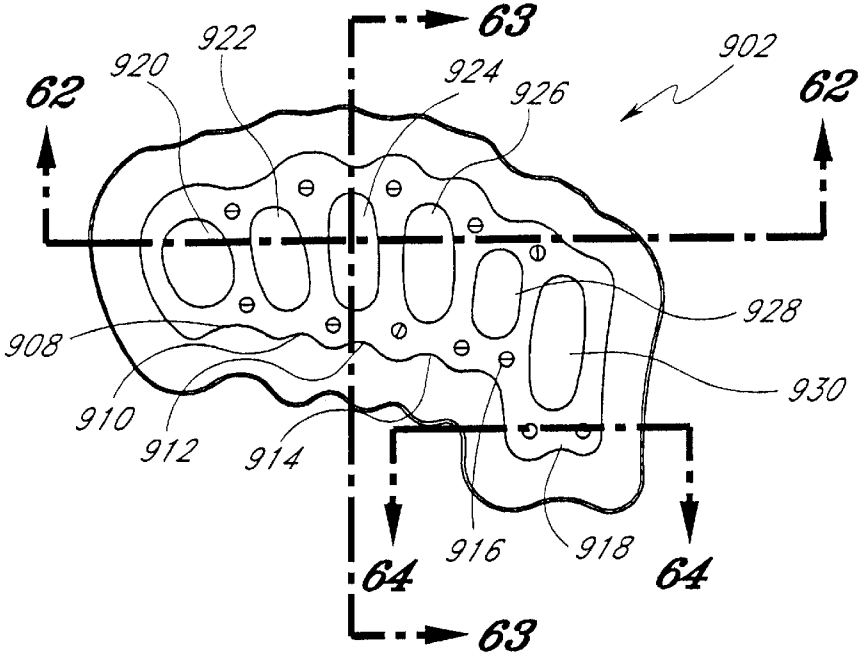
FIG. 61 is a bottom plan view of the forefoot actuator layer of FIG. 34.
Figure 62:
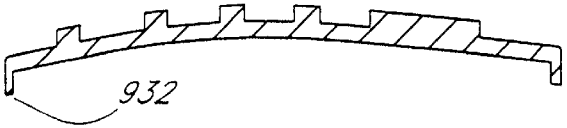
FIG. 62 is a cross-sectional view of the forefoot actuator layer of FIG. 61, taken along line 62—62.
Figure 65:
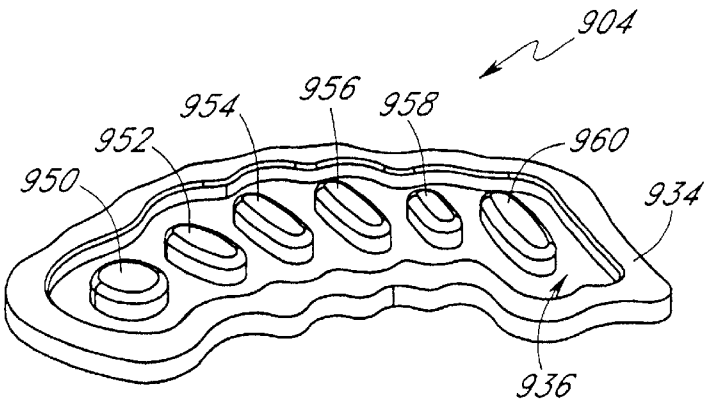
FIG. 65 is a perspective view of the forefoot chamber layer of FIG. 34.
Figure 66:
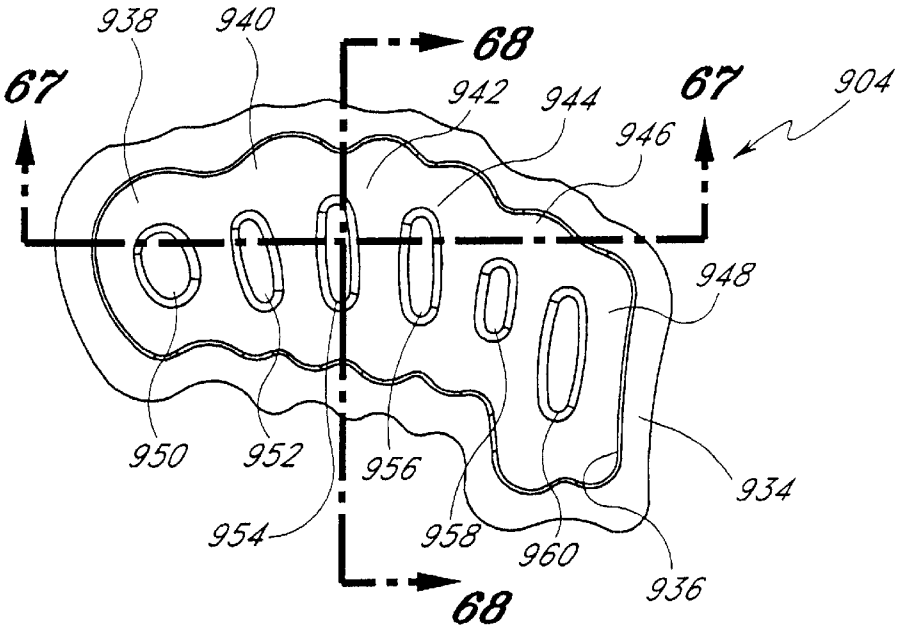
FIG. 66 is a bottom plan view of the forefoot chamber layer of FIG. 34.

The metatarsal or forefoot actuator layer 902 shown in FIGS. 60–64 is designed similar to the toe actuator layer 802. More particularly, the layer 902 is preferably made of rubber, with all of the elements described and shown in FIGS. 60–64 being preferably integrally formed. The layer 902 preferably comprises a main resilient portion 906. Provided below the main portion 904 are the metatarsal actuators 908, 910, 916, 914 and 918. As shown in FIG. 62, the metatarsal actuators are preferably raised segments below the main portion 904. The metatarsal actuators each contain chambers 920, 922, 924, 926, 928 and 930 within the actuators, which are substantially oval in shape. As shown in FIGS. 62–64, the metatarsal actuator layer is preferably arched. Along the edges of the metatarsal actuator layer 904 are upwardly-oriented walls 932 to contain the metatarsal chamber layer 904, described below.

The illustrated metatarsal actuator layer 902 preferably has a length of about 4.302 inches as measured across the side-to-side expanse of the metatarsals. The metatarsal actuator layer 902 preferably has a width of about 3.03 inches as measured from the frontmost to rearmost point of layer 902. The main portion 906 of the layer 902 preferably has a thickness of about 0.12 inches, with the actuators 908–918 having a height of about 0.12 inches measured from the underside of the main portion 906. The walls 932 preferably extend about 0.16 inches away from the top side of the main portion 906, and are preferably about 0.55 inches thick.

Figure 67:
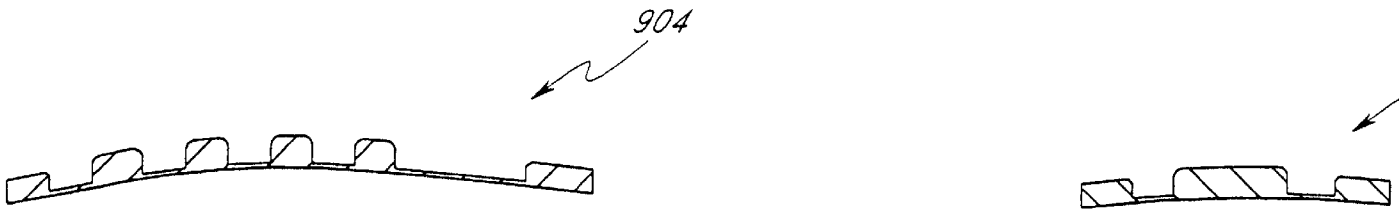
FIG. 67 is a cross-sectional view of the forefoot chamber layer of FIG. 65, taken along line 67—67.
Figure 68:
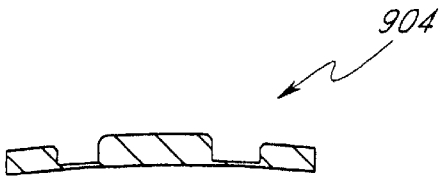
FIG. 68 is a cross-sectional view of the forefoot chamber layer of FIG. 65, taken along line 68—68.
Figure 69:
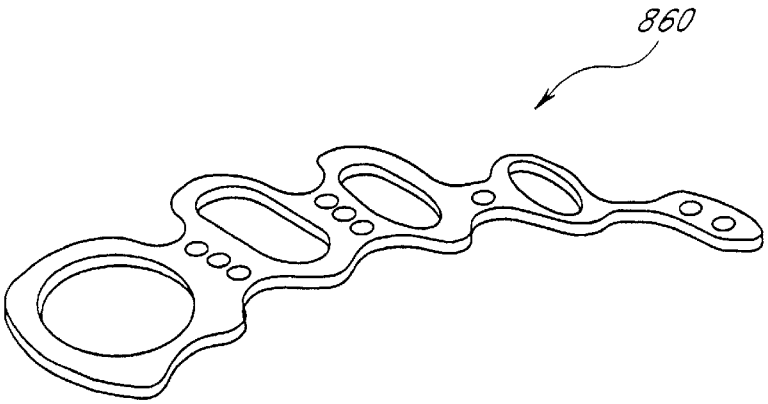
FIG. 69 is a perspective view of a toe traction layer.
Figure 72:
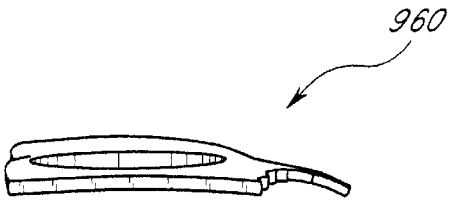
FIGS. 71 and 72 are side views of the toe traction layer of FIG. 69.
Figure 70:
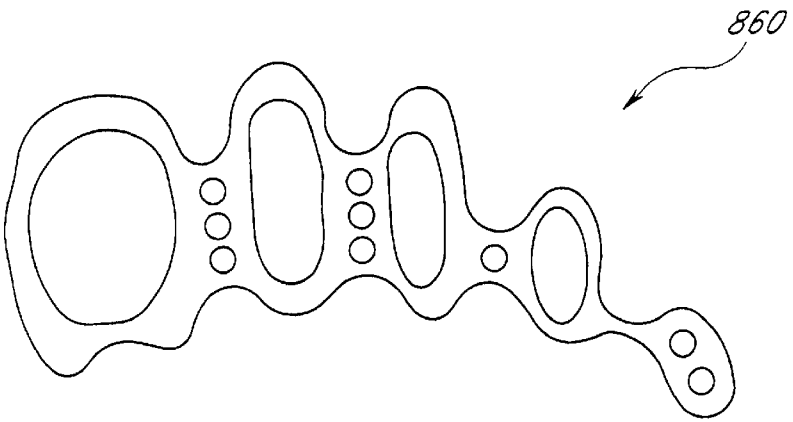
FIG. 70 is is a bottom plan view of the toe traction layer of FIG. 69.
Figure 71:
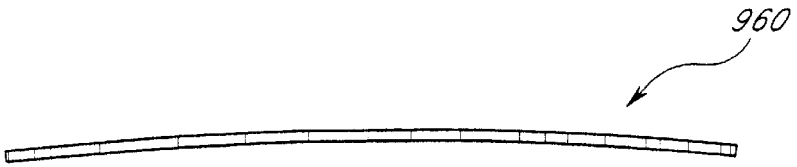
Figure 73:
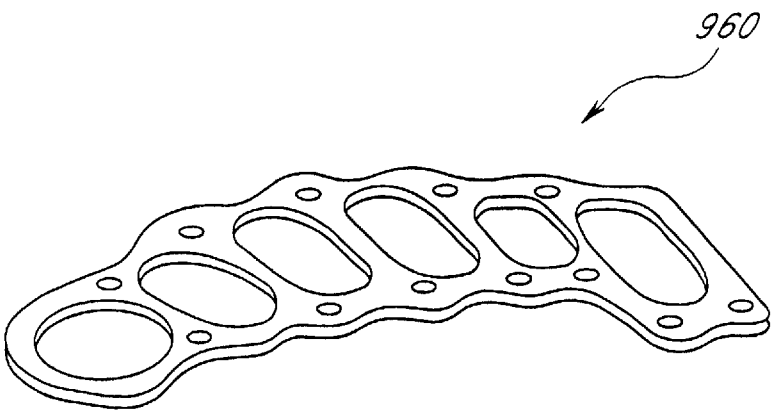
FIG. 73 is a perspective view of a forefoot traction layer.
Figure 76:
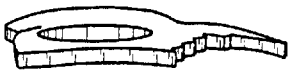
FIGS. 75 and 76 are side views of the forefoot traction layer of FIG. 73.
Figure 74:
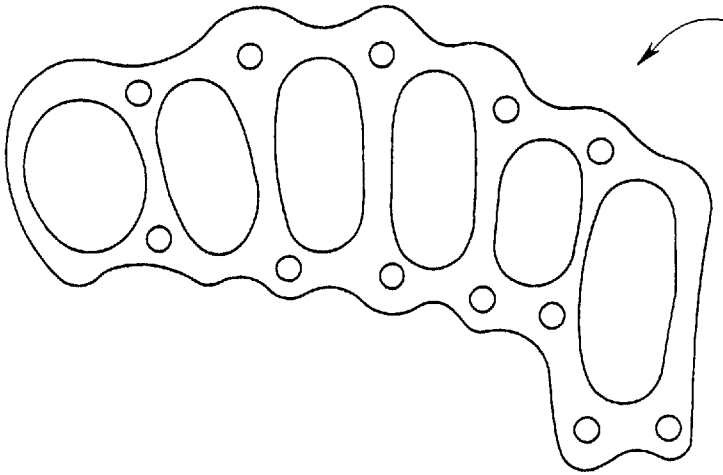
FIG. 74 is a bottom plan view of the forefoot traction layer of FIG. 73.
Figure 75:
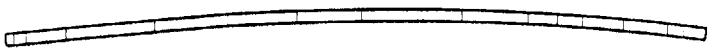

FIGS. 65–68 illustrate the metatarsal chamber layer 904 that corresponds with the metatarsal actuator layer 902 described above. The metatarsal chamber layer 904 is also preferably made of Dupont HYTREL®, and is formed having an upstanding perimeter wall 934 that extends around the peripheral edge of the layer 904 to define a chamber 936 therein. The metatarsal chamber layer is shaped geometrically similar to the metatarsal actuator layer and is also preferably arched as shown in FIGS. 67 and 68. As may be seen with reference to FIG. 66, perimeter wall 934 is configured so that chamber 936 has six regions 938, 940, 942, 944, 946 and 948. Plungers 950, 952, 954, 956, 958 and 960 preferably having a substantially oval shape are provided in each of the regions 938–948 in the chamber 936, respectively, which press downward through the main portion 906 of layer 902 into the chambers 920–930 when the sole construction is compressed. Accordingly, the plungers 950–960 are sized to be smaller than the corresponding chambers 920–930 of layer 902. Similarly, the actuators 908–918 of the layer 902 press through the main portion 906 of layer 902 into the chamber 936 when compressed to provide dual action energy storage and return. This is substantially the same energy characteristic as described above with respect to FIGS. 22A–22C.

In the illustrated embodiment, the perimeter wall 934 and the plungers 950–960 preferably have a height of about 0.16 inches. The layer 904 has a thickness of about 0.03 inches at its thinnest point within chamber 936. The length of the layer 904 is preferably about 4.182 inches, with a width of about 2.908 as measured between the frontmost and rearmost points of the layer 904.

The sole construction of the embodiments described above is preferably attached to the underside of an upper of a shoe (not shown). The embodiments described above may further include an outersole or traction layer chemically bonded to the bottom of the sole construction for contact with the ground. FIGS. 69–76 illustrate toe and forefoot traction layers designed for contact with the ground. As shown in FIGS. 69–73, the toe traction layer 860 is sized and shaped to conform substantially to the shape and size of the toe actuator layer 802. Similarly, the forefoot traction layer 960 is sized and shaped to conform substantially to the shape and size of the forefoot actuator layer 902. Each of these traction layers is preferably formed from a rubber material, and has lateral and medial borders that are approximately twice as tall as at its center to encourage foot and ankle rotation within the neutral plane. In one embodiment, the traction layers have a thickness of about 0.025 to 0.05 inches, with the thickness at the borders being about 0.05 inches and the thickness at the center being about 0.025 inches. It will be appreciated that traction layers may be also be provided underneath the heel portion, motion control posts and other portions of the sole construction.

Furthermore, it is also contemplated that a single traction layer be provided underneath the entire sole construction.

As illustrated above, the actuators of the sole construction may have a varying rigidity to improve stability of the foot and to accommodate the foot's natural rolling motion. As illustrated by the seventh exemplary embodiment, this varying actuator rigidity may be provided by making the satellite thrustors 754 and secondary thrustor 786 out of a more rigid material, such as 80 to 90 durometer Dupont HYTREL®, and making the main thrustor 702 out of a less rigid material, such as 40 to 50 durometer Dupont HYTREL®. Similarly, lugs 774 are preferably made of a less rigid material such as rubber. Thus, the sole construction has alternating rigidity which allows for fine tuning the energy storage and rebound provided by each of the actuators. Actuator rigidity may also be varied according to the desired use of the shoe. For instance, more compliant actuators may be desired to conform to uneven surfaces and for special use applications, such as trail running, golf and hiking. More rigid actuators may be used where greater performance is desired, such as for running and sprinting, vertical leaping, basketball, volleyball and tennis. It should therefore be appreciated that numerous possibilities exist for varying the rigidity of the actuators, in addition to varying their size, shape and position, to provide desired performance characteristics.

Furthermore, the curved shape of the actuators with corresponding curved chambers provides mechanical advantages to the performance of the sole construction. In particular, a curved actuator surface, when loaded, is pressured to a flatter state, causing an expansion of its footprint size into the stretchable layer. This expansion of the actuator increases the amount of stretching that the stretchable layer experiences, thereby leading to an increased storage and rebound of energy.

Experimental Results

The advantages of Applicant's invention are illustrated in the results of experimental tests performed on the shoe described in accordance with the seventh exemplary embodiment of the present invention ("Applicant's shoe"), as compared to a standard shoe. Unless otherwise noted, Mizuno Wave Runner Technology was used for the standard shoe. The results are presented below.

1. Whole Body Efficiency Results ($VO_2$ Uptake Tests)

Whole body efficiency measures the consumption and expiration of gases. To determine the improvement of Applicant's shoe as compared to the standard shoe, graded and steady state exercise tests were performed to analyze the expired gases (determine $VO_2$) with 3 or 12 lead electrocardiography during treadmill running on athletes. Specifically, $VO_2$ measures $O_2$ delivered by the heart/cardiac output.

Test subject athletes reported for testing on two occasions. On the first occasion each subject wore the standard shoe and $VO_{2max}$ was determined by a graded exercise test on a treadmill. On the second occasion the standard shoe and Applicant's shoe were compared using a 75–90% $VO_{2max}$ graded steady state intensity and absolute intensity protocol. The equipment used was a Sensor Medics $V_{max}$ 29 metabolic cart equipped with two calibration gas tanks, one laptop computer with software installed, one printer, one VGA monitor and 12/3 lead EKG machines. Additionally, sets of flow sensors, tubing, mouthpieces and headgears, as well as an ample supply of EKG patch electrodes, were used.

In response to the same running protocol, Applicant's shoe demonstrated a reduced $O_2$ consumption at the same relative (80%–90%) $VO_{2max}$ and absolute intensity in all male athletes tested. This finding was notable at intensities representing 80–90% $VO_{2max}$ and at speeds of 9.5, 10, 10.5 and 11 miles/hr. This finding is consistent with an improved whole body efficiency when running in Applicant's shoe relative to the standard shoe at paces that are typical of those performed during racing and intense recreational training. The average improvement in whole body efficiency at the aforementioned intensities was 13%. However, at the higher absolute and relative intensities, the average improvement in whole body efficiency was 15%. Individual variability was present, as certain individuals demonstrated an average improvement of efficiency of 21% and 18%, respectively, at the same absolute intensity of 10, 10.5 and 11 miles/hr. This individual variation may be credited to initial differences in biomechanics, body mechanics or running style. Interestingly, the least improvement was measured in the ultradistance runners, whereas the greatest effect of the shoe was measured in shorter distance triathletes/duathletes. This finding is consistent with the idea that the ultradistance runners demonstrated improved mechanical or biomechanical efficiency initially when compared with the shorter distance cross-trained athlete. The overall findings were that every subject received whole body efficiency improvements using Applicant's shoe. Results varied between subjects due to biomechanics, body mechanics and running style. In conclusion, Applicant's shoe leads to improved running efficiency as demonstrated by the physiological data of all male athletes tested.

The preliminary data to compare whole body efficiency during like protocol treadmill running using Applicant's shoe and the standard shoe in a female elite athlete is consistent with data previously collected on men. Although the magnitude of the effect was less, the measured $VO_2$ was consistently lower at all measured workloads and the discrepancy between males and one female runner may be credited to different running mechanics (specifically, forefoot running in the female). To this effect, when mechanics were made more similar by an imposed grade during very fast treadmill running, the whole body efficiency was improved. It is likely that the improved whole body efficiency measured in an elite female athlete when wearing the experimental is similar to that measured previously in men.

As seen in male runners, in response to the same running protocol, Applicant's shoe demonstrated a reduced $O_2$ consumption at the same relative (80–90%) $VO_{2max}$ and absolute intensity in an elite female runner. This finding was notable at intensities representing (80–95%) $VO_{2max}$ and at speeds of 8.5, 9, 9.5 and 10 mph. This finding is consistent with an improved whole body efficiency when running in the experimental shoe relative to the standard shoe at paces that are typical of those performed during racing and intense recreational training. Although the magnitude of the improvement measured at different intensities was smaller than that measured in men, it is still a notable (around 3%) difference. To this difference, it was noted that the elite female athlete landed primarily on her forefoot. Hence, the total effectiveness of the shoe may not have been fully measured due to the construction of the shoe which places the major mechanism in the heel of the shoe. Of interest was the $VO_2$ measurement during exercise on the treadmill in response to a change in grade. Mechanically for a forefoot runner this grade change at a 10.5 mph speed may force the athlete to spring off from her heel and thereby explain the improvement in whole body efficiency measured. Specifically, we measured a 5–7% decrease in whole body efficiency in the light of an increase in workload. Therefore, this improvement in whole body efficiency in response to grade is greatly underestimated. On the other hand, this preliminary data offers insight as to more areas of investigation for the possibility of improved whole body efficiency due to the mechanics of the experimental shoe.

2. Whole Body Kinematic Test

Applicant has also performed a whole body kinematic test to show how the whole body receives benefits from Applicant's invention in particular, by providing more proper angles at the ankle, knee and hip and less vertical body movements.

A running stride analysis was performed on the two subjects to determine running temporal and kinematic parameters across varying shoes. The shoes tested were as follows: a regular pair of running shoes, and two pairs of running shoes designed to return energy to the runner ("Applicant's shoe"). The concept behind Applicant's shoe is that it absorbs the energy of impact with the ground and is able to transfer that energy back to the runner in the latter phases of stance, thus improving running economy. It was hypothesized that there would be observable changes in the running kinematics, notably, decreased stance time combined with an increased swing time (time in the air) as well as increased leg extension in late stance as the shoe returned energy.

Data was collected on one male (Subject 1) and one female (Subject 2). Eighteen joint markers were placed bilaterally on the following landmarks: the lateral aspect of the head of the $5^{th}$ metatarsal, the lateral malleolus, lateral approximation of the axis of rotation of the knee, lateral approximation of the axis of rotation of the hip, iliac crests, lateral approximation of the shoulder axis of rotation, lateral elbow, wrist, forehead and chin. Subject 1 was filmed with 3 video cameras at a frame rate of 30 frames per second while running on a treadmill at 10.0 mph (4.47 m/s). The trial order was: regular shoes, energy return shoes, lightweight energy return shoes. Subject 2 was filmed while running at 8.6 mph (3.84 m/s) and 10.0 mph (4.47 m/s). The video data was analyzed using the Ariel Performance Analysis System (APAS) to generate a three-dimensional image of the subject for each of the three trials. Trial information is provided below:

| Subject | Trial | Speed (m/s) | Shoe |
|---|---|---|---|
| 1 | 1 | 4.47 | Regular |
| 1 | 2 | 4.47 | Energy Return |
| 1 | 3 | 4.47 | Light Energy Return |
| 2 | 1 | 3.84 | Regular |
| 2 | 2 | 4.47 | Regular |
| 2 | 3 | 3.84 | Light Energy Return |
| 2 | 4 | 4.47 | Light Energy Return |

The temporal measure of the running stride were determined to be as follows:

TABLE 1

Temporal Stride Measurements

| Subject | Speed (m/s) | Trial Number | Stance Time(s) | Swing Time(s) | Stride Rate(s) |
|---|---|---|---|---|---|
| 1 | 4.47 | 1 | 0.207 | 0.420 | 0.627 |
| 1 | 4.47 | 2 | 0.207 | 0.426 | 0.633 |
| 1 | 4.47 | 3 | 0.207 | 0.413 | 0.620 |
| 2 | 3.84 | 1 | 0.217 | 0.450 | 0.667 |

TABLE 1-continued

Temporal Stride Measurements

| Subject | Speed (m/s) | Trial Number | Stance Time(s) | Swing Time(s) | Stride Rate(s) |
|---|---|---|---|---|---|
| 2 | 4.47 | 2 | 0.206 | 0.440 | 0.647 |
| 2 | 3.84 | 3 | 0.206 | 0.440 | 0.647 |
| 2 | 4.47 | 4 | 0.203 | 0.437 | 0.640 |

The general sagittal plane-kinematic variables of stride length, vertical displacement and R foot travel are shown below. Stride length was determined from the rate determined above and the treadmill velocity, which was assumed to remain constant. The vertical displacement is the measure of the sagittal plane travel of the forehead marker. The travel of the right foot is the measure of the foot's sagittal displacement through one complete stance and swing cycle.

TABLE 2

General Kinetic Measurements

| Subject | Speed (m/s) | Trial Number | Stride Length (m) | Vertical Displacement (cm) | R Foot travel during one running stride (m) |
|---|---|---|---|---|---|
| 1 | 4.47 | 1 | 2.80 | 6.0 | 1.95 |
| 1 | 4.47 | 2 | 2.83 | 5.8 | 2.01 |
| 1 | 4.47 | 3 | 2.77 | 5.0 | 1.94 |
| 2 | 3.84 | 1 | 2.56 | 6.9 | 1.91 |
| 2 | 4.47 | 2 | 2.89 | 5.8 | 2.00 |
| 2 | 3.84 | 3 | 2.48 | 6.4 | 1.86 |
| 2 | 4.47 | 4 | 2.86 | 5.8 | 2.01 |

The lower extremity sagittal plane kinematics were determined for the right side. This included the hip, knee and ankle angles. Hip angle was calculated as the angle between the high and the pelvis and an increasing angle equals hip extension. Knee angle was calculated as the angle between the thigh and the shank segments and an increasing angle equals extension. Ankle angle was calculated as the angle between the shank and the foot and an increasing angle equals plantarflexion.

The maximum hip extension was observed just prior to toe off and maximum hip flexion was observed just prior to heel strike.

TABLE 3

Hip Kinematics

| Subject | Speed (m/s) | Trial Number | Maximum hip extension (degrees) | Maximum hip flexion (degrees) | Range of motion of the hip (degrees) |
|---|---|---|---|---|---|
| 1 | 4.47 | 1 | 171.2 | 130.4 | 40.8 |
| 1 | 4.47 | 2 | 166.8 | 128.2 | 38.6 |
| 1 | 4.47 | 3 | 171.2 | 131.0 | 40.2 |
| 2 | 3.84 | 1 | 157.2 | 96.2 | 54.8 |
| 2 | 4.47 | 2 | 151.0 | 96.2 | 54.8 |
| 2 | 3.84 | 3 | 157.0 | 113.6 | 43.4 |
| 2 | 4.47 | 4 | 158.2 | 108.9 | 49.3 |

Knee angles indicated a yielding phase of knee flexion during the beginning of stance followed by knee extension through toe-off. During swing the knee rapidly flexed and then extended prior to heel strike. Range of motion of the yielding phase and the extension phase of stance are shown below, as is the maximum knee flexion observed during swing.

TABLE 4

Knee Kinematics

| Subject | Speed (m/s) | Trial Number | Knee Flexion during stance (degrees) | Knee Extension during stance (degrees) | Maximum knee flexion during swing (degrees) |
|---|---|---|---|---|---|
| 1 | 4.47 | 1 | 14.7 | 16.1 | 75.5 |
| 1 | 4.47 | 2 | 14.2 | 12.2 | 81.6 |
| 1 | 4.47 | 3 | 19.7 | 27.2 | 78.2 |
| 2 | 3.84 | 1 | 13.4 | 27.2 | 76.8 |
| 2 | 4.47 | 2 | 22.1 | 28.7 | 69.4 |
| 2 | 3.84 | 3 | 18.2 | 26.1 | 78.0 |
| 2 | 4.47 | 4 | 18.5 | 26.7 | 75.0 |

Ankle angle ranges of motion are shown in Table 5. The ankle plantarflexed during the initial phase of stance. Ankle dorsiflexion was observed through mid-stance and then plantarflexion from late stance through the initial phase of swing.

TABLE 5

Ankle Kinematics

| Subject | Speed | Trial Number | Ankle Range of Motion (degrees) |
|---|---|---|---|
| 1 | 4.47 | 1 | 29 |
| 1 | 4.47 | 2 | 27 |
| 1 | 4.47 | 3 | 42 |
| 2 | 3.84 | 1 | 43 |
| 2 | 4.47 | 2 | 39 |
| 2 | 3.84 | 3 | 53 |
| 2 | 4.47 | 4 | 45 |

This study attempted to quantify kinematic and temporal changes in running mechanics at two speeds with two subjects across different types of footwear. General observations from this study can be made.

There were few changes in the temporal measures of stride rate, stance and swing times. Subject 1 had a slightly shorter stride rate in the third trial, meaning turnover had increased. The lack of differences may in part be due to the frame rate used in this study. The frame rate of 30 frames per second is inadequate to determine the precise moments of foot strike and toe off. This study did not use a mechanical foot switch to determine heel strike more accurately.

Subject 1 had a lower vertical displacement during trial 3 compared to trials 1 and 2. This could be an indication of better running economy. A lower vertical displacement may indicate less energy being expended to raise the body's center of mass, which could result in lower physiological costs.

There was an interesting difference in the kinematic parameters of the knee and ankle when comparing the trials 1 and 2 with trial 3 of Subject 1. There was a relatively higher degree of knee flexion during the yield phase of stance followed by a greater degree of knee extension. This could indicate that energy is being stored during the yield phase of trial 3 and returned to the lower extremity during the push off phase. The energy transfer might be observed as a greater knee extension during push off. The ankle kinematics followed a similar pattern. The range of motion of the ankle was greater in trial 3 than in the other two trials. These differences were not noted in Subject 2 across the same speeds.

It is interesting to note that the "original" energy return shoe showed few differences from the regular running shoe of trial 1. The patterns described above should be examined with a more complete study to determine if the shoe in trial 3 is significantly different than the other shoes.

3. F-Scan Tests

Two F-Scan Tests were performed to show how Applicant's shoe tends to spread out high pressure areas of the feet from the ground up. Applicant's shoe was tested against Mizuno Wave Rider Technology, which claims to have 22% more shock absorbency than any current midsole technology.

Applicant's invention had a profound ability to spread out high-pressure areas of the foot from the ground up. A close comparison can be drawn to the effect an orthotic gives to the foot. Orthotics correct negative foot movements from the ground up to stabilize the foot in a neutral position instead of over-pronation or over-supination. In the forefoot, or ball of the foot, each metatarsal head gets a more equal share of the load placed upon it. As the biomechanics place heavy loads on certain metatarsals, the load will get shared by the others. The F-scan tests particularly demonstrated the equal loading of the metatarsals, significantly less amount of heel pressure when wearing Applicant's shoe.

4. Shock Absorption Tests

Shock absorption tests were performed on Applicant's shoe and the standard shoe. The shock absorption test uses a heel impact test machine constructed by ARTECH, featuring a one-inch diameter steel rod guided by a pair of linear ball bearings. The rod weighs eight pounds and a three pound weight is clamped to the rod to give a total weight of eleven pounds. A five hundred pound load cell placed under the specimen measures force produced during impact. Force and displacement are recorded by a computer using a 12-bit data acquisition system, for 256 milliseconds at millisecond intervals.

The ARTECH system uses a load cell under the specimen rather than an accelerometer on the drop shaft. G-force is calculated by subtracting the weight of the drop shaft and the spring force from the peak load force, which may offer a more direct measure of comfort.

The computer software calculates peak load and g-force as indicated above, and calculates energy return by comparing the height of the first rebound to the drop height at full compression.

The test data is the average of 10 drops for each style of footwear. In general, lower loads and shock (g value) suggest more comfort to the wearer. High-energy returns, while not as critical for comfort, may provide an appealing "spring" in the step, may reduce energy expenditure, and may indicate a resistance to packing down of the cushion material.

To provide a general comparison to the attached test results, a very comfortable athletic shoe produced a g value of 5.4, which included the rubber sole, EVA midsole and sockliner. A very uncomfortable athletic shoe had a g value of 8.7 and a men's loafer 16.2 fees.

The test procedure was slightly modified while testing these shoes. The submitted shoes were tested with the normal eleven pond weight and then with an added weight to total twenty-two pound weight. The shoes were also tested on a flat surface and at a 30° angle.

The test results are shown in the table below.

| Sample ID | | | Mizuno Shoe | |
|---|---|---|---|---|
| Property Assessed | Applicant's Shoe | | | 22 lb. |
| Heel Drop | 11 lb. Load | 22 lb. Load | 11 lb. Load | Load |
| Shock Absorption Avg. (R & L shoes) "g" Value | 1.12 | 1.09 | 1.13 | 1.10 |
| Energy Returned % | 83.3 | 86.2 | 82.9 | 79.0 |
| Drop Height | .7683 | 0.6111 | 0.8314 | 0.8107 |
| | | | 30° angle | |
| | 30° angle | | | 22 lb. |
| Heel Drop | 11 lb. Load | 22 lb. Load | 11 lb. Load | Load |
| Shock Absorption Avg. (R & L shoes) "g" Value | 1.10 | 1.00 | 1.11 | 1.12 |
| Energy Returned % | 84.0 | 70.75 | 83.4 | 88.0 |
| Drop Height (in.) | .5808 | 0.8438 | 0.5407 | 0.7675 |

5. Physics Testing

Three general phenomenon are observed with Applicant's invention:

1. VERTICAL ENERGY RETURN—the shoe vertically returns or rebounds from where the user started.

2. GUIDANCE—the shoe actually moves vertically without the side-to-side movement.

3. CUSHIONING UPON IMPACT—the shoe continues to move for a longer duration than conventional athletic footwear, creating greater shock absorption.

When the shoe strikes the ground while running, the user decelerates and loses energy. Then, energy is needed to lift the foot and leg up against gravity to start the next stride. Because Applicant's invention returns a quantifiable amount of energy to assist in lifting the foot, heel and lower leg, less work (energy) is needed to run, and less oxygen is required to perform. This energy return can be defined as an "unweighing" of an individual.

A device was utilized that could hold any brand of athletic shoe, impacting the wall vertically and measuring recorded data from the length of rebound off the wall, the distance each shoe returned from the wall (measurements taken at 12" and 18") and weighted (117 lbs) giving us the energy return data used in the testing. Shoes used: Nike Air Tailwind, Nike Air Triax, Asics Gel Kayano, Asics Gel 2030, Brooks Beast, Saucony Grid Hurricane and Applicant's shoe. Applicant's shoe returned up to 22% more energy than current athletic shoe offerings.

6. Vertical Leap Testing & Measurement Two different methods of testing vertical leap may be performed to compare vertical leaping ability of Applicant's shoe with current athletic footwear.

For the first test, at the University of Colorado Boulder campus, the athletic department training room uses a vertical leap-measuring device called a VERTECK. This device is commonly found in university, college and selected high school athletic training centers. The VERTECK is a free-standing, movable, vertically adjustable pole-like device with colored plastic strips representing various measurements.

First, a standing vertical reach is established. Standing flat-footed, with one or both arms extended vertically and stretching the fingertips, the subject tries to move the plastic strips out of the way. The mark where the strips are moved—or height—represents that subject's vertical reach. This height also represents the starting point for measurement vertically.

The subject then warms up by stretching, running, bounding and jumping. Tests may be performed by a minimum of 2 subjects each sequence.

The first subject stands directly under the VERTECK device, crouches down, then leaps vertically, knocking away the plastic strips. The measurement between standing vertical reach (or zero) and the highest plastic strip to move is the vertical leap measurement. The test may then proceed as follows.

Round 1: Subject 1 uses Fila footwear—2 attempts lumps) would be measured.

Subject 2 uses Applicant's shoe—2 attempts would be measured.

Round 2: Subject 1 uses Applicant's shoe.

Subject 2 uses Fila footwear.

Continue the Rounds by the subjects until exhausted.

Record and compare all Rounds and attempts by each subject.

A comparative test has not yet been conducted using a prototype of Applicant's invention and the VERTECK device. If the VERTECK device is not available, a second measuring protocol may be used. As in method 1, vertical reach may be established by chalking the middle finger-tip of the subject and standing flat-footed, sideways to a vertical wall or 45 degree angle to a vertical wall, or facing the wall. Reaching vertically, the top of the chalk mark is determined to be the vertical reach. By re-chalking the finger-tip with each vertical leap attempt, and measuring the distance from the vertical reach to the top of the finger-tip chalk mark, the vertical leap is determined. For this test, Applicant recorded subjects, number of attempts and scores with each leap. An average of 10% vertical leap improvement was exhibited using Applicant's shoe versus the Fila shoe in both tests.

It should be appreciated that various elements from the different embodiments described herein may be incorporated into other embodiments without departing from the scope of the invention. It should also be understood that certain variations and modifications will suggest themselves to one of ordinary skill in the art. In particular, any dimensions given are purely exemplary and should not be construed to limit the present invention to any particular size or shape. The scope of the present invention is not to be limited by the illustrations or the foregoing description thereof, but rather solely by the appended claims.

What is claimed is:

1. An energy return system for footwear, comprising:

at least one layer of stretchable material having a first side and a second side;

a plurality of chambers positioned on either the first side or the second side of the layer; and a plurality of actuators each vertically aligned with a corresponding chamber and positioned opposite said chamber across said at least one layer of stretchable material, such that when the footwear receives a generally vertical compressive force, each actuator pushes against said at least one layer and moves at least partially into a corresponding chamber;

wherein each of said plurality of actuators is selectively positioned to provide individual support to a specific portion of the human foot, each said actuator substantially underlying only said specific portion and underlying substantially the entire extent of said portion, said portion being selected from the group consisting of a toe, a toe region that includes the five toes of the human foot, a metatarsal bone, a metatarsal region that includes the five metatarsals of the human foot, a metatarsal portion extending between adjacent metatarsal bones and a heel.

2. The system of claim 1, wherein the actuators have varying rigidity.

3. The system of claim 1, wherein the actuators are tapered to decrease in thickness toward the front of the footwear.

4. The system of claim 1, wherein at least some of the actuators are dome-shaped.

5. The system of claim 1, wherein a primary actuator is positioned beneath the location of the human heel.

6. The system of claim 1, wherein a plurality of U-shaped actuators are positioned to cradle the heel of the human foot.

7. The system of claim 1, wherein an individual actuator is disposed underneath each of the toes of a human foot.

8. The system of claim 1, wherein a plurality of actuators is disposed such that each of the metatarsal bones of a human foot is cradled by a pair of actuators.

* * * * *